US005736299A

United States Patent [19]

Watanabe et al.

[11] Patent Number: 5,736,299

[45] Date of Patent: Apr. 7, 1998

[54] SILVER HALIDE COLOR PHOTOGRAPHIC MATERIAL COMPRISING A MAGENTA OR CYAN COUPLER AND A HYDRAZINE COMPOUND

[75] Inventors: Toshiyuki Watanabe; Hiroshi Fukuzawa; Michio Ono; Takashi Nakamura, all of Minami-ashigara, Japan

[73] Assignee: Fuji Photo Film Co., Ltd., Kanagawa, Japan

[21] Appl. No.: 590,323

[22] Filed: Jan. 23, 1996

[30] Foreign Application Priority Data

Jan. 23, 1995 [JP] Japan ..... 7-025810
Jan. 25, 1995 [JP] Japan ..... 7-027753

[51] Int. Cl.[6] ..... G03C 7/32

[52] U.S. Cl. ..... 430/379; 430/407; 430/409; 430/410; 430/264; 430/505; 430/551; 430/558; 430/598

[58] Field of Search ..... 430/505, 264, 430/379, 407, 409, 410, 551, 558, 598

[56] References Cited

U.S. PATENT DOCUMENTS 4,999,275 3/1991 Kasama et al. ..... 430/264

FOREIGN PATENT DOCUMENTS 0283041 9/1988 European Pat. Off. ..... 430/598
3-154051 7/1991 Japan .
5-142688 6/1993 Japan .
5-173281 7/1993 Japan .
5-232651 9/1993 Japan .

*Primary Examiner*—Janet C. Baxter

[57] ABSTRACT

A silver halide color photographic material is disclosed, wherein it comprises a support having thereon one or more constituent layers including at least one silver halide emulsion layer, wherein at least one hydrophilic colloid layer of said constituent layers contains a coupler represented by the following formula (M) or formula (I) and at least one hydrophilic colloid layer of said constituent layers contains a compound represented by the following formula (H):

(M)

(I)

20 Claims, No Drawings

SILVER HALIDE COLOR PHOTOGRAPHIC MATERIAL COMPRISING A MAGENTA OR CYAN COUPLER AND A HYDRAZINE COMPOUND

FIELD OF THE INVENTION

The present invention relates to a silver halide color photographic material and, more particularly, to a silver halide color photographic material which is excellent in color reproducibility and improved in storage stabilities of a photographic material and an image.

The present invention relates to a silver halide color photographic material containing a cyan dye-forming coupler or a magenta dye-forming coupler and, in particular, to a silver halide color photographic material improved in color turbidity during processing, storage stability under high temperature, spot failure, and color image fastness.

BACKGROUND OF THE INVENTION

In recent years, a color photographic material has been improved in sensitivity, image quality and color reproducibility due to technical improvements in silver halide emulsions, couplers and other functional organic materials.

On the other hand, although the storage stability of a photographic material and the image stability have been considerably improved, the storage stability is not yet sufficient and further improvements have been desired. Furthermore, the storage stability of a photographic material and the image stability are often incompatible with high sensitization and image quality improvement, therefore, these are important problems to be solved from now on.

In a color photographing material, in particular, in a color reversal material, the compatibility of these high sensitivity, high image quality and storage stability is an important problem.

On the contrary, reducing organic materials have been conventionally used in a color photographic material for purposes of preventing color turbidity (color mixing) between emulsion layers, gradation controlling (hard gradation at highlight areas) of a color image, preventing emulsion fog and decomposition of coexisting organic materials. (Hereinafter for simplicity, the compounds which are used for these purposes are represented by "color mixing preventives".) For these purposes, in general, hydroquinone derivatives have been used. Other than hydroquinone derivatives, hydrazine derivatives are known (U.S. Pat. Nos. 4,923,787 and 5,230,992) and partly put in a practical use. However, these hydroquinone derivatives and the like have not manifested sufficient effects.

The present inventors have found that these hydroquinone derivatives and the like deteriorate the storage stability of a photographic material and color image stability under certain storage conditions. As the causes thereof have not been sufficiently made clear, but it was unexpected that hydroquinone derivatives affect discoloration (fastness) due to light of dyes formed by pyrazoloazole magenta couplers present in other layers.

A technique of preventing color turbidity between layers by using a pyrazoloazole magenta coupler in combination with a hydrazine compound is disclosed in JP-A-3-154051 (the term "JP-A" as used herein refers to a "published unexamined Japanese patent application"), but there are not found descriptions concerning the discoloration (fastness) due to light and the storage stability of the present invention.

From the foregoing, the development of "color mixing preventives" called in the present invention has become a new subject.

By the way, 5-pyrazolone type magenta couplerd are generally used as a magenta coupler in a silver halide color photographic material, but since the color dye thereof has an unnecessary side absorption, there is a disadvantage such that the color reproducibility is impaired, otherwise they have a load of using a colored coupler or bearing an excessive interlayer effect to correct side absorption. Accordingly, the development of a coupler which forms a dye having less side absorption has been conducted.

Pyrazoloazole magenta couplers have been developed in place of the conventional 5-pyrazolone magenta couplers such as disclosed, for example, in U.S. Pat. Nos. 3,725,067 and 4,540,654. They are preferred in view of forming a magenta dye having less unnecessary absorption and have been partly put in a practical use. However, specific compounds of these pyrazoloazole magenta couplers disclosed in the above patents have a drawback of adversely affecting the aging stability of a photographic material and color image storability when incorporated into a photographic material, therefore, sufficiently satisfactory usages have not yet been established. To cope with these problems, couplers the substituents on the pyrazoloazole rings of which have been variously contrived have been proposed. For example, with respect to the light fastness of color images, the improvements by couplers who have bulky substituents at the 6-position are disclosed in U.S. Pat. No. 4,882,266, European Patent Publication No. 558145, U.S. Pat. No. 4,675,280 and European Patent Publication No. 183445. However, either of them has not yet reached a sufficient level of the storage stability required in recent years.

On the other hand, a phenol coupler and a naphthol coupler have been used as a cyan dye-forming coupler.

In recent years, heightening of an image quality has been discussed, and the use of a pyrrolopyrazole cyan coupler has been proposed in EP-A-456226 for improve hue and heat fastness which are drawbacks of the above described conventionally used couplers.

However, a pyrrolopyrazole coupler has disadvantages such that the color image fastness thereof deteriorates under high humidity conditions, in particular, in a low density region, and since it has a high coloring ability, color turbidity due to color mixing between layers increases. With respect to this problem, it is disclosed in JP-A-5-232651 (the term "JP-A" as used herein refers to a "published unexamined Japanese patent application") that this color turbidity can be improved by the combined use of a pyrroloazole cyan coupler with a hydrazine compound.

However, it has become clear that a satisfactory performance of color image stability cannot be obtained yet even by the above combination, the reduction of maximum density occurs when a material is preserved under high temperature and, further, when a pyrroloazole cyan coupler is present together with a hydrazine compound in the same layer, spot-like non-coloring portions of 50 μm or more are generated in color image portions after processing.

This non-coloring micro spot, in particular, in a photographing material, in some case, becomes a size to be observed visually on a printed matter in the case when the photographed film images are further enlarged when printing, as a result, it becomes a serious obstacle.

Further, color turbidity is conspicuously aggravated in a color reversal photographic material in which the material is processed with a color developing solution having a pH 11 or more, therefore, it has been strongly desired to improve these problems.

SUMMARY OF THE INVENTION

Accordingly, the object of the present invention is to provide a silver halide color photographic material which is excellent in color reproducibility and improved in aging stability of a photographic material and storage stability of an image.

Another object of the present invention is to provide a silver halide color photographic material having a layer coated with a pyrroloazole cyan coupler is improved in storage stability under high temperature.

The present inventors have earnestly studied the above described problems and have found that these objects of the present invention can be achieved by the following means.

(1) A silver halide color photographic material comprising a support having thereon one or more constituent layers including at least one silver halide emulsion layer, wherein at least one hydrophilic colloid layer of said constituent layers contains a coupler represented by the following formula (M) or formula (I) and at least one hydrophilic colloid layer of said constituent layers contains a compound represented by the following formula (H):

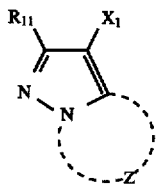

(M)

wherein $R_{11}$ represents a hydrogen atom or a substituent; Z represents a non-metallic atomic group necessary to form a 5-membered azole ring containing from 2 to 4 nitrogen atoms, and said azole ring may have a substituent (including a heterocyclic ring); and $X_1$ represents a hydrogen atom or a group capable of being eliminated upon coupling reaction with the oxidized product of a developing agent:

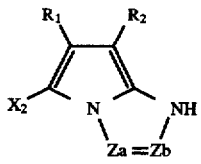

(I)

wherein Za represents —C($R_3$)= or —N=, when Za represents —N=, Zb represents —C($R_3$)= and when Za represents —C($R_3$)=, Zb represents —N=; $R_1$ and $R_2$ each represents an electron attractive group having a Hammett's substitution constant $\sigma_p$ value of from 0.20 to 1.0; $R_3$ represents a substituent; and $X_2$ represents a hydrogen atom or a group being eliminated upon coupling reaction with an oxidized product of a color developing agent:

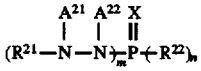

(H)

wherein $R^{21}$ represents an aryl group or a heterocyclic group; $R^{22}$ represents an alkyl group, a cycloalkyl group, an aryl group, an alkoxyl group or an aryloxy group; $A^{21}$ and $A^{22}$ each represents a hydrogen atom or a group being eliminated by alkali; m represents 1, 2 or 3; n represents 0, 1 or 2, the total of m and n is 3, when n represents 2, two groups represented by $R^{22}$ may be the same or different, and they may be bonded to each other to form a cyclic structure containing a phosphorus atom; and Y represents a sulfur atom or an oxygen atom, which may form a dimer or more polymer by bonding at $R^{21}$ or $R^{22}$, provided that $R^{21}$ is not a phenyl group substituted with an acylamino group at the p-position, and when $R^{22}$ represents an unsubstituted phenoxy group, $R^{21}$ does not represent a phenyl group substituted at the p-position with a substituted or unsubstituted benzenesulfonamido group or a phenyl group substituted with a hydroxyl group at the p-position.

(2) A silver halide color photographic material as described in (1), wherein at least a light-insensitive layer adjacent to the silver halide emulsion layer containing the coupler represented by formula (M) or formula (I) contains the compound represented by formula (H).

(3) A silver halide color photographic material as described in (1), wherein at least the silver halide emulsion layer containing the coupler represented by formula (M) or formula (I) contains the compound represented by formula (H).

(4) A silver halide color photographic material as described in (1), wherein the compound represented by formula (H) is contained in both the silver halide emulsion layer containing the coupler represented by formula (M) or formula (I) and a light-insensitive layer adjacent to said silver halide emulsion layer.

(5) A process for processing a silver halide color photographic material as described in (1), wherein the silver halide color photographic material is color development processed after black-and-white development process.

(6) A process for processing a silver halide color photographic material as described in (1), wherein said silver halide color photographic material is subjected to imagewise exposure and black-and-white development processing, then processed with a color developing solution having pH of 11 or more.

DETAILED DESCRIPTION OF THE INVENTION

The present invention will be described in detail below.

At first, the compound represented by formula (M) is described.

The preferred coupler skeletons represented by formula (M) for use in the present invention include 1H-imidazo[1,2-b]pyrazole, 1H-pyrazolo[1,5-b][1,2,4]triazole, 1H-pyrazolo[5,1-c][1,2,4]triazole and 1H-pyrazolo[1,5-d]-tetrazole, and represented by formulae (M-I), (M-II), (M-III) and (M-IV), respectively.

More preferred are the compounds represented by formulae (M-II) and (M-III).

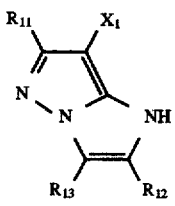

(M-I)

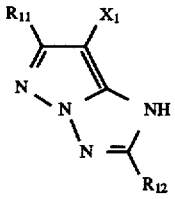

(M-II)

-continued

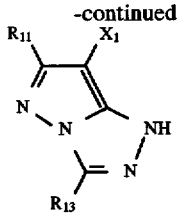

(M-III)

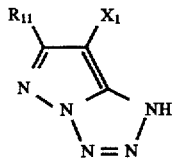

(M-IV)

Substituents $R_{11}$, $R_{12}$, $R_{13}$ and $X_1$ in the above formulae are described in detail.

$R_{11}$ represents a hydrogen atom, a halogen atom, an alkyl group, an aryl group, a heterocyclic group, a cyano group, a hydroxyl group, a nitro group, a carboxyl group, an amino group, an alkoxyl group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a sulfonyl group, an aryloxycarbonyl group, an acyl group, or an azolyl group, and $R_{11}$ may be a divalent group to form a bis form.

Further in detail, $R_{11}$ represents a hydrogen atom, a halogen atom (e.g., chlorine, bromine), an alkyl group (e.g., a straight chain or branched chain alkyl group having from 1 to 32 carbon atoms), an aralkyl group, an alkenyl group, an alkynyl group, a cycloalkyl group, a cycloalkenyl group, specifically, e.g., methyl, ethyl, propyl, isopropyl, t-butyl, tridecyl, 2-methanesulfonylethyl, 3-(3-pentadecylphenoxy) propyl, 3-[4-{2-[4-(4-hydroxyphenylsulfonyl)phenoxy] dodecanamido}phenyl]propyl, 2-ethoxytridecyl, trifluoromethyl, cyclopentyl, 3-(2,4-di-t-amylphenoxy) propyl), an aryl group (e.g., phenyl, 4-t-butylphenyl, 2,4-di-t-amylphenyl, 4-tetradecanamidophenyl), a heterocyclic group (e.g., 2-furyl, 2-thienyl, 2-pyrimidinyl, 2-benzothiazolyl), a cyano group, a hydroxyl group, a nitro group, a carboxyl group, an amino group, an alkoxyl group (e.g., methoxy, ethoxy, 2-methoxyethoxy, 2-dodecylethoxy, 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, 3-methoxycarbamoyl), an acylamino group (e.g., acetamido, benzamido, tetradecanamido, 2-(2,4-di-t-amylphenoxy)butanamido, 4-(3-t-butyl-4-hydroxyphenoxy)butanamido, 2-[4-(4-hydroxyphenylsulfonyl)phenoxy]decanamido), an alkylamino group (e.g., methylamino, butylamino, dodecylamino, diethylamino, methylbutylamino), an anilino group (e.g., phenylamino, 2-chloroanilino, 2-chloro-5-tetradecanaminoanilino, 2-chloro-5-dodecyloxycarbonylanilino, N-acetylanilino, 2-chloro-5-[α-( 3-t-butyl-4-hydroxyphenoxy)dodecanamido]anilino), a ureido group (e.g., phenylureido, methylureido, N,N-dibutylureido), a sulfamoylamino group (e.g., N,N-dipropylsulfamoylamino, N-methyl-N-decylsulfamoylamino), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-octylphenylthio, 3-pentadecylphenylthio, 2-carboxyphenylthio, 4-tetradecanamidophenylthio), an alkoxycarbonylamino group (e.g., methoxycarbonylamino, tetradecyloxycarbonylamino), a sulfonamido group (e.g., methanesulfonamido, hexadecansulfonamido, benzenesulfonamido, p-toluenesulfonamido, octadecanesulfonamido, 2-methyloxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-[3-(2,4-di-t-amylphenoxy)propyl]-carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (e.g., methanesulfonyl, octanesulfonyl, benzenesulfonyl, toluenesulfonyl), an alkoxycarbonyl group (e.g., methoxycarbonyl, butyloxycarbonyl, dodecyloxycarbonyl, octadecyloxycarbonyl), a heterocyclic oxy group (e.g., 1-phenyltetrazol-5-oxy, 2-tetrahydropyranyloxy), an azo group (e.g., phenylazo, 4-methoxyphenylazo, 4-pivaloylaminophenylazo, 2-hydroxy-4-propanoylphenylazo), an acyloxy group (e.g., acetoxy), a carbamoyloxy group (e.g., N-methylcarbamoyloxy, N-phenylcarbamoyloxy), a silyloxy group (e.g., trimethylsilyloxy, dibutylmethylsilyloxy), an aryloxycarbonylamino group (e.g., phenoxycarbonylamino), an imido group (e.g., N-succinimido, N-phthalimido, 3-octadecenylsuccinimido), a heterocyclic thio group (e.g., 2-benzothiazolylthio, 2,4-diphenoxy-1, 3,5-triazole-6-thio, 2-pyridylthio), a sulfinyl group (e.g., dodecanesulfinyl, 3-pentadecylphenylsulfinyl, 3-phenoxypropylsulfinyl), a phosphonyl group (e.g., phenoxyphosphonyl, octyloxyphosphonyl, phenylphosphonyl), an aryloxycarbonyl group (e.g., phenoxycarbonyl), an acyl group (e.g., acetyl, 3-phenylpropanoyl, benzoyl, 4-dodecyloxybenzoyl), or an azolyl group (e.g., imidazolyl, pyrazolyl, 3-chloropyrazol-1-yl, triazole).

Of these substituents, those which can further have substituents may have organic substituents such as connecting via a carbon atom, an oxygen atom, a nitrogen atom or a sulfur atom, or a halogen atom.

Of the above substituents, preferred as $R_{11}$ are an alkyl group, an aryl group, an alkoxyl group, an aryloxy group, an alkylthio group, a ureido group, and an acylamino group.

$R_{12}$ represents the same substituents as exemplified for $R_{11}$, and preferably represents a hydrogen atom, an alkyl group, an aryl group, a heterocyclic group, an alkoxycarbonyl group, a carbamoyl group, a sulfamoyl group, a sulfinyl group, an acyl group or a cyano group.

$R_{13}$ represents the same substituents as exemplified for $R_{11}$, preferably represents a hydrogen atom, an alkyl group, an aryl group, a heterocyclic group, an alkoxyl group, an aryloxy group, an alkylthio group, an arylthio group, an alkoxycarbonyl group, a carbamoyl group, or an acyl group, and more preferably an alkyl group, an aryl group, a heterocyclic group, an alkylthio group, or an arylthio group.

$X_1$ represents a hydrogen atom or a group being eliminated (or a separable group) upon reaction with the oxidized product of an aromatic primary amine color developing agent. The group being eliminated specifically includes a halogen atom, an alkoxyl group, an aryloxy group, an acyloxy group, an alkyl- or arylsulfonyloxy group, an acylamino group, an alkyl- or arylsulfonamido group, an alkoxycarbonyloxy group, an aryloxycarbonyloxy group, an alkyl-, aryl- or heterocyclic thio group, a carbamoylamino group, a 5- or 6-membered nitrogen-containing heterocyclic group, an imido group and an arylazo group. These groups may further be substituted with the substituents cited as the substituents for $R_{11}$.

More specifically, the separable group includes a halogen atom (e.g., fluorine, chlorine, bromine), an alkoxyl group (e.g., ethoxy, dodecyloxy, methoxyethylcarbamoylmethoxy, carboxypropyloxy, methylsulfonylethoxy, ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), an acyloxy group (e.g., acetoxy, tetradecanoyloxy, benzoyloxy), an alkyl- or arylsulfonyloxy group (e.g.,methanesulfonyloxy, toluenesulfonyloxy), an acylamino group (e.g., dichloroacetylamino, heptafluorobutyrylamino), an alkyl- or arylsulfonamido group (e.g., methanesulfonamino, trifluoromethanesulfonamino, p-toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an alkyl-, aryl- or heterocyclic thio group (e.g., dodecylthio, 1-carboxydodecylthio, phenylthio, 2-butoxy-5-t-octylphenylthio, tetrazolylthio), a carbamoylamino group (e.g., N-methylcarbamoylamino, N-phenylcarbamoylamino), a 5- or 6-membered nitrogen-containing heterocyclic group (e.g., imidazole, pyrazolyl, triazolyl, tetrazolyl, 1,2-dihydro-2-oxo-1-pyridyl), an imido group (e.g., succinimido, hydantoinyl), an arylazo group (e.g., phenylazo, 4-methoxyphenylazo), etc. $X_1$ in some case, in addition to the above, may take the form of a bis type coupler obtained by condensing 4-equivalent coupler with aldehydes or ketones as a separable group bonded via a carbon atom. Also, $X_1$ may contain photographically useful groups such as a development inhibitor or a development accelerator. $X_1$ preferably represents a halogen atom, an alkoxyl group, an aryloxy group, an alkyl- or arylthio group, or a 5- or 6-membered nitrogen-containing heterocyclic group bonding to the coupling active position via a nitrogen atom.

Specific examples of the magenta couplers represented by formula (M) are shown below, but it should not be construed as the present invention is limited thereto.

(M-1)

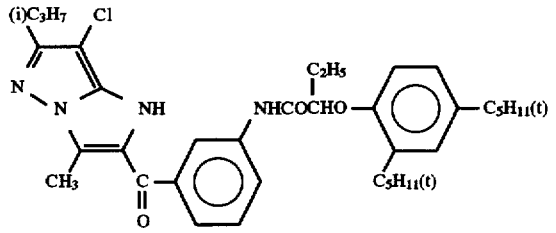

(M-2)

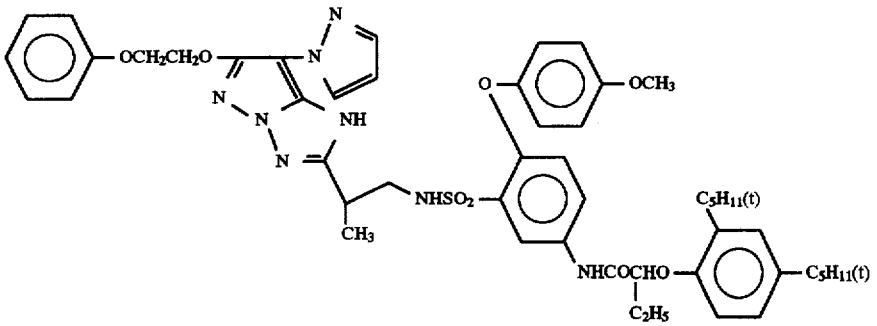

(M-3)

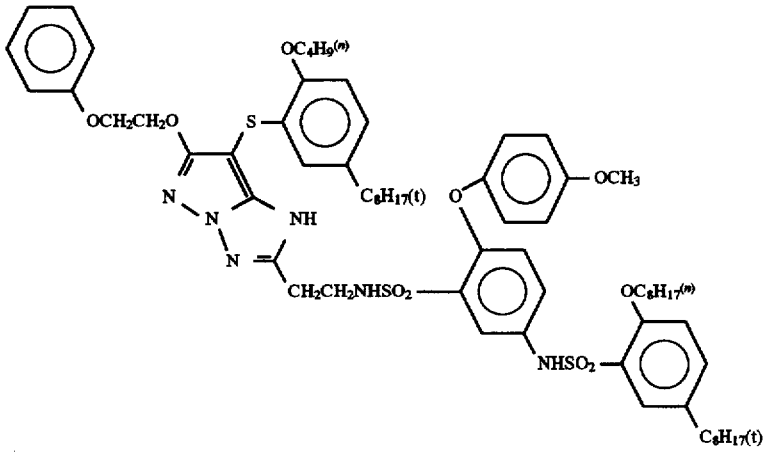

-continued
(M-4)
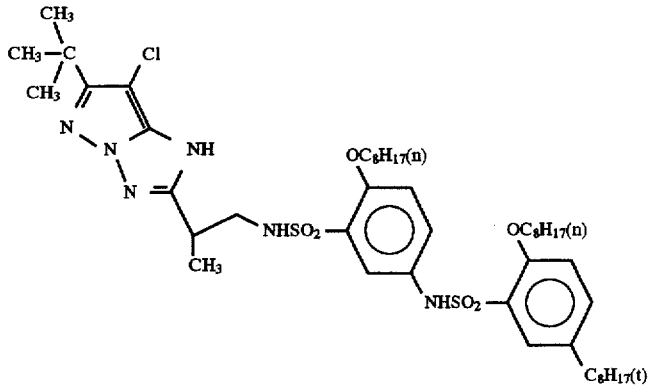
(M-5)
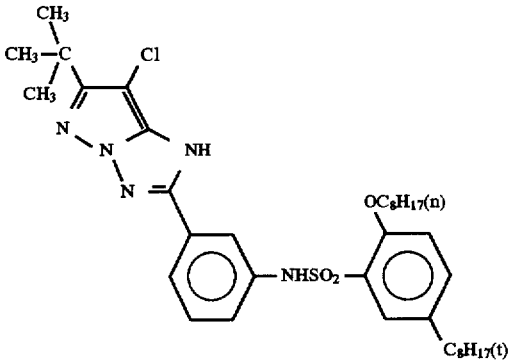
(M-6)
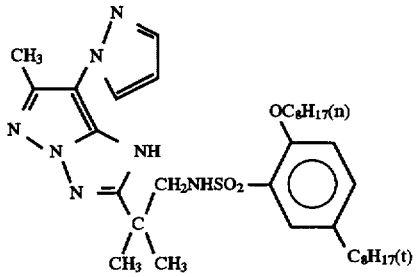
(M-7)
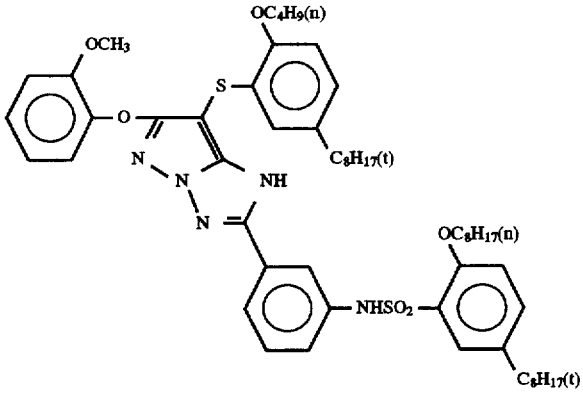
(M-8)
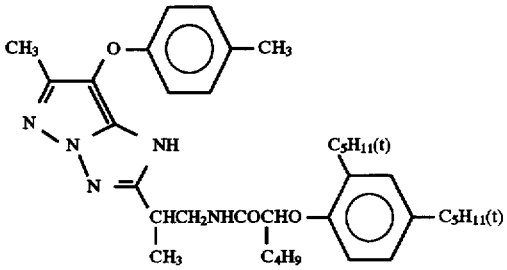
(M-9)
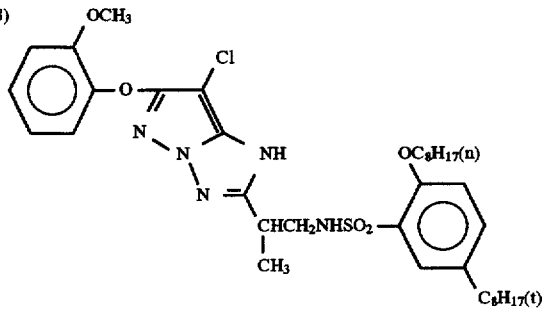

-continued
(M-10)
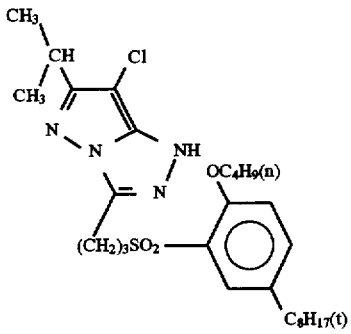
(M-11)
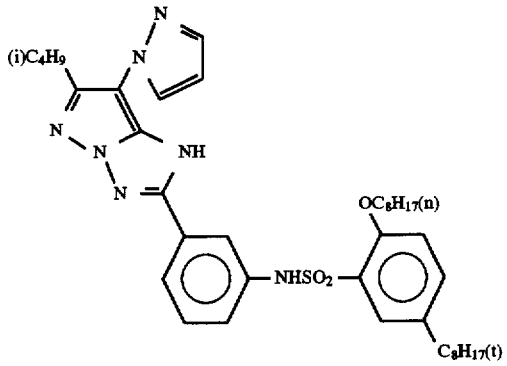
(M-12)
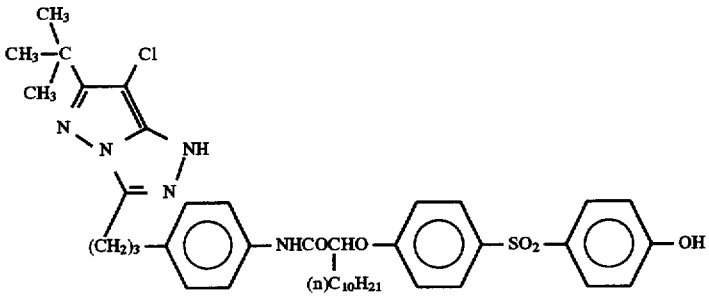
(M-13)
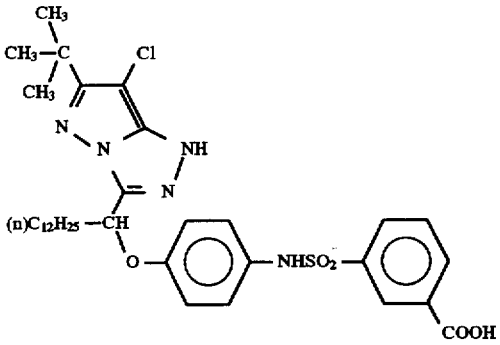
(M-14)
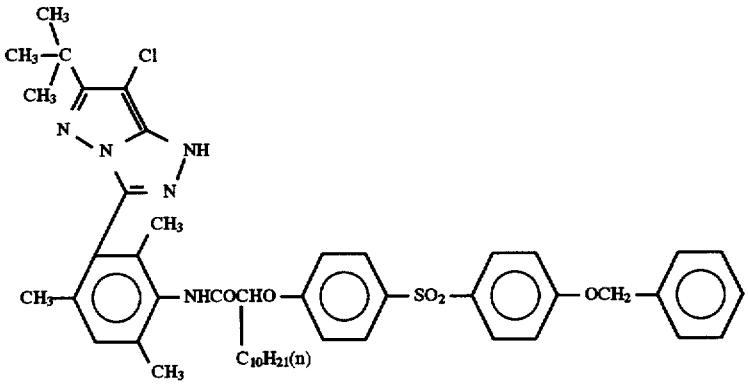

-continued
(M-15)
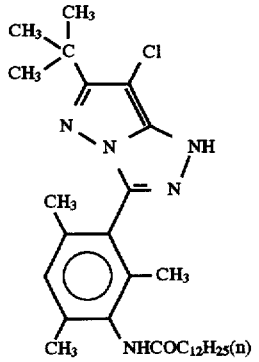
(M-16)
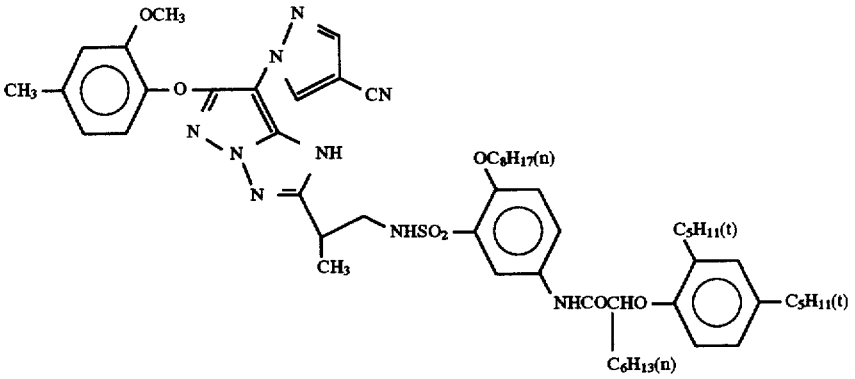
(M-17)
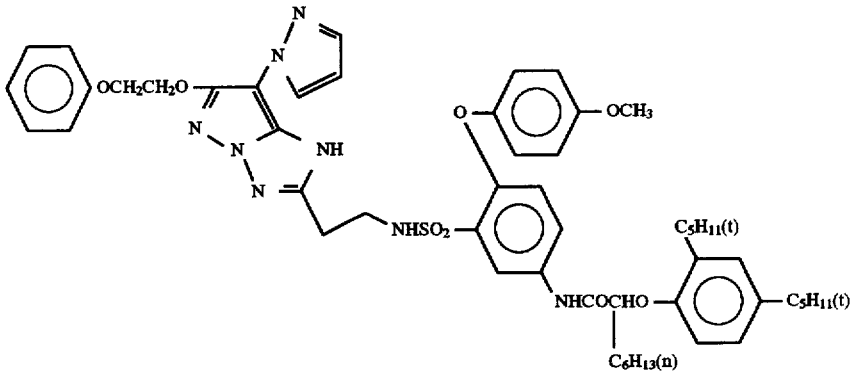
(M-18)
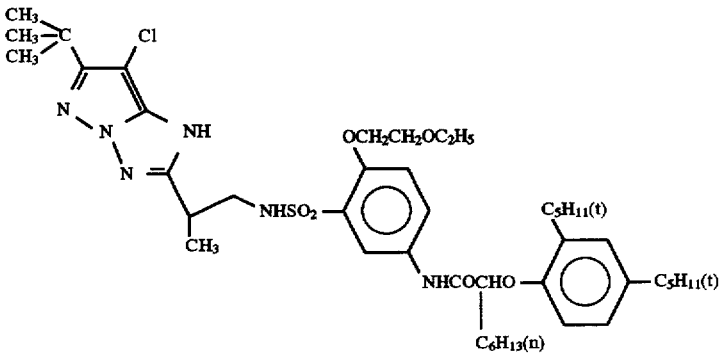

-continued
(M-21)
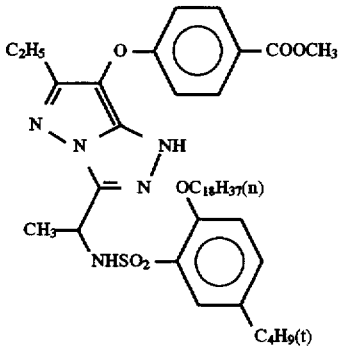
(M-22)
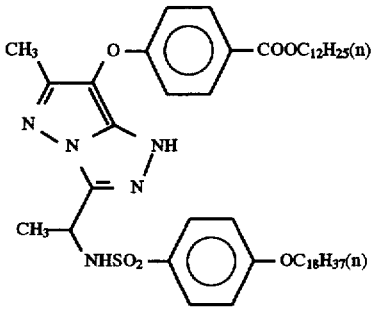
(M-23)
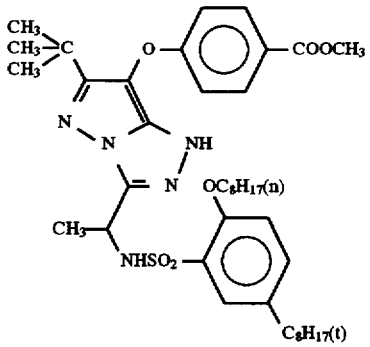
(M-19)
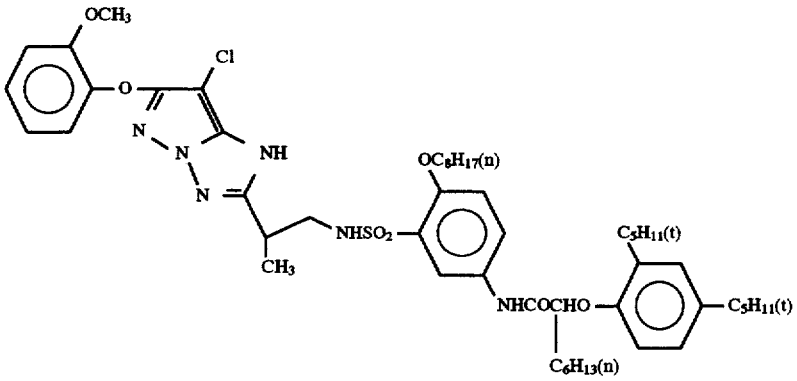
(M-20)
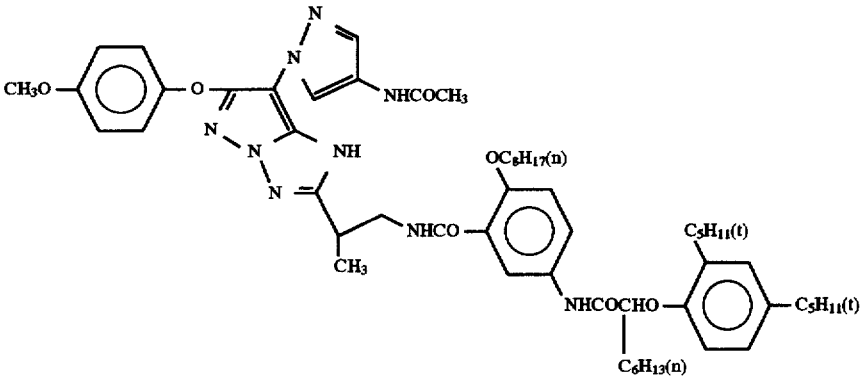

-continued
(M-24)
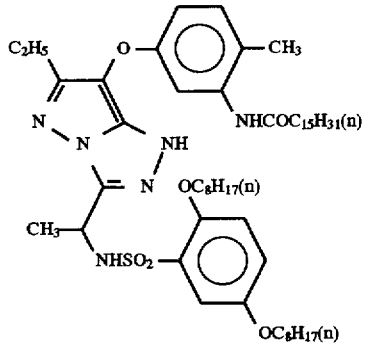
(M-25)
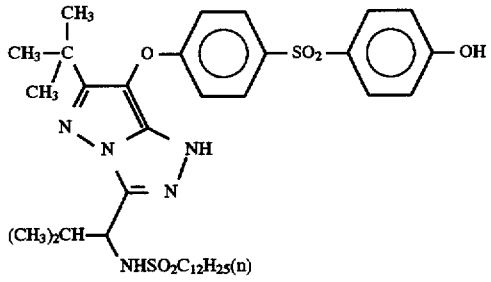
(M-26)
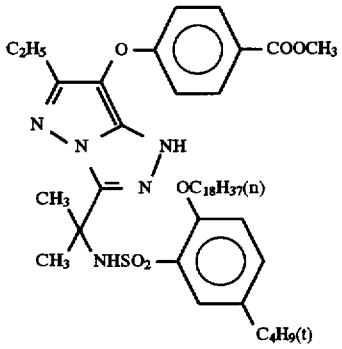
(M-27)
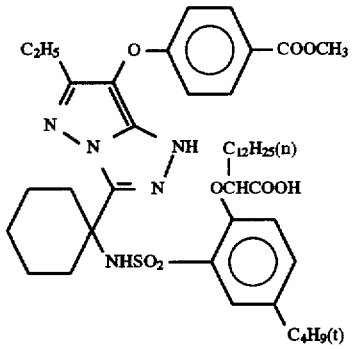
(M-28)
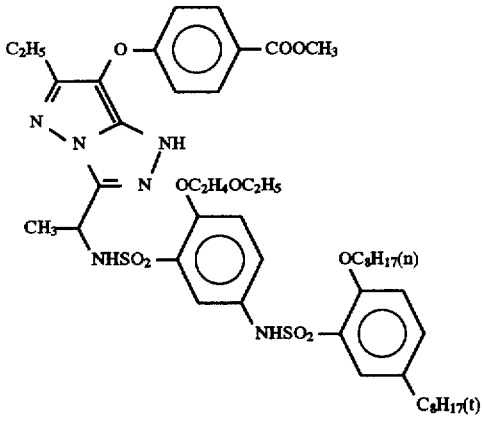
(M-29)
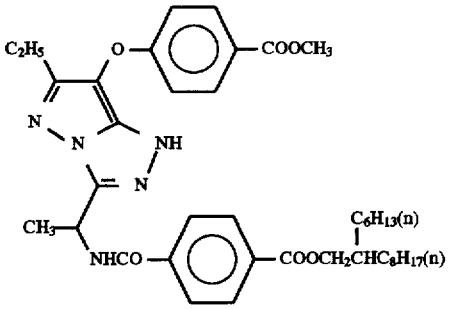
(M-30)
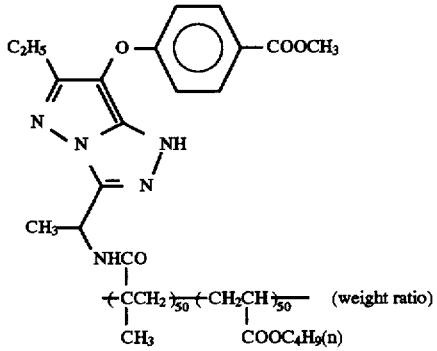
(M-31)
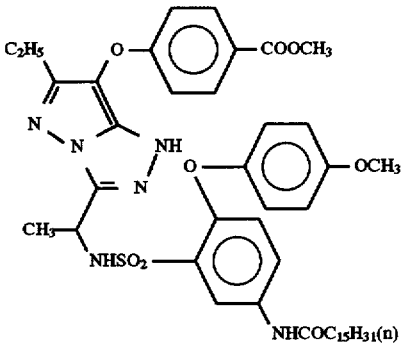

-continued (M-32)

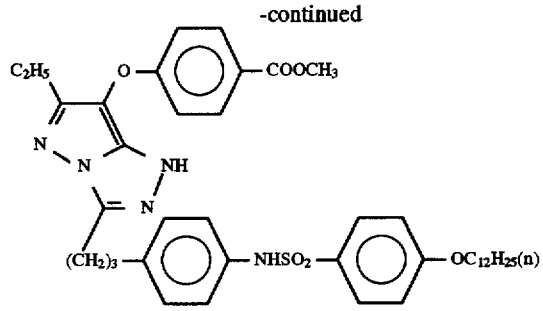

(M-33)

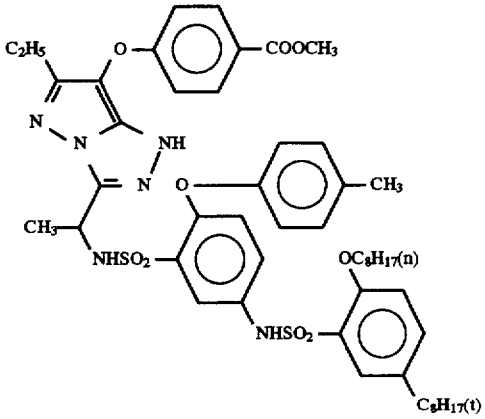

(M-34)

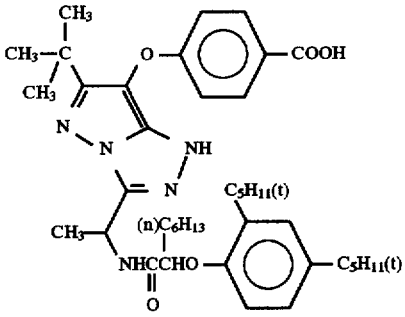

The literature in which the synthesis examples of the couplers represented by formula (M) are disclosed are listed below.

The compounds represented by formula (M-I) can be synthesized according to the methods disclosed in U.S. Pat. No. 4,500,630, (M-II) in U.S. Pat. Nos. 4,540,654, 4,705,863, JP-A-1-65245, JP-A-62-209457 and JP-A-62-249155, (M-III) in JP-B-47-27411 (the term "JP-B" as used herein refers to an "examined Japanese patent publication"), U.S. Pat. No. 3,725,067, and (M-IV) in JP-A-60-33552.

The magenta coupler represented by formula (M) of the present invention is added to a green-sensitive emulsion layer and/or the adjacent layers thereto, and the total addition amount is from 0.01 to 5.0 g/m$^2$, preferably from 0.05 to 1.0 g/m$^2$, and more preferably from 0.1 to 0.8 g/m$^2$. The addition method of the magenta coupler of the present invention to a photographic material is corresponding to the addition methods of other couplers described later, and the amount of a high boiling point organic solvent used as a solvent for dispersion is, in a weight ratio to the total amount of the couplers added in the layer as the magenta coupler of the present invention is added, from 0 to 10.0, preferably from 0 to 3.0, and more preferably from 0.1 to 1.5.

The couplers of the present invention represented by formula (I) can be specifically represented by the following formulae (II) and (III).

(II)

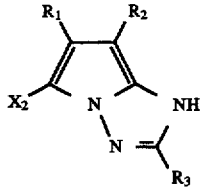

-continued (III)

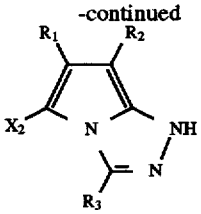

wherein $R_1$, $R_2$ and $R_3$ each has the same meaning as $R_1$, $R_2$ and $R_3$ in formula (I).

In the present invention, the couplers represented by formula (II) are particularly preferred.

$R_1$ and $R_2$ of the couplers of the present invention each represents an electron attractive group having a $\sigma_p$ value of from 0.20 to 1.0, and the sum total of $\sigma_p$ values of $R_1$ and $R_2$ is preferably 0.65 or more. The couplers of the present invention have an excellent performance as a cyan coupler by the introduction of such a strong electron attractive group. The sum total of $\sigma_p$ values of $R_1$ and $R_2$ is preferably 0.70 or more and the upper limit is 1.8 or so.

In the present invention, $R_1$ and $R_2$ are each an electron attractive group having a Hammett's substitution constant $\sigma_p$ value (hereinafter referred to as simply $\sigma_p$ value) of from 0.20 to 1.0, preferably from 0.30 to 0.8. Hammett's rule is a rule of thumb advocated by L. P. Hammett in 1935 to discuss quantitatively the influence of a substituent on reaction or equilibrium of a benzene derivative. Nowadays, its propriety is widely admitted. There are substitution constants $\sigma_p$ value and $\sigma_m$ value obtained by Hammett's rule and these values are disclosed in various general literature, for example, disclosed in detail in J. A. Dean compiled, *Lange's Handbook of Chemistry*, 12th Ed., 1979 (McGraw-Hill), *Kagaku no Ryoiki, Zokan*, No. 122, pages 96 to 103, 1979 (Mankodo), and *Chemical Reviews*, Vol. 91, pages 165 to 195, 1991. In the present invention, $R_1$ and $R_2$ are defined by a Hammett's substitution constant $\sigma_p$ value, but it does not mean that $R_1$ and $R_2$ are limited to only the substituents having the values known in the literature and, even if the values are unknown in the literature, if the values fall within the specified range when measured according to Hammett's rule, they are also included.

Specific examples of $R_1$ and $R_2$ which are electron attractive groups having $\sigma_p$ value of from 0.20 to 1.0 include an acyl group, an acyloxy group, a carbamoyl group, an aliphatic oxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, an alkyl group substituted with at least two or more halogen atoms, an alkoxyl group substituted with at least two or more halogen atoms, an aryloxy group substituted with at least two or more halogen atoms, an alkylamino group substituted with at least two or more halogen atoms, an alkylthio group substituted with at least two or more halogen atoms, an aryl group substituted with other electron attractive group having $\sigma_p$ value of 0.20 or more, a heterocyclic group, a chlorine atom, a bromine atom, an azo group or a selenocyanate group. Of these substituents, those capable of further having a substituent may further have a substituent as described for $R_3$ below.

Further, the aliphatic moiety of the aliphatic oxycarbonyl group may be straight chain, branched chain or cyclic, saturated or may contain an unsaturated bond, and the aliphatic oxycarbonyl group includes alkoxycarbonyl, cycloalkoxycarbonyl, alkenyloxycarbonyl, alkinyloxycarbonyl, or cycloalkenyloxycarbonyl.

The $\sigma_p$ values of representative electron attractive groups having $\sigma_p$ value of from 0.2 to 1.0 include a bromine atom (0.23), a chlorine atom (0.23), a cyano group (0.66), a nitro group (0.78), a trifluoromethyl group (0.54), a tribromomethyl group (0.29), a trichloromethyl group (0.33), a carboxyl group (0.45), an acetyl group (0.50), a benzoyl group (0.43), an acetyloxy group (0.31), a trifluoromethanesulfonyl group (0.92), a methanesulfonyl group (0.72), a benzenesulfonyl group (0.70), a methanesulfinyl group (0.49), a carbamoyl group (0.36), a methoxycarbonyl group (0.45), an ethoxycarbonyl group (0.45), a phenoxycarbonyl group (0.44), a pyrazolyl group (0.37), a methanesulfonyloxy group (0.36), a dimethoxyphosphoryl group (0.60), a sulfamoyl group (0.57), etc.

Groups preferably represented by $R_1$ include a cyano group, an aliphatic oxycarbonyl group (a straight chain or branched chain aliphatic oxycarbonyl group having from 2 to 36 carbon atoms, such as an alkoxycarbonyl group, an aralkyloxycarbonyl group, an alkenyloxycarbonyl group, an alkinyloxycarbonyl group, a cycloalkoxycarbonyl group, or a cycloalkenyloxycarbonyl group, e.g., methoxycarbonyl, ethoxycarbonyl, dodecyloxycarbonyl, octadecyloxycarbonyl, 2-ethylhexyloxycarbonyl, sec-butyloxycarbonyl, oleyloxycarbonyl, benzyloxycarbonyl, propargyloxycarbonyl, cyclopentyloxycarbonyl, cyclohexyloxycarbonyl, 2,6-di-t-butyl-4-methylcyclohexyloxycarbonyl), a dialkylphosphono group (a dialkylphosphono group having from 2 to 36 carbon atoms, e.g., diethylphosphono, dimethylphosphono), an alkyl- or arylsulfonyl group (an alkyl- or arylsulfonyl group having from 1 to 36 carbon atoms, e.g., methanesulfonyl, butanesulfonyl, benzenesulfonyl, p-toluenesulfonyl), or a fluorinated alkyl group (a fluorinated alkyl group having from 1 to 36 carbon atoms, e.g., trifluoromethyl). Of these groups, a cyano group, an aliphatic oxycarbonyl group, and a fluorinated alkyl group are particularly preferred as $R_1$, and a cyano group is most preferred.

Groups preferably represented by $R_2$ include aliphatic oxycarbonyl groups as described in $R_1$, a carbamoyl group (a carbamoyl group having from 1 to 36 carbon atoms, e.g., diphenylcarbamoyl, dioctylcarbamoyl), a sulfamoyl group (a sulfamoyl group having from 1 to 36 carbon atoms, e.g., dimethylsulfamoyl, dibutylsulfamoyl), a dialkylphosphono group as described in $R_1$, or a diarylphosphono group (a diarylphosphono group having from 12 to 50 carbon atoms, e.g., diphenylphosphono, di(p-toluyl)phosphono). Particularly preferred as $R_2$ is an aliphatic oxycarbonyl group represented by the following formula (IV):

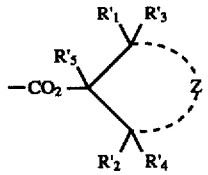

(IV)

wherein $R_1'$ and $R_2'$ represent an aliphatic group, for example, a straight chain or branched chain aliphatic group having from 1 to 36 carbon atoms such as an alkyl group, an aralkyl group, an alkenyl group, an alkinyl group, a cycloalkyl group, or a cycloalkenyl group, specifically, e.g., methyl, ethyl, propyl, isopropyl, t-butyl, t-amyl, t-octyl, tridecyl, cyclopentyl or cyclohexyl. $R_3'$, $R_4'$ and $R_5'$ represent a hydrogen atom or an aliphatic group. As an aliphatic group, groups described in $R_1'$ and $R_2'$ above can be cited. $R_3'$, $R_4'$ and $R_5'$ preferably represent a hydrogen atom.

Z represents a non-metallic atomic group necessary to form a 5- to 8-membered ring, the ring may be substituted, or may be a saturated ring, or may contain an unsaturated bond. Preferred non-metallic atoms include a nitrogen atom, an oxygen atom, a sulfur atom or a carbon atom, more preferably a carbon atom.

Examples of rings formed by Z include, e.g., a cyclopentane ring, a cyclohexane ring, a cycloheptane ring, a cyclooctane ring, a cyclohexene ring, a piperazine ring, an oxane ring and a thiane ring, and these rings may be substituted with the substituents represented by $R_3$ described later.

The preferred ring formed by Z is a cyclohexane ring which may be substituted, and the particularly preferred ring is a cyclohexane ring substituted with an alkyl group having from 1 to 36 carbon atoms at the 4-position (which may be substituted with a substituent represented by $R_3$ as described below).

$R_3$ represents a substituent, for example, a halogen atom (e.g., fluorine, chlorine, bromine), an aliphatic group (a straight chain or branched aliphatic group having from 1 to 36 carbon atoms, such as an alkyl group, an aralkyl group, an alkenyl group, an alkinyl group, a cycloalkyl group, or a cycloalkenyl group, specifically, e.g., methyl, ethyl, propyl, isopropyl, t-butyl, tridecyl, t-amyl, t-octyl, 2-methanesulfonylethyl, 3-(3-pentadecylphenoxy)propyl, 3-{4-{2-[4-(4-hydroxyphenylsulfonyl)phenoxy] dodecanamido}phenyl}-propyl, 2-ethoxytridecyl, trifluoromethyl, cyclopentyl, 3-(2,4-di-t-amylphenoxypropyl), an aryl group (an aryl group having from 6 to 36 carbon atoms, e.g., phenyl, 4-t-butylphenyl, 2,4-di-t-amylphenyl, 4-tetradecanamidophenyl, 2-methoxyphenyl), a heterocyclic group (a heterocyclic group having from 1 to 36 carbon atoms, e.g., 2-furyl, 2-thienyl, 2-pyrimidinyl, 2-benzothiazolyl), a cyano group, a hydroxyl group, a nitro group, a carboxy group, an amino group, an alkoxyl group (a straight chain, branched chain or cyclic alkoxyl group having from 1 to 36 carbon atoms, e.g., methoxy, ethoxy, butoxy, 2-methoxyethoxy, 2-dodecyloxyethoxy, 2-methanesulfonylethoxy), an aryloxy group (an aryloxy group having from 6 to 36 carbon atoms, e.g., phenoxy, 2-methylphenoxy, 4-t-butylphenoxy, 3-nitrophenoxy, 3-t-butyloxy-carbamoylphenoxy, 3-methoxycarbamoyl), an acylamino group (an acylamino group having from 2 to 36 carbon atoms, e.g., acetamido, benzamido, tetradecanamido, 2-(2,4-di-t-amyl-phenoxy) butanamido, 4-(3-t-butyl-4-hydroxyphenoxy)butanamido, 2-[4-(4-hydroxyphenylsulfonyl)phenoxy]decanamido), an alkylamino group (an alkylamino group having from 1 to 36 carbon atoms, e.g., methylamino, butylamino, dodecylamino, diethylamino, methylbutylamino), an anilino group (an anilino group having from 6 to 36 carbon atoms, e.g., phenylamino, 2-chloroanilino, 2-chloro-5-tetradecanaminoanilino, 2-chloro-5-dodecyloxycarbonylanilino, N-acetylanilino, 2-chloro-5-[2-(3-t-butyl-4-hydroxyphenoxy)dodecanamido]anilino), a ureido group (a ureido group having from 2 to 36 carbon atoms, e.g., phenylureido, methylureido, N,N-dibutylureido), a sulfamoylamino group (a sulfamoylamino group having from 1 to 36 carbon atoms, e.g., N,N-dipropylsulfamoylamino, N-methyl-N-decylsulfamoylamino), an alkylthio group (an alkylthio group having from 1 to 36 carbon atoms, e.g., methylthio, octylthio, tetradecylthio, 2-phenoxyethylthio, 3-phenoxypropylthio, 3-(4-t-butylphenoxy)propylthio), an arylthio group (an arylthio group having from 6 to 36 carbon atoms, e.g., phenylthio, 2-butoxy-5-t-octylphenylthio, 3-pentadecylphenylthio, 2-carboxyphenylthio, 4-tetradecanamidophenylthio), an alkoxycarbonylamino group (an alkoxycarbonylamino group having from 2 to 36 carbon atoms, e.g., methoxycarbonylamino, tetradecyloxycarbonylamino), a sulfonamido group (an alkyl- and arylsulfonamido group having from 1 to 36 carbon atoms, e.g., methanesulfonamido, butanesulfonamido, octanesulfonamido, hexadecanesulfonamido, benzenesulfonamido, p-toluenesulfonamido, octadecanesulfonamido, 2-methoxy-5-t-butylbenzenesulfonamido), a carbamoyl group (a carbamoyl group having from 1 to 36 carbon atoms, e.g., N-ethylcarbamoyl, N,N-dibutylcarbamoyl, N-(2-dodecyloxyethyl)carbamoyl, N-methyl-N-dodecylcarbamoyl, N-[3-(2,4-di-t-amylphenoxy)propyl] carbamoyl), a sulfamoyl group (a sulfamoyl group having from 1 to 36 carbon atoms, e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (an alkyl- and arylsulfonyl group having from 1 to 36 carbon atoms, e.g., methanesulfonyl, octanesulfonyl, benzenesulfonyl, toluenesulfonyl), an alkoxycarbonyl group (an alkoxycarbonyl group having from 2 to 36 carbon atoms, e.g., methoxycarbonyl, butyloxycarbonyl, dodecyloxycarbonyl, octadecyloxycarbonyl), a heterocyclic oxy group (a heterocyclic oxy group having from 1 to 36 carbon atoms, e.g., 1-phenyltetrazol-5-oxy, 2-tetrahydropyranyloxy), an azo group (e.g., phenylazo, 4-methoxyphenylazo, 4-pivaloylaminophenylazo, 2-hydroxy-4-propanoylphenylazo), an acyloxy group (an acyloxy group having from 2 to 36 carbon atoms, e.g., acetoxy), a carbamoyloxy group (a carbamoyloxy group having from 1 to 36 carbon atoms, e.g., N-methylcarbamoyloxy, N-phenylcarbamoyloxy), a silyloxy group (a silyloxy group having from 3 to 36 carbon atoms, e.g., trimethylsilyloxy, dibutylmethylsilyloxy), an aryloxycarbonylamino group (an aryloxycarbonylamino group having from 7 to 36 carbon atoms, e.g., phenoxycarbonylamino), an imido group (an imido group having from 4 to 36 carbon atoms, e.g., N-succinimido, N-phthalimido, 3-octadecenylsuccinimido), a heterocyclic thio group (a heterocyclic thio group having from 1 to 36 carbon atoms, e.g., 2-benzothiazolylthio, 2,4-diphenoxy-1,3,5-triazole-6-thio, 2-pyridylthio), a sulfinyl group (a sulfinyl group having from 1 to 36 carbon atoms, e.g., dodecanesulfinyl, 3-pentadecylphenylsulfinyl, 3-phenoxypropylsulfinyl), a phosphonyl group (a phosphonyl group having from 1 to 36 carbon atoms, e.g., phenoxyphosphonyl, octyloxyphosphonyl, phenylphosphonyl), an aryloxycarbonyl group (an aryloxycarbonyl group having from 7 to 36 carbon atoms, e.g., phenoxycarbonyl), an acyl group (an acyl group having from 2 to 36 carbon atoms, e.g., acetyl, 3-phenylpropanoyl, benzoyl, 4-dodecyloxybenzoyl), or an azolyl group (e.g., imidazolyl, pyrazolyl, 3-chloropyrazol-1-yl, triazolyl). Of these substituents, those capable of further substitution may be substituted with substituents as enumerated herein for $R_3$.

$R_3$ is preferably an alkoxyl group, an acylamino group, an aliphatic group or an aryl group, and they may be substituted with substituents as enumerated for $R_3$.

$X_2$ represents a hydrogen atom or a group which is eliminated when the coupler reacts with an oxidized product of an aromatic primary amine color developing agent, and when $X_2$ represents a group to be eliminated, examples of said separable group include a halogen atom, an aryloxy group, an alkyl- or heterocyclic acyloxy group, an alkyl-, aryl- or heterocyclic sulfonyloxy group, a dialkyl- or diarylphosphonoxy group, an alkoxycarbonyloxy group, an aryloxycarbonyloxy group, a heterocyclic oxycarbonyloxy group, a carbamoyloxy group, an alkyl-, aryl- or heterocyclic sulfonyl group, an alkylaryl- or heterocyclic sulfinyl group, an alkyl-, aryl- or heterocyclic thio group, an imido group, an azo group, and a 5- or 6-membered nitrogen-containing heterocyclic group bonded to the coupling position via a nitrogen atom. The alkyl moiety, aryl moiety or heterocyclic moiety contained in these separable groups may be substituted with the substituents described in $R_3$. When there are two or more substituents they may be the same or different, and these substituents may be substituted with the substituents described in $R_3$.

Specific examples of the group to be eliminated include a fluorine atom, a chlorine atom, a bromine atom, an aryloxy group having from 6 to 30 carbon atoms (e.g., 4-methylphenoxy, 4-chlorophenoxy, 4-methoxyphenoxy, 2-methoxyphenoxy, 4-ethoxycarboxyphenoxy, 3-acetylaminophenoxy), an alkyl- or heterocyclic acyloxy group having from 2 to 30 carbon atoms (e.g., acetoxy, tetradecanoyloxy, morpholinocarbonyloxy), an alkyl-, aryl- or heterocyclic sulfonyloxy group having from 1 to 30 carbon atoms (e.g., methanesulfonyloxy, toluenesulfonyloxy), a dialkyl- or diarylphosphonoxy group having from 1 to 30 carbon atoms (e.g., diethylphosphonoxy, diphenylphosphonooxy), an alkoxycarbonyloxy group having from 2 to 30 carbon atoms (e.g., ethoxycarbonyloxy, i-butoxycarbonyloxy), an arylcarbonyloxy group having from 6 to 40 carbon atoms (e.g., benzoyloxy, 2,6-dichlorobenzoyloxy, 4-octadecytoxybenzoyloxy), an aryloxycarbonyloxy group having from 6 to 40 carbon atoms (e.g., phenoxycarbonyloxy), a carbamoyloxy group having from 1 to 30 carbon atoms (e.g., diethylcarbamoyloxy, diallylcarbamoyloxy), an alkyl-, aryl- or heterocyclic sulfonyl group having from 1 to 30 carbon atoms (e.g., methanesulfonyloxy, toluenesulfonyloxy), an alkyl-, aryl- or heterocyclic sulfinyl group having from 1 to 30 carbon atoms (e.g., phenylsulfinyl), an alkyl-, aryl- or heterocyclic thio group having from 1 to 30 carbon atoms (e.g., ethylthio, 2-butoxy-5-t-octylphenylthio, tetrazolylthio), a heterocyclic oxy group (e.g., pyrimidinoxy, triazinoxy), imidazolyl, pyrazolyl, triazolyl, 2-dihydro-2-oxo-1-pyridyl, phenylazo, and 4-methoxyphenylazo. A group to be eliminated may contain a photographically useful group such as a development inhibitor or development accelerator.

Preferred groups represented by $X_2$ are a hydrogen atom, a halogen atom, an aryloxy group, a heterocyclic acyloxy group, a dialkylphosphonoxy group, an arylcarbonyloxy group, an arylsulfonyloxy group, an alkoxycarbonyloxy group or a carbamoyloxy group.

The compound represented by formula (I) of the present invention can be represented by the following formula (V):

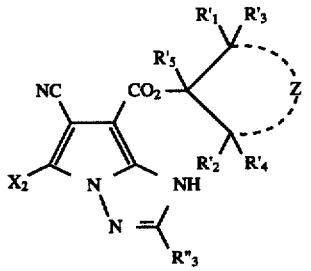

(V)

wherein $R_1'$, $R_2'$, $R_3'$, $R_4'$, $R_5'$, $X_2$ and Z have the same meaning as described above; and $R_3''$ represents an aliphatic group or an aryl group.

More preferably, $R_3''$ represents a branched chain alkyl or aryl group; $X_2$ represents a heterocyclic acyloxy group, an arylcarbonyloxy group or a carbamoyloxy group; $R_3'$, $R_4'$ and $R_5'$ each represents a hydrogen atom; and the ring represented by Z is a cyclohexane ring compound.

The coupler represented by formula (I), (II) or (III) may be a dimer or more polymer in which $R_2$ or $R_3$ bonds to the residue of the coupler represented by formula (I), (II) or (III), or a homopolymer or copolymer in which $R_2$ or $R_3$ contains a high polymer chain. A typical example of a homopolymer or copolymer containing a high polymer chain is a homopolymer or copolymer of addition polymer of ethylenic unsaturated compound containing the residue of the coupler represented by formula (I), (II) or (III). In this case, one or more cyan coloring repeating units containing the residue of the coupler represented by formula (I) may be contained in a polymer or in a copolymer in which, as copolymer components, one or more non-coloring ethylenic monomers providing no coupling reaction with an oxidized product of an aromatic primary amine developing agent such as acrylate, methacrylate, or maleate, may be copolymerized.

Specific examples of the couplers of the present invention are shown below, but the present invention is not limited thereto.

(1)

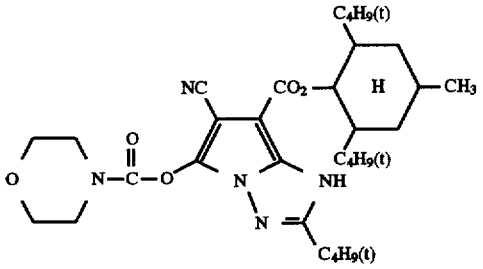

(2)

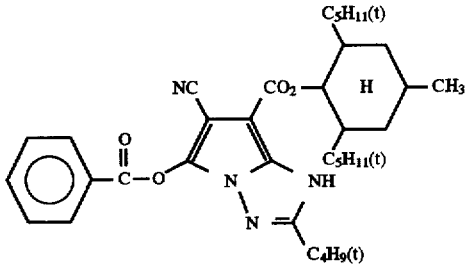

(3)

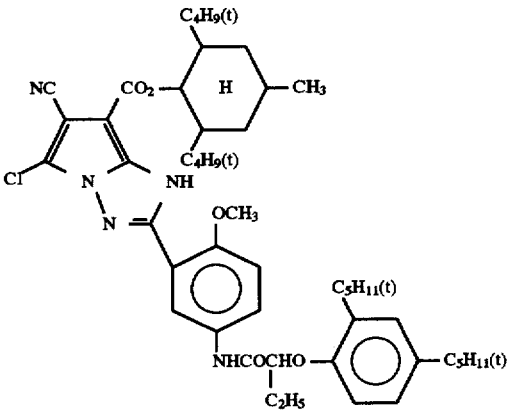

(4)

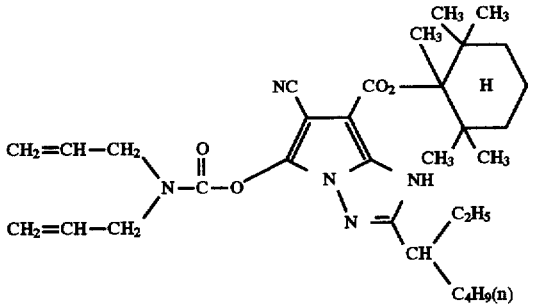

-continued
(5)
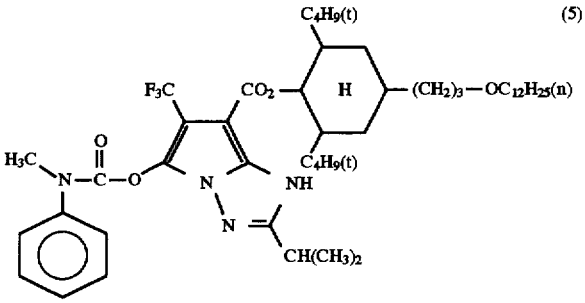
(6)
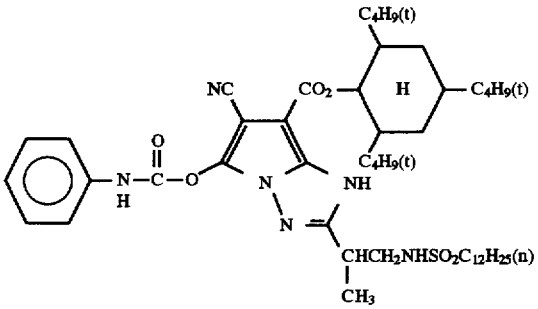
(7)
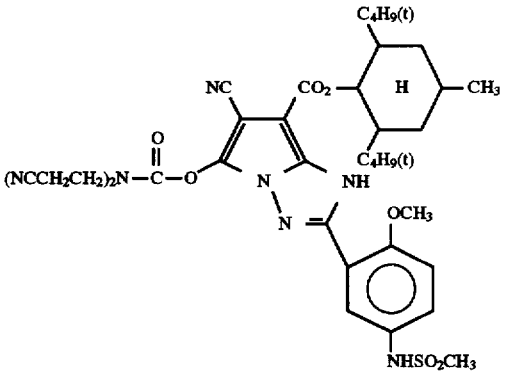
(8)
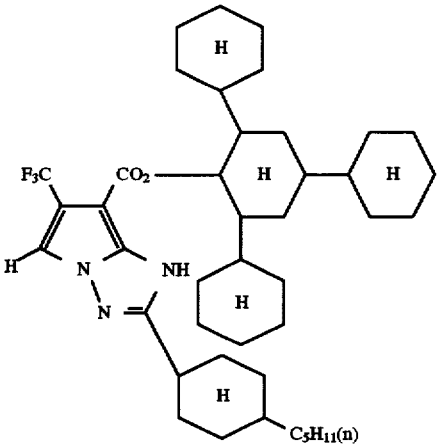
(9)
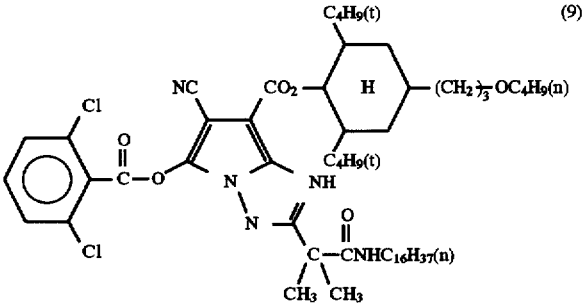
(10)
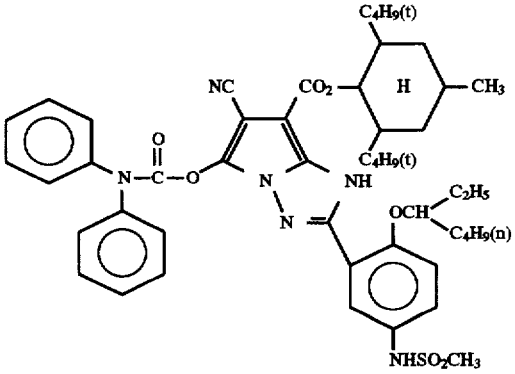
(11)
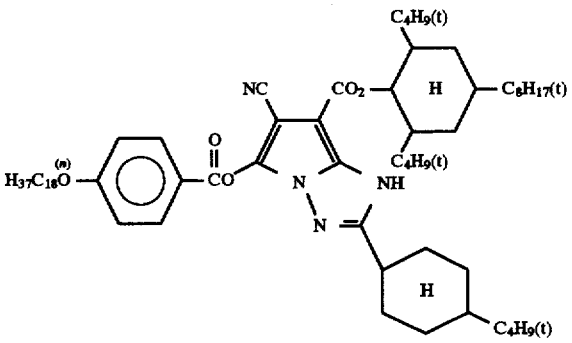

-continued
(12)
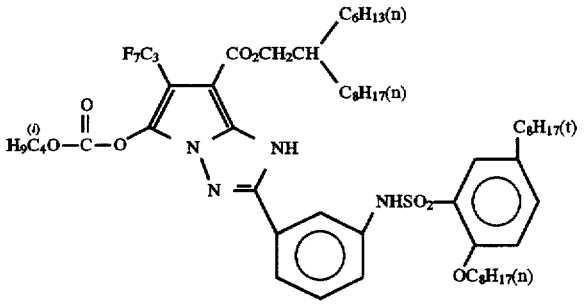
(13)
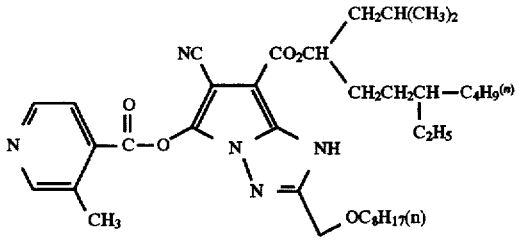
(14)
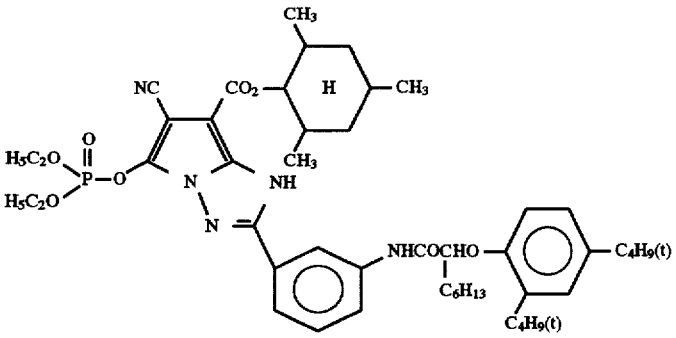
(15)
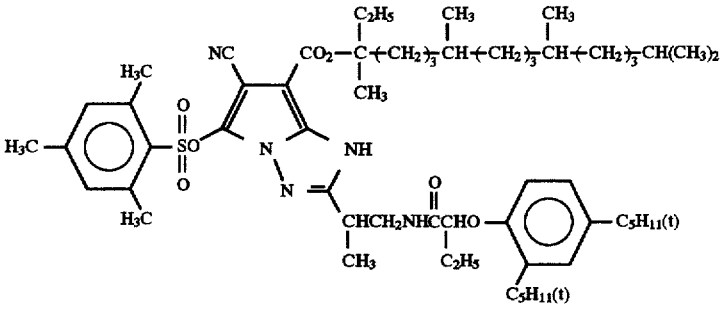
(16)
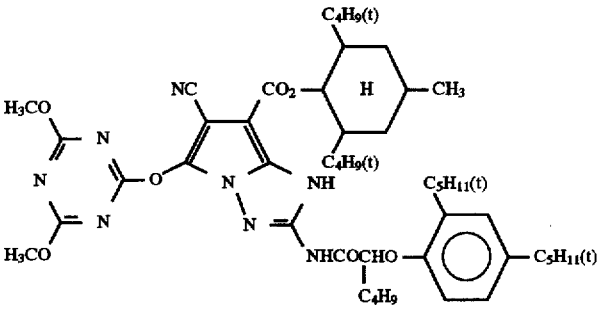

-continued
(17)
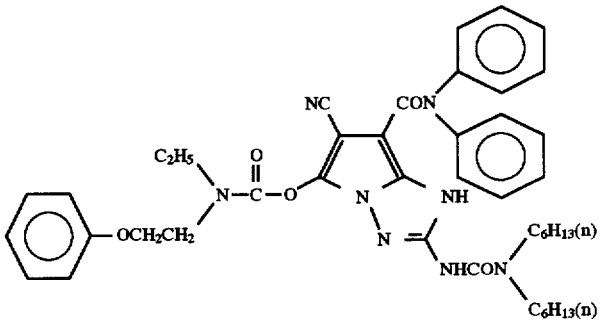
(18)
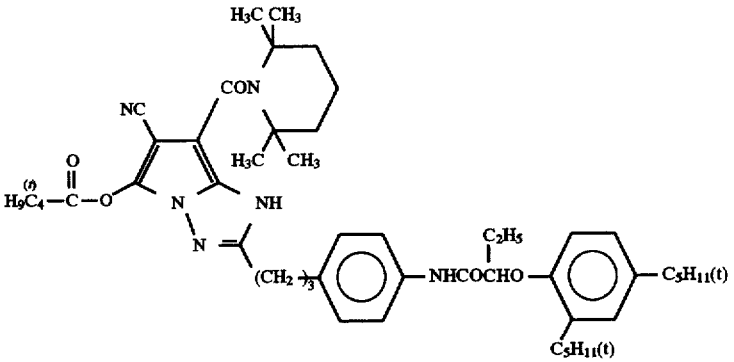
(19)
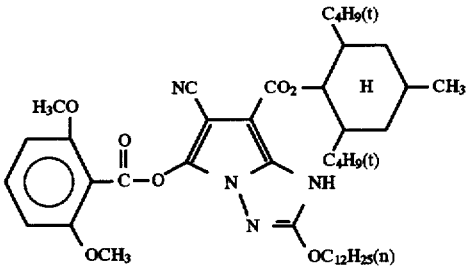
(20)
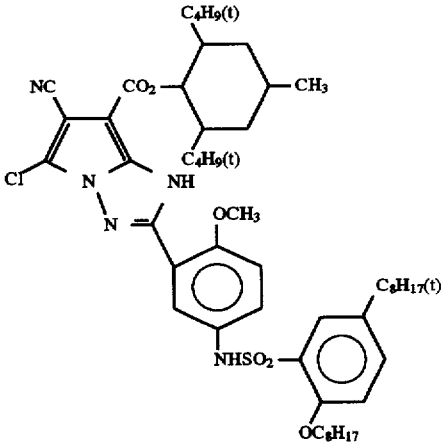
(21)
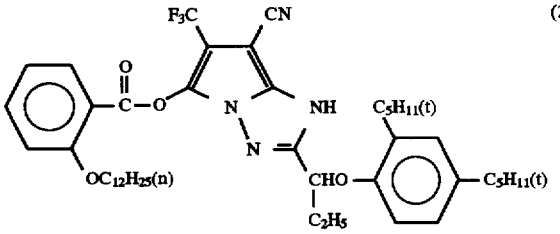
(22)
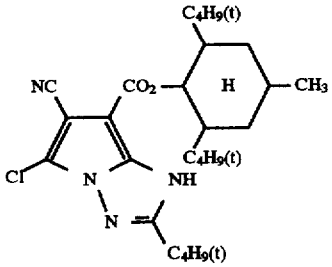

-continued
(23)
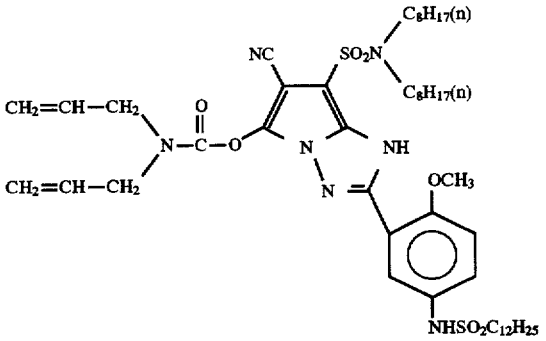
(24)
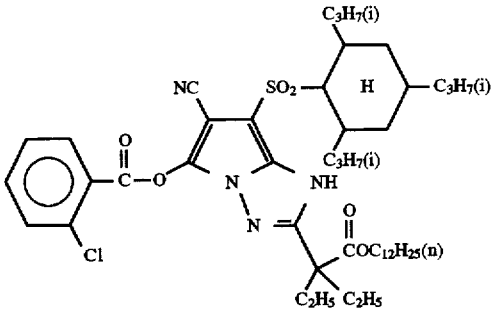
(25)
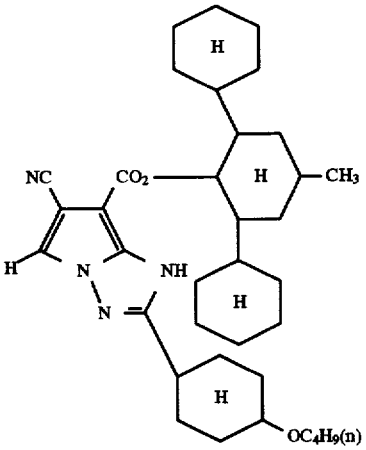
(26)
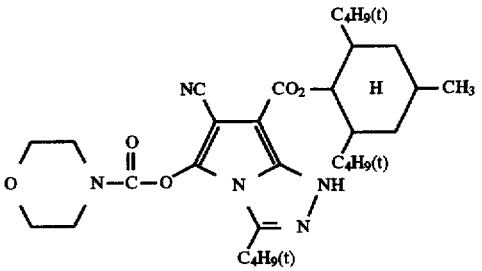
(27)
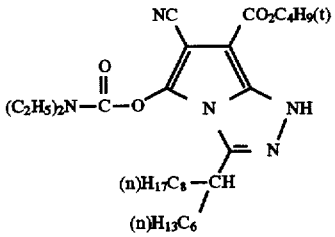
(28)
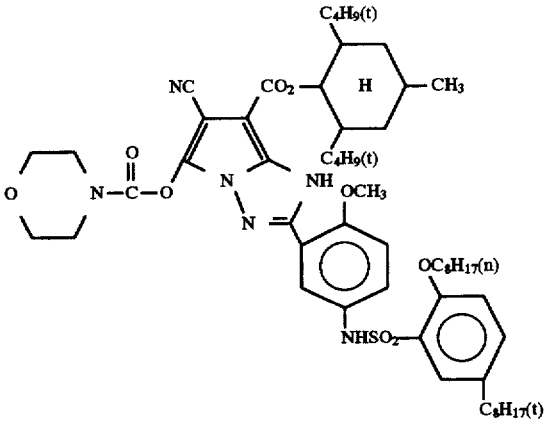
(29)
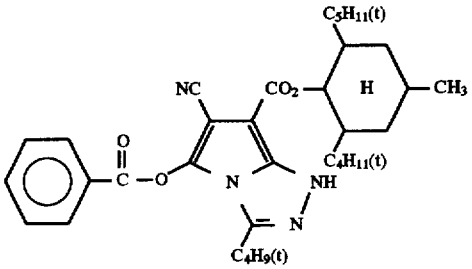
(30)
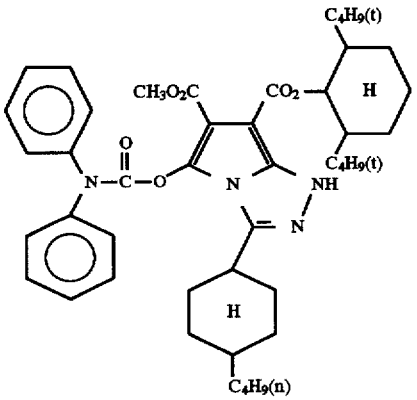

-continued
(31)
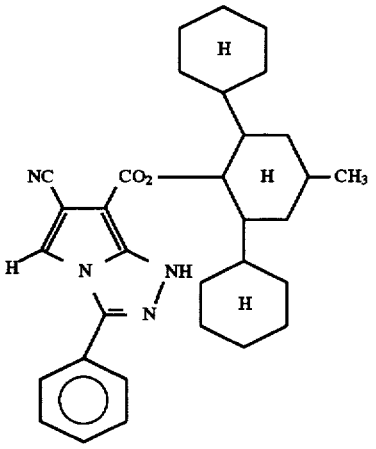
(32)
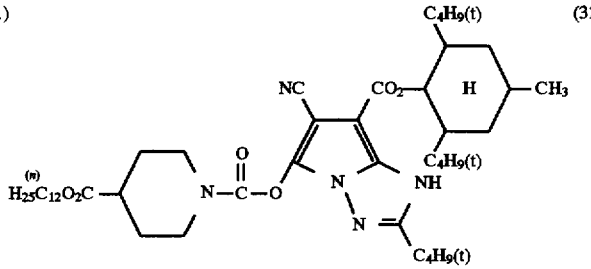
(33)
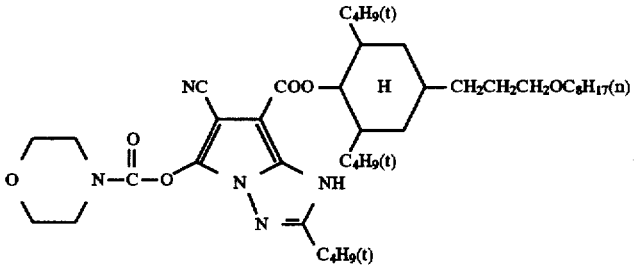
(34)
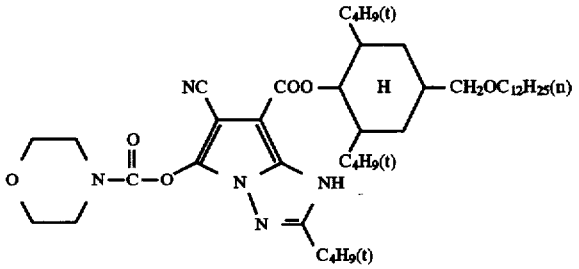
(35)
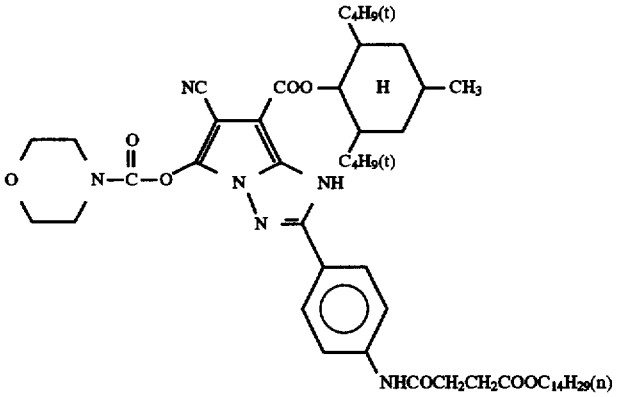

-continued
(36)
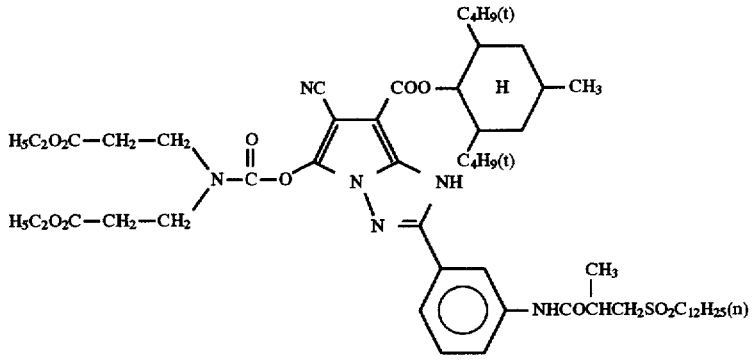
(37)
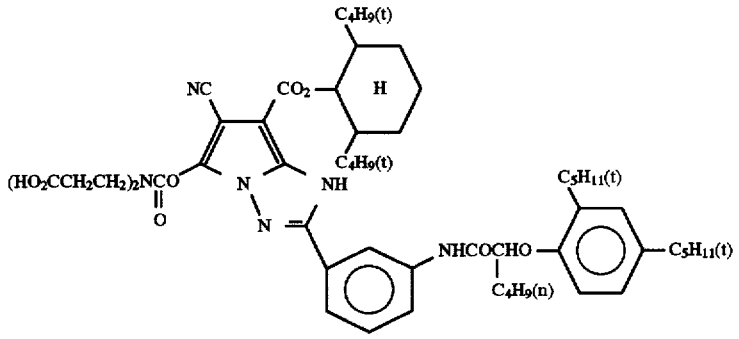
(38)
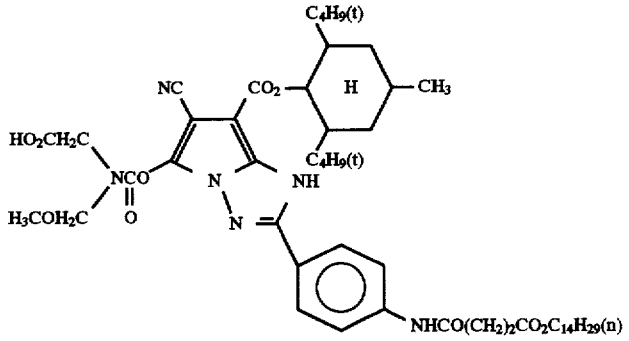
(39)
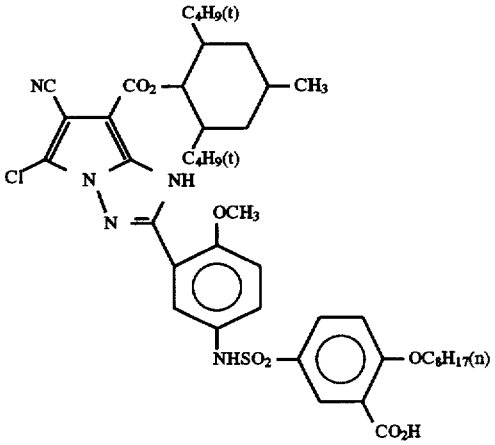
(40)
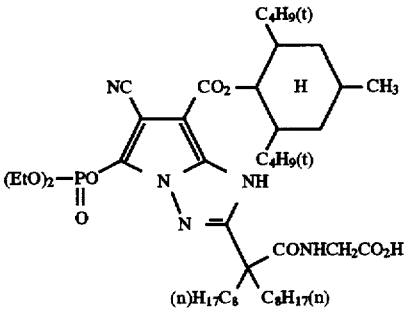

-continued (41)

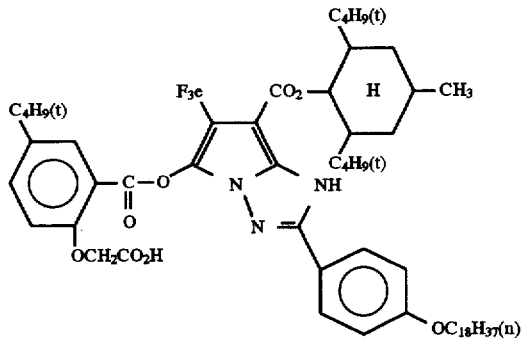

(42)

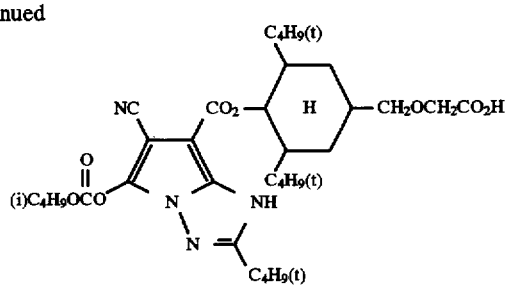

The compound represented by formula (I) of the present invention can be synthesized easily, for example, according to the synthesis method shown below using the triazole compound represented by the following formula (VI) as a starting material. The compound represented by formula (VI) can be synthesized according to the methods disclosed, for example, *J.C.S.*, page 518 (1961), *J.C.S.*, page 5149 (1962), *Angew. Chem.*, Vol. 72, page 956 (1960), *Berichte*, Vol. 97, page 3436 (1964), etc., or the literature cited therein or to analogs thereof.

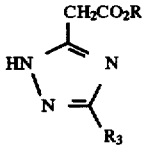

(VI)

wherein R represents a hydrogen atom or an alkyl group and $R_3$ represents a substituent.

Specific synthesis examples of the compound of the present invention are shown below.

Synthesis Example 1

Synthesis of Exemplified Compound (1):

Compound (1) was synthesized according to the following reaction scheme.

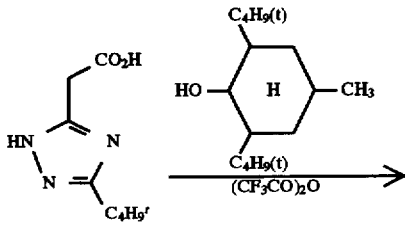

(a)

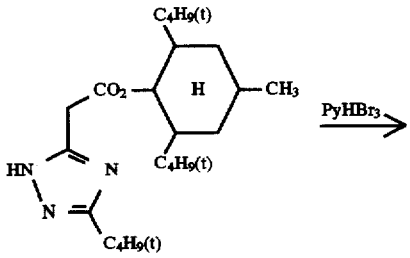

(b)

-continued

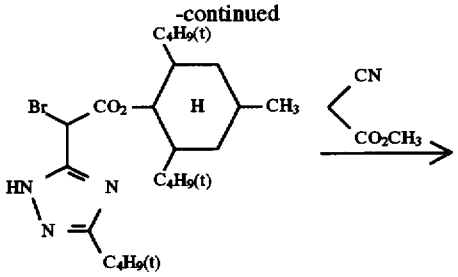

(c)

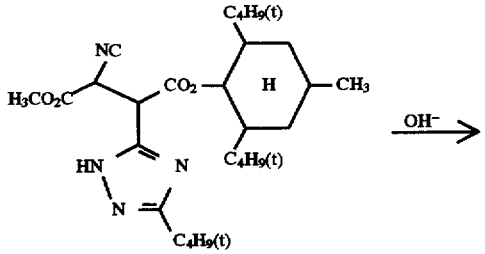

(d)

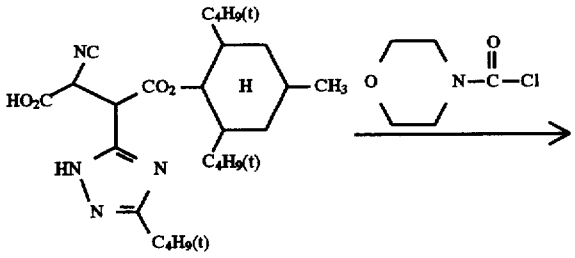

(e)

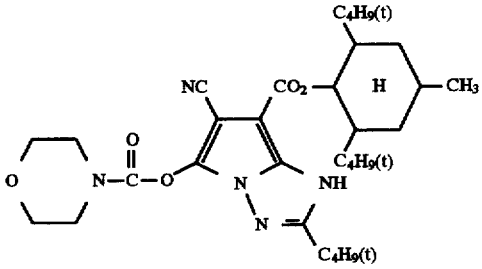

Synthesis of Compound b:

To a solution of 2,6-di-t-butyl-4-methylcyclohexanol (17 g, 75 mmol) dissolved in 200 ml of acetonitrile, trifluoroacetic acid anhydride (10.6 ml, 75 mmol) was dropwise added at 0° C., subsequently Compound a (11 g, 60.4 mmol) was gradually added. After the reaction solution was stirred for 2 hours at room temperature, 300 ml of water was added and extracted with 300 ml of ethyl acetate. The organic phase was washed with aqueous sodium bicarbonate, water, and brine, then dried with sodium sulfate, and the solvent was distilled off under reduced pressure to thereby obtain crude Compound b (14 g). Crude Compound b (14 g) was used in the next process without purification.

Synthesis of Compound c:

To a solution of crude Compound b (14 g) dissolved in 200 ml of tetrahydrofuran, pyridinium promide perbromide (12.7 g, 40 mmol) was added at room temperature and stirred for 8 hours. After 200 ml of an aqueous solution containing 2 g of sodium sulfite was added to the reaction solution, the reaction solution was extracted with 300 ml of ethyl acetate. The organic phase was washed with water and brine and dried with sodium sulfate. The solvent was distilled off under reduced pressure and crude Compound c (15 g) was obtained. Crude Compound c (15 g) was used in the next process without purification.

Synthesis of Compound d:

To a solution of methyl cyanoacetate (9.5 g, 96 mmol) dissolved in 50 ml of tetrahydrofuran, sodium hydride (3.2 g, 80 mmol) was gradually added at 0° C., and stirred for 30 minutes at room temperature (Solution s). To a solution of crude Compound c (15 g) dissolved in 100 ml of tetrahydrofuran, Solution s was dropwise added at 0° C. and stirred for 1 hour at room temperature. 200 ml of 1N sulfuric acid and 200 ml of ethyl acetate were added to the reaction solution and extracted. The organic phase was washed with water and brine and dried with sodium sulfate, then the solvent was distilled off under reduced pressure. The obtained residue was subjected to purification through a column chromatography to obtain Compound d (12.1 g).

Synthesis of Compound e:

To a solution of Compound d (12.1 g, 24.8 mmol) dissolved in 100 ml of methanol, 50 ml of an aqueous solution containing 5 g of sodium hydroxide was added and stirred at 50° C. for 2 hours. 200 ml of 1N hydrochloric acid and 200 ml of ethyl acetate were added to the reaction solution and extracted. The organic phase was washed with water and brine, dried with sodium sulfate, and the solvent was distilled off under reduced pressure to thereby obtain Compound e (11.2 g).

Synthesis of Compound (1):

To a solution of Compound (e) (11.2 g, 23.6 mmol) dissolved in 60 ml of pyridine, morpholinocarbamoyl chloride (6.7 g, 44.8 mmol) was dropwise added at 0° C., stirred for 2 hours at room temperature. The reaction mixture was poured into 200 ml of diluted aqueous hydrochloric acid and extracted with 100 ml of ethyl acetate. The organic phase was washed with water three times, then dried with sodium sulfate. The obtained product was concentrated under reduced pressure, and recrystallized from ethyl acetate-hexane to obtain the objective Compound (1) (10.3 g, 18.1 mmol, melting point: 268°–272° C.).

Synthesis Example 2

Synthesis of Exemplified Compound (7):

Exemplified Compound (7) was synthesized according to the following reaction scheme. (Compounds b to f were synthesized in the same manner as in Synthesis Example 1.)

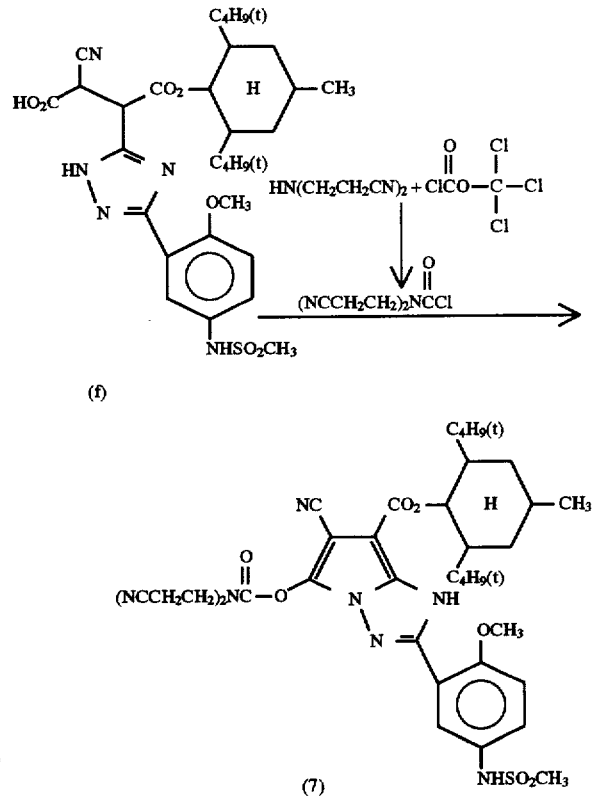

To a solution of chlorotrichloromethyl formate (1.23 ml, 10.2 mmol) dissolved in 10 ml of dichloromethane, a solution of bis(cyanoethyl)amine (2.23 g, 20.4 mmol) and isopropylethylamine (2.64 g, 20.4 mmol) dissolved in 10 ml of dichloromethane was dropwise added at 0° C., and stirred at room temperature for 30 minutes.

To a solution of Compound (f) (5.75 g, 9.30 mmol) dissolved in 100 ml of pyridine, the above solution was dripwise added at 0° C., then the mixed solution was stirred at room temperature for 2 hours, the solution was poured into a 500 ml of diluted aqueous hydrochloric acid, and extracted with 200 ml of ethyl acetate. The organic phase was washed with water three times and dried with sodium sulfate. The obtained product was concentrated under reduced pressure, and subjected to purification through a column chromatography to obtain the objective Compound (7) (4.2 g, 5.6 mmol, melting point: 217°–218° C.).

The cyan coupler of the present invention can be used in a silver halide emulsion layer or in a light-insensitive layer. In the case when the cyan coupler of the present invention is used in a silver halide emulsion layer, the amount used is from 0.005 to 1 mol, preferably from 0.01 to 0.5 mol, more preferably from 0.05 to 0.4 mol, per mol of silver halide. Also, when the cyan coupler of the present invention is used in a light-insensitive layer, the amount used is from $1.0\times10^{-5}$ to $1.0\times10^{-3}$ mol/m$^2$, preferably from $5.0\times10^{-5}$ to $5.0\times10^{-4}$ mol/m$^2$.

The cyan couplers of the present invention can be used in combination of two or more, or can be used in combination with known cyan couplers such as a phenol coupler and a naphthol coupler in such a degree that the effects of the present invention are not impaired. Specifically, the cyan couplers of the present invention are used in proportion of 25% or more, preferably 50% or more, and more preferably 70% or more. Further, the use amount of the entire cyan coupler based on silver halide is within the range described above.

The cyan coupler of the present invention can be incorporated into a color photographic material by various known methods.

In an oil-in-water dispersion method which is one of the known dispersion methods, a method of using a low boiling point organic solvent (e.g., ethyl acetate, butyl acetate, methyl ethyl ketone, isopropanol) can be applied to coat fine dispersion in which the low boiling point organic solvent does not substantially remain in the dried film. Moreover, when using a high boiling point organic solvent, any solvent having a boiling point of 175° C. or more can be used, and one or two or more can be used in admixture optionally. The proportion of the cyan coupler of the present invention to these high boiling point organic solvents may be wide range, but is in the range of 5.0 or less per 1 g of the coupler in weight ratio, preferably from 0 to 2.0, and more preferably from 0.01 to 1.0.

In addition, a latex dispersion method described later can also be used.

Further, the cyan coupler of the present invention can be used in combination with or coexistence with various couplers or mixtures described later.

In formula (H), the aryl group and the heterocyclic group represented by $R^{21}$ may have substituents, and the aryl group preferably has from 6 to 30 carbon atoms, specifically a phenyl group or a naphthyl group, and the heterocyclic group is preferably a 3- to 8-membered ring containing an oxygen atom, a nitrogen atom or a sulfur atom as a hetero atom, specifically 2-pyridyl, 2-furyl, 2-benzoxazolyl or 2-thienyl. Particularly preferred as $R^{21}$ is a phenyl group.

When $R^{21}$ has substituents, the substituents specifically include an alkyl group, an aryl group, an acylamino group (having from 2 to 60 carbon atoms, e.g., acetylamino, n-butanoylamino, octanoylamino, 2-hexadecanoylamino, 2-(2', 4'-di-t-amylphenoxy)butanoylamino, benzoylamino, nicotinoylamino), an alkoxyl group (having from 1 to 60 carbon atoms, e.g., methoxy, ethoxy, butoxy, n-octyloxy, hexadecyloxy, 2-methoxyethoxy), an aryloxy group (having from 6 to 60 carbon atoms, e.g., phenoxy, 2,4-t-amylphenoxy, 4-t-butylphenoxy, naphthoxy), an alkylthio group (having from 1 to 60 carbon atoms, e.g., methylthio, ethylthio, butylthio, hexadecylthio), an arylthio group (having from 6 to 60 carbon atoms, e.g., phenylthio, 4-dodecyloxyphenylthio), an acyl group (having from 1 to 60 carbon atoms, e.g., acetyl, benzoyl, butanoyl, dodecanoyl), a sulfonyl group (having from 1 to 60 carbon atoms, e.g., methanesulfonyl, butanesulfonyl, toluenesulfonyl), a sulfonamido group (having from 1 to 60 carbon atoms, e.g., methanesulfonamido, phenylsulfonamido), a cyano group, a carbamoyl group (having from 1 to 60 carbon atoms, e.g., N,N-dicyclohexylcarbamoyl), a sulfamoyl group (having from 0 to 60 carbon atoms, e.g., N,N-dimethylsulfamoyl), a carboxyl group, a halogen atom and a hydroxyl group.

These substituents may further be substituted with these substituents, and if possible, these substituents may be linked to each other to form a ring.

When $R^{22}$ represents an alkyl group, the alkyl group is a substituted or unsubstituted alkyl group, preferably having from 1 to 60 carbon atoms, specifically, methyl, ethyl propyl, isobutyl, t-butyl, 2-ethylhexyl, nonyl, undecyl, pentadecyl, n-hexadecyl, or 3-decanamidopropyl. When $R^{22}$ represents a cycloalkyl group, the cycloalkyl group is a substituted or unsubstituted cycloalkyl group, preferably having from 3 to 60 carbon atoms, specifically, cyclopropyl, 1-ethylcyclopropyl, cyclopentyl, or cyclohexyl. When $R^{22}$ represents an alkoxyl group, the alkyl moiety of which has specifically the same meaning as the alkyl group and the cycloalkyl group described in $R^{22}$. When $R^{22}$ represents an aryloxy group having 7 or more carbon atoms, the aryl moiety of which has specifically the same meaning as the aryl group and substituents therefor described in $R^{21}$.

The substituents cited with respect to $R^{21}$ are applicable to the substituents for $R^{22}$. Preferred substituents include an alkyl group, an alkoxyl group, an aryloxy group, an acyl group and a hydroxyl group, more preferably an alkyl group, an alkoxyl group and an acyl group.

$A^{21}$ and $A^{22}$ preferably represent hydrogen atoms, but when they represent hydrolyzable groups, specifically, a sulfonyl group, an acyl group and an oxalyl group are preferred.

Y represents an oxygen atom or a sulfur atom, more preferably an oxygen atom.

At least one of $R^{21}$ and $R^{22}$ has preferably incorporated therein a ballast group which is usually used in immobile photographic additives such as a coupler. The ballast group is a group having 8 or more carbon atoms and photographically inert, which can be selected, for example, from an alkyl group, an alkoxyl group, an aryl group, an aryloxy group, an amido group, a ureido group, a sulfonamido group, an ester group, a sulfonyl group, an acyl group, a hydroxy group, and a combination of these groups.

The compounds represented by formula (H) are preferably represented by formula (H-A):

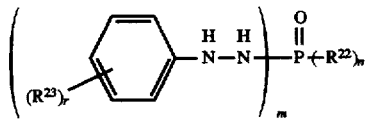

(H-A)

wherein $R^{23}$ represents the same substituents as described for $R^{21}$ in formula (H), but $R^{23}$ does not represent an acylamino group substituted at the p-position.

In formula (H-A), when $R^{22}$ represents an unsubstituted phenyl group, $R^{23}$ is preferably not a p-substituted or unsubstituted benzenesulfonamido group.

In formula (H-A), r represents an integer of from 1 to 5, and when r is 2 or more, a plurality of groups represented by $R^{23}$ may be the same or different, and the adjacent groups of $R^{23}$ may be connected to each other to form a cyclic structure.

In formula (H-A), $R^{22}$, m and n each has the same meaning as $R^{22}$, m and n in formula (H).

The compounds represented by formula (H-A) are more preferably represented by formula (H-B):

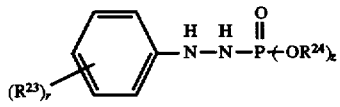

(H-B)

wherein $R^{24}$ represents an alkyl group, a cycloalkyl group, or an aryl group, and they have the same meaning as the alkyl group, the cycloalkyl group and the aryl group represented by $R^{22}$ in formula (H-A).

In formula (H-B), $R^{23}$ and r have the same meaning as $R^{23}$ and r in formula (H-A), and at least one of $R^{23}$ is preferably an alkoxyl group or a sulfonamido group.

In formula (H-B), when $R^{23}$ substituted at the p-position is a substituted or unsubstituted benzenesulfonamido group, it is preferred that two groups of $R^{22}$ form conjointly a 5- to 8-membered ring structure containing a phosphorus atom.

Specific examples of the compounds represented by formula (H) are shown below, but the present invention is not limited thereto.

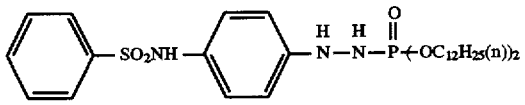
(H-1)
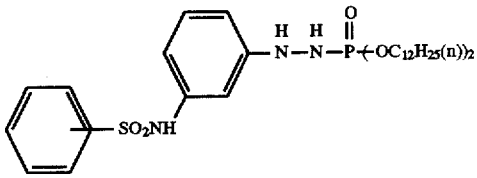
(H-2)
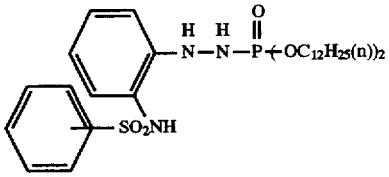
(H-3)
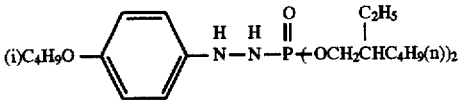
(H-4)
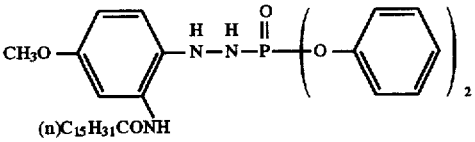
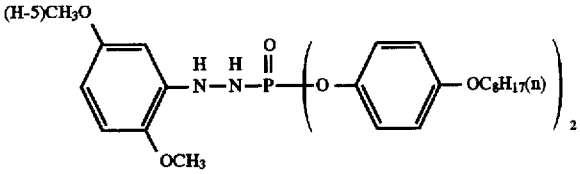
(H-6)
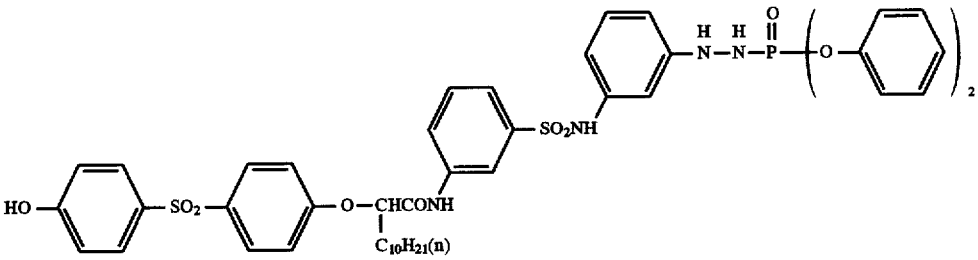
(H-7)
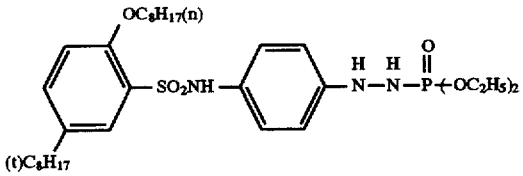
(H-8)
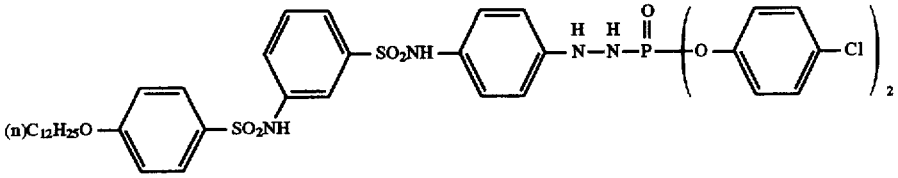
(H-9)
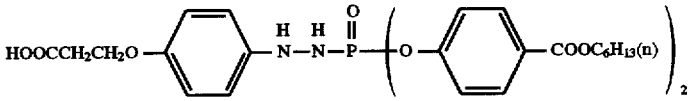
(H-10)
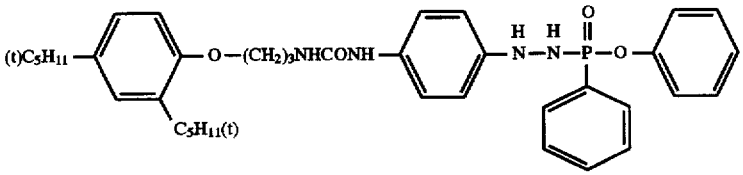
(H-11)
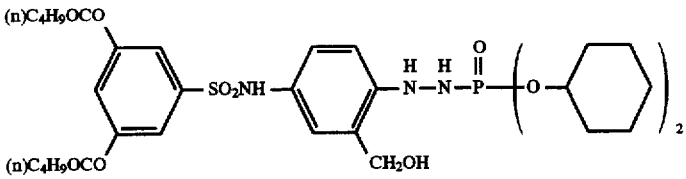
(H-12)

-continued
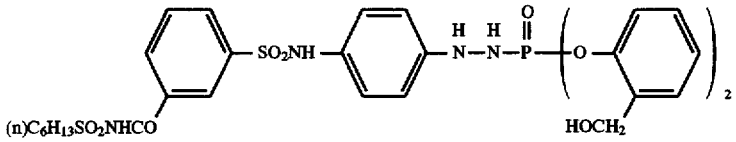
(H-13)
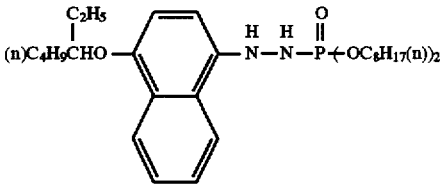
(H-14)
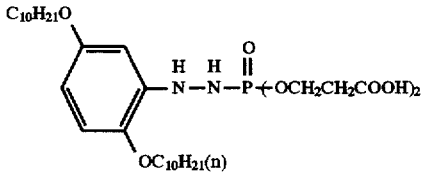
(H-15)
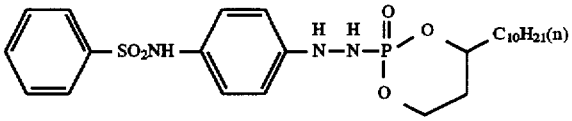
(H-16)
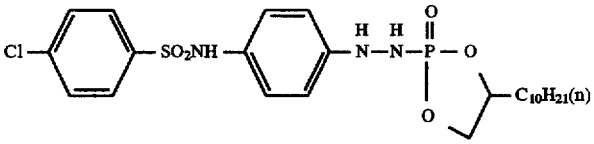
(H-17)
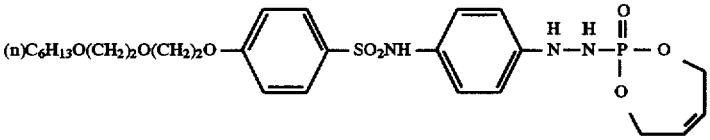
(H-18)
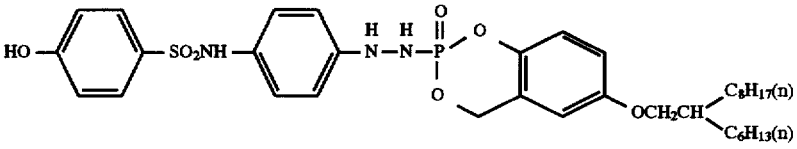
(H-19)
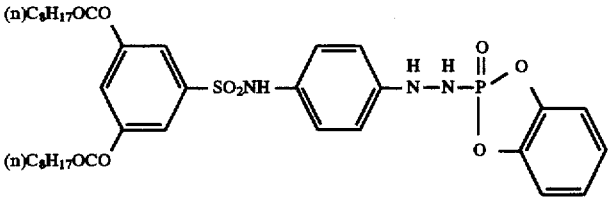
(H-20)
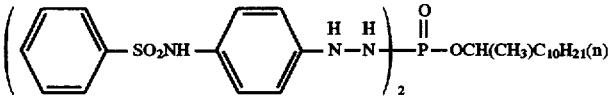
(H-21)
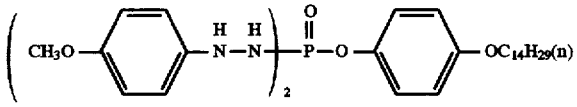
(H-22)
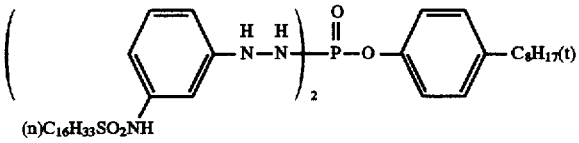
(H-23)
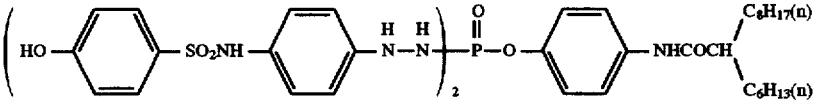
(H-24)

-continued

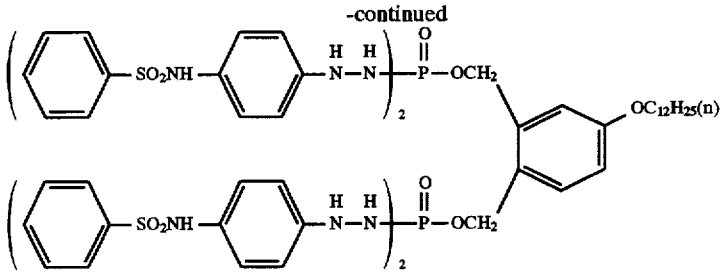

(H-26)

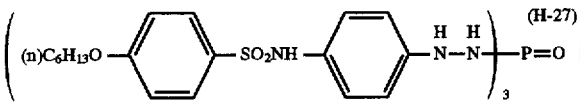

(H-27)

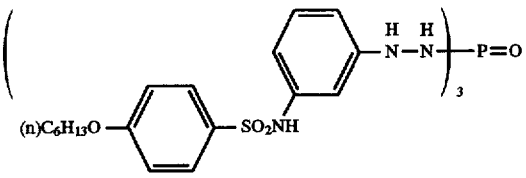

(H-28)

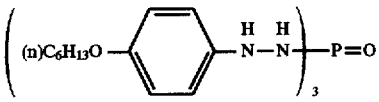

(H-29)

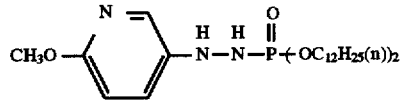

(H-30)

The compound of the present invention can be synthesized according to the following synthesis example or corresponding methods thereto.

1. Synthesis of Exemplified Compound (H-1):

Synthesis of 1-bis(dodecaoxo)phospholio-2-p-phenylsulfonylaminophenylhydrazine (H-1)

To a solution of 4.6 ml of oxyphosphorus chloride dissolved in 30 ml of hexane, a solution of 22.7 ml of n-dodecanol and 21 ml of triethylamine dissolved in 12 ml of hexane was dropwise added gradually at room temperature. The mixed solution was stirred for 2 hours, then 16.3 g of 1,5-naphthalenedisulfonate of p-phenylsulfonylaminophenylhydrazine and 7.0 ml of triethylamine were added thereto, and stirred for 3 hours at room temperature. The reaction solution was added to 200 ml of water, and extracted with ethyl acetate according to the ordinary method. The extract was concentrated, the residue was subjected to purification through a silica gel column chromatography (n-hexane/ethyl acetate), then crystallized with ethanol and dried to thereby obtain the exemplified Compound (H-1) (yield: 20.2 g, 61%).

$^1$H NMR ($CDCl_3$) 0.90 (t, 6H), 1.25 (m, 36H), 1.56 (m, 4H), 4.00 (m, 4H), 4.80 (d, 1H), 5.41 (s, 1H), 6.62 (s, 1H), 6.28 (d, 2H), 6.92 (d, 2H), 7.40 (m, 3H), 7.75 (m, 2H) p 2.

Synthesis of Exemplified Compound (H-8):

7.0 g of hydrazine hydrochloride was dispersed in 50 ml of acetonitrile, 3.0 ml of diethyl phosphorus chloride and 3.6 ml of triethylamine were added thereto at room temperature, and stirred for 5 hours at room temperature. The reaction solution was added to 100 ml of water, and extracted with ethyl acetate according to the ordinary method. The extract was concentrated, the residue was subjected to purification through a silica gel column chromatography (n-hexane/ethyl acetate), then crystallized with ethanol and dried to thereby obtain the exemplified Compound (H-8) (yield: 6.6 g, 80%).

$^1$H NMR ($CDCl_3$) 0.55 (s, 9H), 0.90 (t, 3H), 1.25 (m, 18H), 1.50 (s, 6H), 1.95 (m, 2H), 4.20 (m, 6H), 4.25 (d, 1H), 5.30 (s, 1H), 6.20 (m, 3H), 6.92 (m, 3H), 7.45 (m, 1H), 7.20 (m, 1H)

The compound represented by formula (H) of the present invention is added to a photographic material in an amount of 0.001 to 1 g/m$^2$, preferably from 0.01 to 0.5 g/m$^2$.

The compound represented by formula (H) of the present invention can be used in combination of two or more. Also, the compound of the present invention can be used in combination with hydroquinone derivatives or hydrazine derivatives other than the compound of the present invention, but the amount of the compound represented by formula (H) of the present invention is, when used in the same layer with the pyrazoloazole magenta couplers of the present invention or in adjacent layers thereto, 50 mol % or more, preferably 70 mol % or more.

The compound represented by formula (H) can be used by known methods such as by dissolving in a high boiling point organic solvent and emulsifying dispersed in an aqueous gelatin solution, dissolving in an organic solvent and being added to a coating solution as it is, or impregnating in a polymer such as latex.

With respect to the silver halide photographic emulsion of the present invention, and various techniques and inorganic and organic materials which can be used in the silver halide photogdraphic material using the silver halide photographic emulsion of the present invention, in general, those disclosed in *Research Disclosure*, No. 308119 (1989) can be used.

In addition to these, more specifically, for example, techniques and inorganic and organic materials which can be used in the color photographic material to which the silver halide photographic emulsion of the present invention is applicable are disclosed in the following places of EP-A-436938 and the patents cited in the following places.

| | |
|---|---|
| 1) Layer Structure | line 34, page 146 to line 25, page 147 |
| 2) Silver Halide Emulsion | line 26, page 147 to line 12, page 148 |
| 3) Yellow Coupler | line 35, page 137 to line 33, page 146, lines 21 to 23, page 149 |
| 4) Magenta Coupler Which Can be Used in Combination | lines 24 to 28, page 149; line 5, page 3 to line 55, page 25 of EP-A-421453 |
| 5) Cyan Coupler | lines 29 to 33, page 149; line 28, page 3 to line 2, page 40 of EP-A-432804 |
| 6) Polymer Coupler | lines 34 to 38, page 149; line 39, page 113 to line 37, page 123 of EP-A-435334 |
| 7) Colored Coupler | line 42, page 53 to line 34, page |

-continued

| | |
|---|---|
| | 137, lines 39 to 45, page 149 |
| 8) Other Functional Coupler | line 1, page 7 to line 41, page 53, line 46, page 149 to line 3 page 150; line 1, page 3 to line 50, page 29 of EP-A-435334 |
| 9) Preservative, Antibacterial Agent | lines 25 to 28, page 150 |
| 10) Formalin Scavenger | lines 15 to 17, page 149 |
| 11) Other Additives | lines 38 to 47, page 153; line 21, page 75 to line 56, page 84 and line 40, page 27 to line 40, page 37 of EP-A-421453 |
| 12) Dispersion Method | lines 4 to 24, page 150 |
| 13) Support | lines 32 to 34, page 150 |
| 14) Film Thickness, Physical Properties of Film | lines 35 to 49, page 150 |
| 15) Color Development Process | line 50, page 150 to line 47, page 151 |
| 16) Desilvering Process | line 48, page 151 to line 53, page 152 |
| 17) Automatic Processor | line 54, page 152 to line 2, page 153 |
| 18) Washing and Stabilizing Processes | lines 3 to 37, page 153 |

The silver halide photographic material of the present invention is applied to photographic materials of ISO speed of 2000 or less under daylight illuminant measured according to the method disclosed in JIS Standard 7613.

EXAMPLE 1

The present invention will be illustrated in more detail with reference to examples below, but the present invention should not be construed as being limiteed thereto.

Preparation of Sample No. 101

A multilayer color photographic material was prepared as Sample No. 101 by coating a backing layer on one surface of a cellulose triacetate film support having the thickness of 205 μm and each layer having the following composition on another surface of the support both surfaces of which were undercoated. The numeral corresponding to each component indicates the addition amount per $m^2$. The function of the compound added is not limited to the use described.

| | |
|---|---|
| **First Layer: Antihalation Layer** | |
| Black Colloidal Silver | 0.10 g |
| Gelatin | 2.20 g |
| Ultraviolet Absorbing Agent U-1 | 0.10 g |
| Ultraviolet Absorbing Agent U-3 | 0.040 g |
| Ultraviolet Absorbing Agent U-4 | 0.10 g |
| High Boiling Point Organic Solvent Oil-1 | 0.10 g |
| Microcrystal Solid Dispersion of Dye E-1 | 0.10 g |
| **Second Layer: Interlayer** | |
| Gelatin | 0.40 g |
| Compound Cpd-C | 5.0 mg |
| Compound Cpd-G | 5.0 mg |
| High Boiling Point Organic Solvent Oil-3 | 0.10 g |
| Dye D-4 | 0.80 g |
| **Third Layer: Interlayer** | |
| Surface and Interior Fogged Fine Grain Silver Iodobromide Emulsion (average grain size: 0.06 μm, variation coefficient: 18%, AgI content: 1 mol %) | silver amount: 0.010 g |
| Yellow Colloidal Silver | silver amount: 0.010 g |
| Gelatin | 0.40 g |
| **Fourth Layer: Low Sensitivity Red-Sensitive Emulsion Layer** | |
| Emulsion A | silver amount: 0.30 g |
| Emulsion B | silver amount: 0.35 g |
| Gelatin | 0.60 g |
| Coupler C-1 | 0.050 g |
| Coupler C-2 | 0.070 g |
| Coupler C-8 | 5.0 mg |
| Coupler C-10 | 0.010 g |
| High Boiling Point Organic Solvent Oil-2 | 0.050 g |
| **Fifth Layer: Middle Sensitivity Red-Sensitive Emulsion Layer** | |
| Emulsion B | silver amount: 0.25 g |
| Emulsion C | silver amount: 0.35 g |
| Gelatin | 0.80 g |
| Coupler C-1 | 0.17 g |
| Coupler C-2 | 0.040 g |
| Coupler C-8 | 3.0 mg |
| High Boiling Point Organic Solvent Oil-2 | 0.080 g |
| **Sixth Layer: High Sensitivity Red-Sensitive Emulsion Layer** | |
| Emulsion D | silver amount: 0.40 g |
| Gelatin | 1.10 g |
| Coupler C-3 | 0.70 g |
| Coupler C-8 | 1.0 mg |
| Additive P-1 | 0.10 g |
| **Seventh Layer: Interlayer** | |
| Gelatin | 0.60 g |
| Color Mixing Preventive Cpd-F | 0.020 g |
| Dye D-5 | 0.020 g |
| Dye D-6 | 0.010 g |
| **Eighth Layer: Interlayer** | |
| Surface and Interior Fogged Silver Iodobromide Emulsion (average grain size: 0.06 μm, variation coefficient: 16%, AgI content: 0.3 mol %) | silver amount: 0.020 g |
| Yellow Colloidal Silver | silver amount: 0.020 g |
| Gelatin | 1.00 g |
| Color Mixing Preventive Cpd-A | 0.10 g |
| Color Mixing Preventive Cpd-C | 0.16 g |
| High Boiling Point Organic Solvent Oil-2 | 0.20 g |
| **Ninth Layer: Low Sensitivity Green-Sensitive Emulsion Layer** | |
| Emulsion E | silver amount: 0.20 g |
| Emulsion F | silver amount: 0.40 g |
| Emulsion G | silver amount: 0.30 g |
| Gelatin | 1.30 g |
| Coupler C-4 | 0.046 g |
| Coupler C-5 | 0.10 g |
| Coupler C-6 | 0.10 g |
| Compound Cpd-B | 0.030 g |
| Compound Cpd-D | 0.010 g |
| Compound Cpd-H | 2.0 mg |
| High Boiling Point Organic Solvent Oil-2 | 0.10 g |
| **Tenth Layer: Middle Sensitivity Green-Sensitive Emulsion Layer** | |
| Emulsion G | silver amount: 0.30 g |
| Emulsion H | silver amount: 0.15 g |
| Gelatin | 0.60 g |
| Coupler C-4 | 0.13 g |
| Coupler C-5 | 0.045 g |
| Coupler C-6 | 0.047 g |
| Compound Cpd-B | 0.030 g |
| High Boiling Point Organic Solvent Oil-2 | 0.050 g |
| **Eleventh Layer: High Sensitivity Green-Sensitive Emulsion Layer** | |
| Emulsion I | silver amount: 0.50 g |
| Gelatin | 1.00 g |
| Coupler C-4 | 0.19 g |
| Coupler C-5 | 0.070 g |
| Coupler C-6 | 0.073 g |

-continued

| | |
|---|---|
| Compound Cpd-B | 0.080 g |
| High Boiling Point Organic Solvent Oil-1 | 0.020 g |
| High Boiling Point Organic Solvent Oil-2 | 0.020 g |
| Twelfth Layer: Interlayer | |
| Gelatin | 0.40 g |
| Compound Cpd-A | 0.020 g |
| High Boiling Point Organic Solvent Oil-1 | 0.020 g |
| Thirteenth Layer: Yellow Filter Layer | |
| Yellow Colloidal Silver | silver amount: 0.035 g |
| Gelatin | 1.10 g |
| Color Mixing Preventive Cpd-A | 0.020 g |
| High Boiling Point Organic Solvent Oil-1 | 0.020 g |
| Microcrystal Solid Dispersion of Dye E-2 | 0.050 g |
| Fourteenth Layer: Low Sensitivity Blue-Sensitive Emulsion Layer | |
| Emulsion J | silver amount: 0.20 g |
| Emulsion K | silver amount: 0.30 g |
| Gelatin | 0.80 g |
| Coupler C-7 | 0.20 g |
| Coupler C-8 | 0.050 g |
| Coupler C-9 | 0.10 g |
| Fifteenth Layer: Middle Sensitivity Blue-Sensitive Emulsion Layer | |
| Emulsion L | silver amount: 0.10 g |
| Emulsion M | silver amount: 0.10 g |
| Gelatin | 0.70 g |
| Coupler C-7 | 0.18 g |
| Coupler C-8 | 0.040 g |
| Coupler C-9 | 0.090 g |
| Sixteenth Layer: High Sensitivity Blue-sensitive Emulsion Layer | |
| Emulsion N | silver amount: 0.20 g |
| Emulsion O | silver amount: 0.20 g |
| Gelatin | 2.0 g |
| Coupler C-7 | 0.20 g |
| Coupler C-8 | 0.20 g |
| Coupler C-9 | 0.80 g |
| High Boiling Point Organic Solvent Oil-2 | 0.20 g |
| Seventeenth Layer: First Protective Layer | |
| Gelatin | 0.70 g |
| Ultraviolet Absorbing Agent U-1 | 0.20 g |
| Ultraviolet Absorbing Agent U-2 | 0.050 g |
| Ultraviolet Absorbing Agent U-5 | 0.30 g |
| Formalin Scavenger Cpd-E | 0.40 g |
| Dye D-1 | 0.15 g |
| Dye D-2 | 0.050 g |
| Dye D-3 | 0.10 g |
| Eighteenth Layer: Second Protective Layer | |
| Colloidal Silver | silver amount: 0.10 mg |
| Fine Grain Silver Iodobromide Emulsion (average grain size: 0.06 μm, AgI content: 1 mol %) | silver amount: 0.10 g |
| Gelatin | 0.40 g |
| Nineteenth Layer: Third Protective Layer | |
| Gelatin | 1.0 g |

-continued

| | |
|---|---|
| Polymethyl Methacrylate (average particle size: 1.5 μm) | 0.10 g |
| Copolymer of Methyl Methacrylate/Acrylic Acid in Proportion of 4/6 (average particle size: 1.5 μm) | 0.10 g |
| Silicone Oil | 0.030 g |
| Surfactant W-1 | 3.0 mg |
| Surfactant W-2 | 0.030 g |

Further, Additives F-1 to F-8 were added to every emulsion layer in addition to the above components. Moreover, gelatin hardener h-1 and surfactants W-3, W-4, W-5 and W-6 for coating and emulsifying were added to every layer in addition to the above components.

Further, phenol, 1,2-benzisothiazolin-3-one, 2-phenoxyethanol, phenethyl alcohol, p-benzoic acid butyl ester were added as antibacterial and antifungal agents.

Preparation of Dispersion of Organic Solid Dispersion Dye

Dye E-1 was dispersed according to the following method. That is, water and 200 g of Pluronic F88 (ethylene oxide/propylene oxide block copolymer) manufactured by BASF Co. were added to 1,430 g of a wet cake of the dye containing 30% of methanol, and stirred to obtain a slurry having dye concentration of 6%. Next, 1,700 ml of zirconia beads having an average grain size of 0.5 mm were filled in ULTRAVISCOMILL (UVM-2) manufactured by AIMEX Co., the slurry was passed and the content was pulverized at a peripheral speed of about 10 m/sec and discharge amount of 0.5 l/min for 8 hours. Beads were removed by filtration, water was added to dilute the dispersion to dye concentration of 3%, then heated at 90° C. for 10 hours for stabilization. The average grain size of the obtained fine grains of the dye was 0.60 μm and the extent of distribution of grain sizes (standard deviation of grain sizes×100/average grain size) was 18%.

Solid dispersion of E-2 was obtained in the same manner. Average grain size was 0.54 μm.

The silver iodobromide emulsions used in Sample No. 101 are as shown in Table 1.

TABLE 1

| Emulsion Name | Characteristics of Grain | Sphere Corresponding Average Grain Size (μm) | Variation Coefficient (%) | AgI Content (%) |
|---|---|---|---|---|
| A | Monodisperse tetradecahedral grains | 0.28 | 16 | 4.0 |
| B | Monodisperse cubic internal latent image type grains | 0.30 | 10 | 4.0 |
| C | Monodisperse cubic grains | 0.38 | 10 | 5.0 |
| D | Monodisperse tabular grains, | 0.68 | 8 | 2.0 |

TABLE 1-continued

| Emulsion Name | Characteristics of Grain | Sphere Corresponding Average Grain Size (μm) | Variation Coefficient (%) | AgI Content (%) |
|---|---|---|---|---|
| | average aspect ratio: 3.0 | | | |
| E | Monodisperse cubic grains | 0.20 | 17 | 4.0 |
| F | Monodisperse tetradecahedral grains. | 0.25 | 16 | 4.0 |
| G | Monodisperse cubic internal latent image type grains | 0.40 | 11 | 4.0 |
| H | Monodisperse cubic grains | 0.50 | 9 | 3.5 |
| I | Monodisperse tabular grains, average aspect ratio: 5.0 | 0.80 | 10 | 2.0 |
| J | Monodisperse cubic grains | 0.30 | 18 | 4.0 |
| K | Monodisperse tetradecahedral grains | 0.45 | 17 | 4.0 |
| L | Monodisperse tabular grains, average aspect ratio: 5.0 | 0.55 | 10 | 2.0 |
| M | Monodisperse tabular grains, average aspect ratio: 8.0 | 0.70 | 13 | 2.0 |
| N | Monodisperse tabular grains, average aspect ratio: 6.0 | 1.00 | 10 | 1.5 |
| O | Monodisperse tabular grains, average aspect ratio: 9.0 | 1.20 | 15 | 1.5 |

TABLE 2

Spectral Sensitization of Emulsions A to I

| Emulsion Name | Sensitizing Dye Added | Addition Amount per mol of Silver Halide (g) |
|---|---|---|
| A | S-2 | 0.025 |
| | S-3 | 0.25 |
| | S-8 | 0.010 |
| B | S-1 | 0.010 |
| | S-3 | 0.25 |
| | S-8 | 0.010 |
| C | S-1 | 0.010 |
| | S-2 | 0.010 |
| | S-3 | 0.25 |
| | S-8 | 0.010 |
| D | S-2 | 0.010 |
| | S-3 | 0.10 |
| | S-8 | 0.010 |
| E | S-4 | 0.50 |
| | S-5 | 0.10 |
| F | S-4 | 0.30 |
| | S-5 | 0.10 |
| G | S-4 | 0.25 |
| | S-5 | 0.08 |
| | S-9 | 0.05 |
| H | S-4 | 0.20 |
| | S-5 | 0.060 |
| | S-9 | 0.050 |
| I | S-4 | 0.30 |
| | S-5 | 0.070 |
| | S-9 | 0.10 |

TABLE 3

Spectral Sensitization of Emulsions J to O

| Emulsion Name | Sensitizing Dye Added | Addition Amount per mol of Silver Halide (g) |
|---|---|---|
| J | S-6 | 0.050 |
| | S-7 | 0.20 |
| K | S-6 | 0.05 |

TABLE 3-continued

Spectral Sensitization of Emulsions J to O

| Emulsion Name | Sensitizing Dye Added | Addition Amount per mol of Silver Halide (g) |
|---|---|---|
| | S-7 | 0.20 |
| L | S-6 | 0.060 |
| | S-7 | 0.22 |
| M | S-6 | 0.050 |
| | S-7 | 0.17 |
| N | S-6 | 0.040 |
| | S-7 | 0.15 |
| O | S-6 | 0.060 |
| | S-7 | 0.22 |

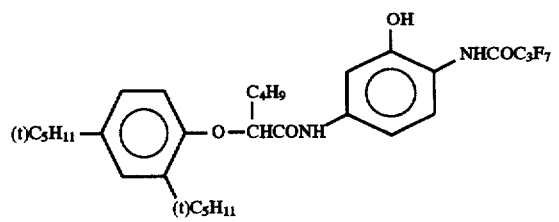

C-1

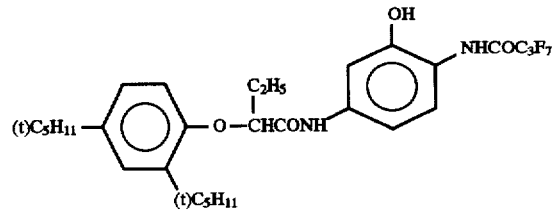

C-2

-continued
C-3
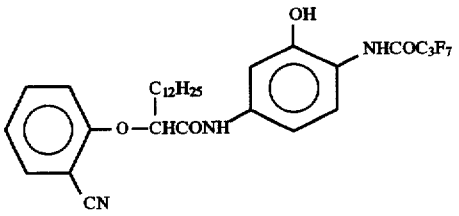
C-4
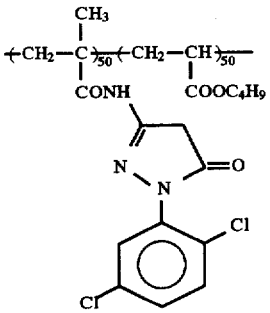
numerals indicate wt %
average molecular weight: about 25,000
C-5
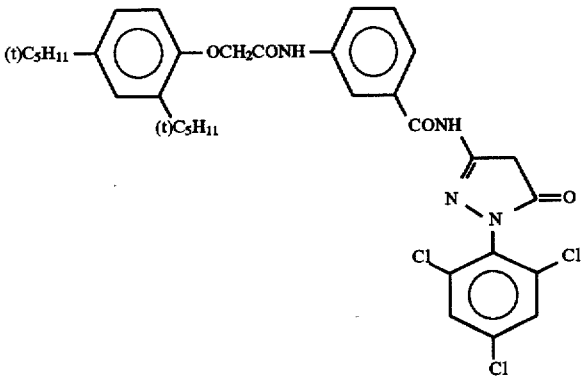
C-6
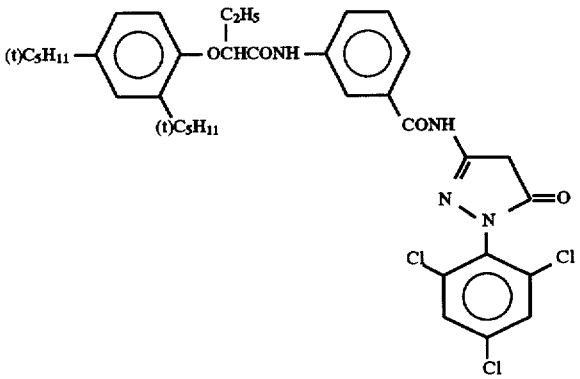

-continued
C-7
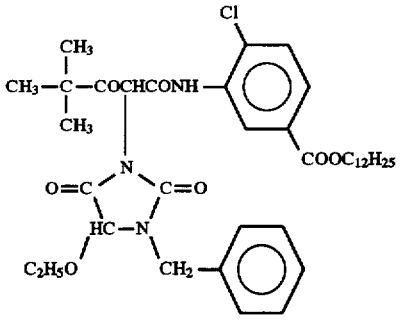
C-8
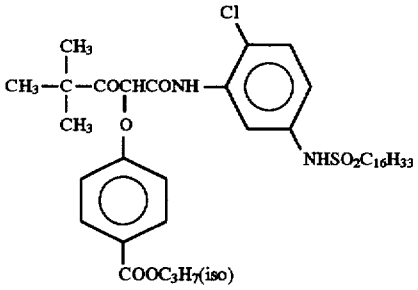
C-9
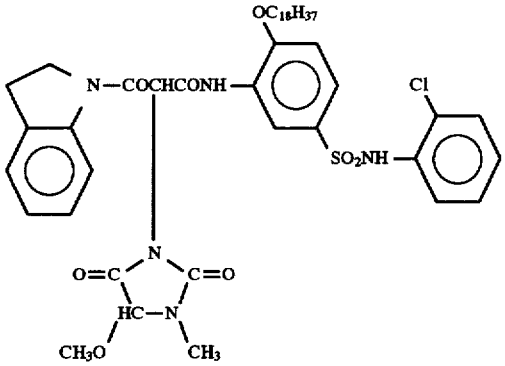
C-10
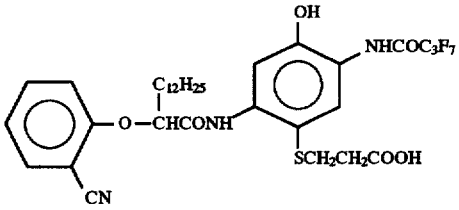
Dibutyl Phthalate Oil-1
Tricresyl Phosphate Oil-2
Oil-3
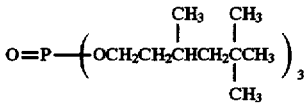
Cpd-A
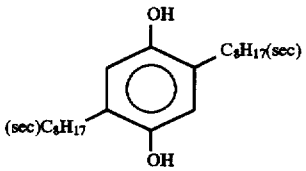
Cpd-B
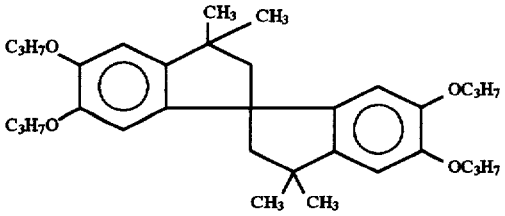
Cpd-C
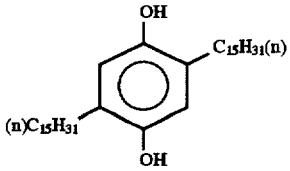
Cpd-D
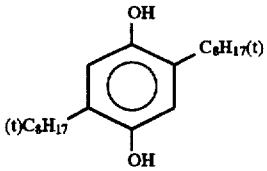
Cpd-E
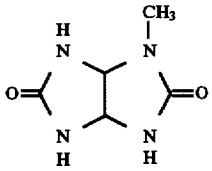
Cpd-F
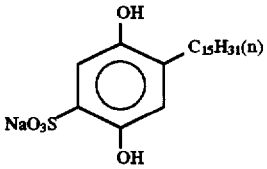
Cpd-G
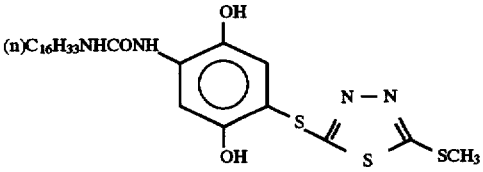

-continued
Cpd-H
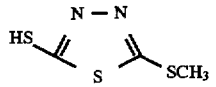
U-1
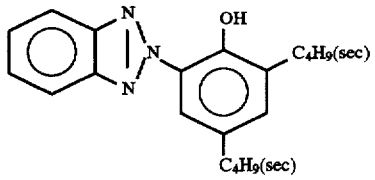
U-2
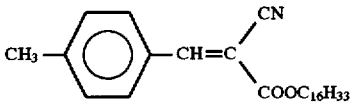
U-3
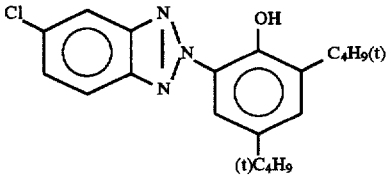
U-4
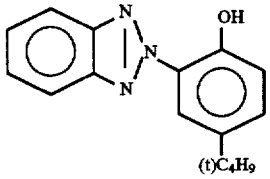
U-5
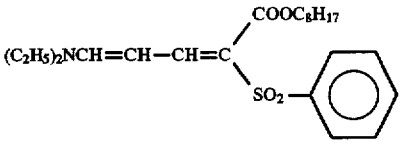
S-1
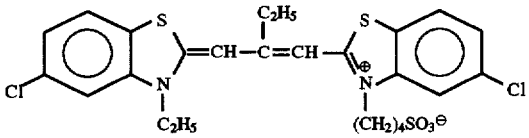
S-2
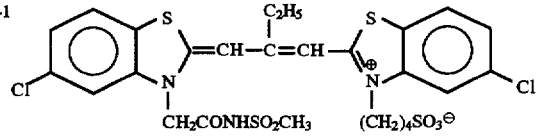
S-3
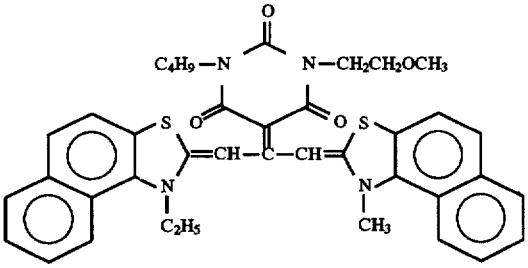
S-4
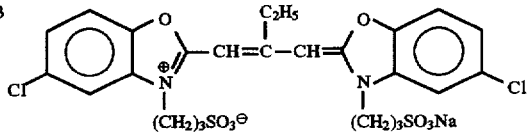
S-5
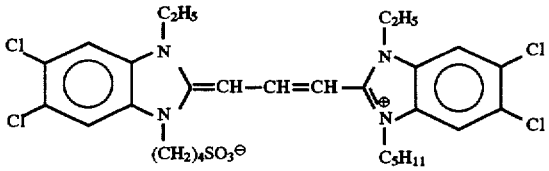
S-6
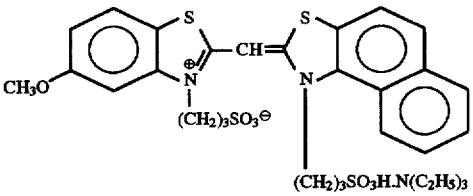
S-7
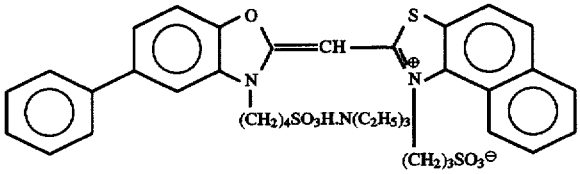
S-8
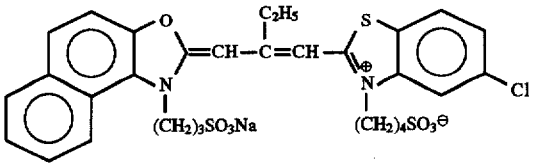

-continued
S-9
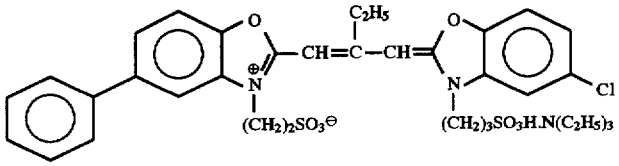
D-1
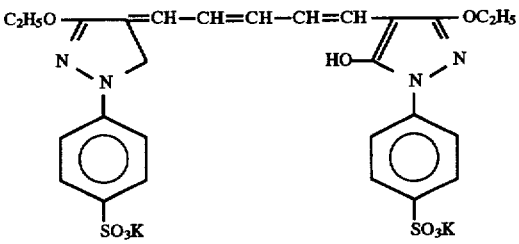
D-2
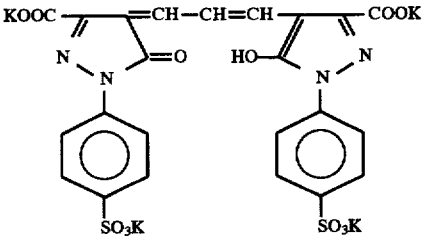
D-3
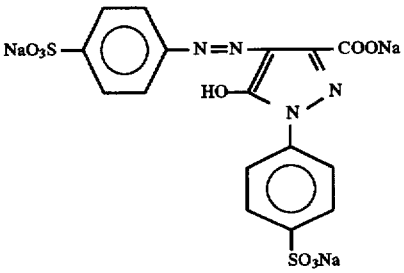
D-4
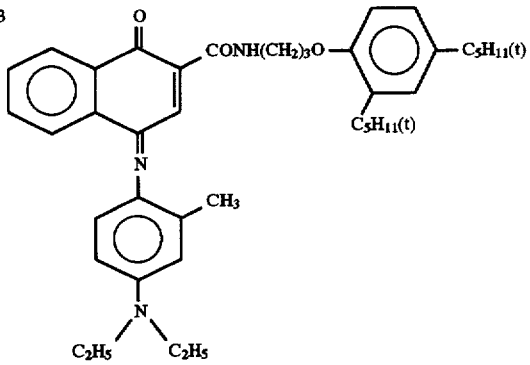
D-5
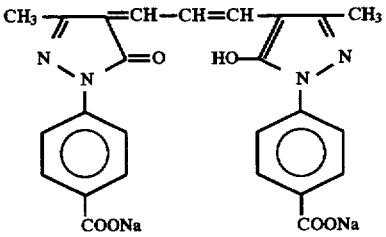
D-6
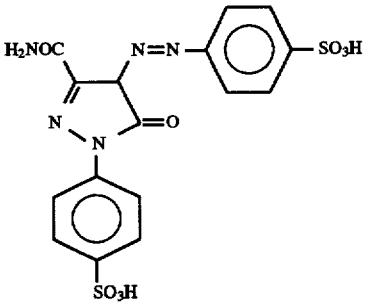
E-1
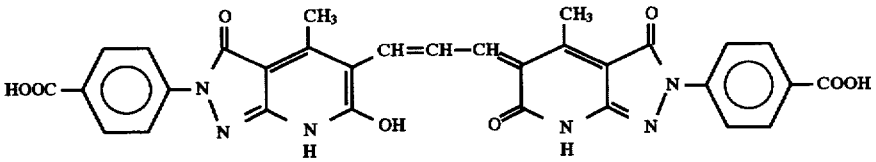
E-2
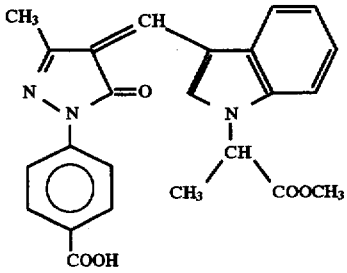
h-1
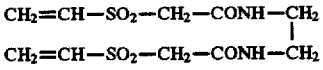

-continued
W-1
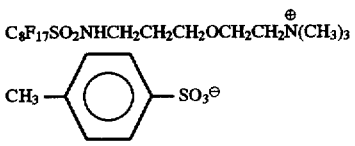
W-2
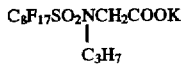
W-3
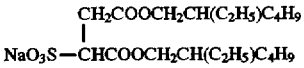
W-4
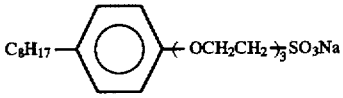
W-5
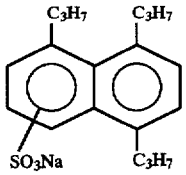
W-6
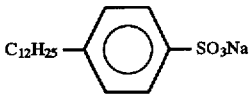
P-1
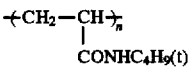
F-1
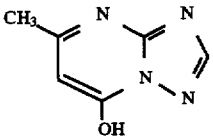
F-2
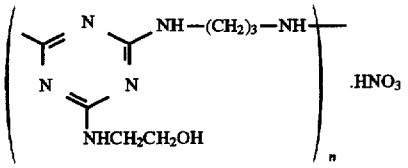
(n = 3~4)
F-3
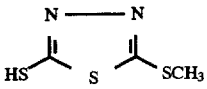
F-4
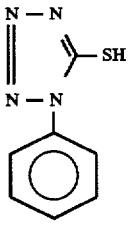
F-5
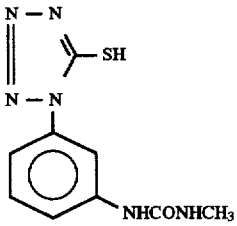
F-6
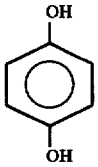
F-7
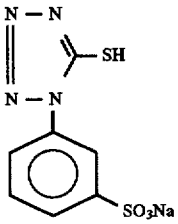
F-8
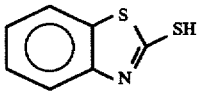

Comparative Compound (A)

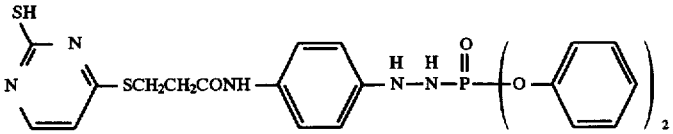

The compound disclosed in JP-A-3-154051

Comparative Compound (B)

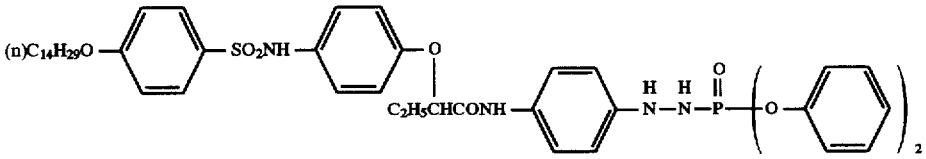

The compound disclosed in JP-A-3-164735

Comparative Compound (C)

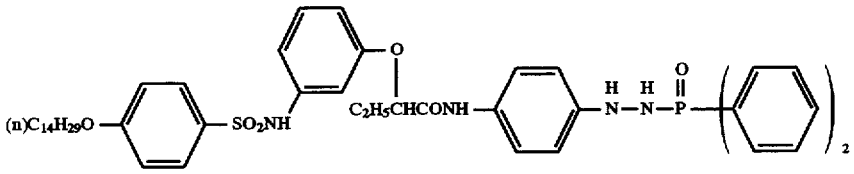

The compound disclosed in JP-A-5-232651

Comparative Compound (D)

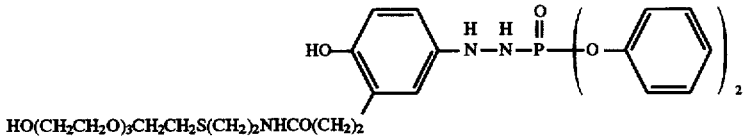

The compound disclosed in JP-A-5-173281

Comparative Compound (E)

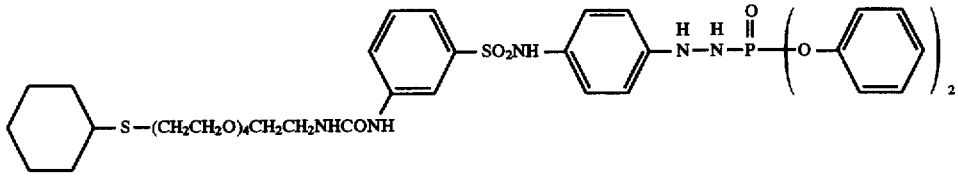

The compound disclosed in JP-A-5-142688

Sample No. 102 was prepared in the same manner as the preparation of Sample No. 101 except for replacing the Magenta Couplers C-4, C-5 and C-6 in the ninth layer, tenth layer and eleventh layer of Sample No. 101 with the Magenta Coupler (M-21) of the present invention with the coating amount being 60 mol %. Also, Sample No. 103 was prepared in the same manner as the preparation of Sample No. 102 except for replacing Color Mixing Preventives Cpd-A and Cpd-C in the eighth layer of Sample No. 102 with Comparative Compound A in the equimolar amount.

Further, Sample Nos. 104 to 112 were prepared in the same manner as the preparation of Sample No. 103 except for changing magenta couplers partly by using Comparative Compounds B, C, D and E, and Compounds (H-1), (H-2), (H-4), (H-16) and (H-23) of the present invention.

Sample Nos. 113 to 115 were prepared by replacing Compound Cpd-D in the ninth layer of Sample Nos. 108 to 110 with Compounds (H-1), (H-2) and (H-4) of the present invention in the equimolar amount.

Sample Nos. 116 to 120 were prepared in the same manner as described above using the couplers and compounds listed in Table 4.

The thus obtained Sample Nos. 101 to 120 were subjected to wedge exposure with white light, then development processed as described later.

After the magenta density ($D_O$) of each processed sample was measured, each sample was irradiated with xenon lamp (85,000 lux) from the emulsion layer side for two days and the magenta density ($D_r$) was measured again. The value $(D_r/D_O)\times100$ was taken as light discoloration resistance.

Sample Nos. 101 to 120 were then subjected to wedge exposure through a red filter and processed in the same manner as above, then the cyan density was measured. The value of the cyan minimum density ($D_{min}$) was taken as a criterion of color turbidity. As a matter of course, the smaller the value, the more excellent is the color reproducibility of the photographic material.

The evaluation of the storage stability of the photographic material was conducted as follows. That is, two strips of each sample of Sample Nos. 101 to 120 were prepared, and each one was preserved in a freezer and the other each one was stored under room temperature and 50 atm pressurized condition, either for 30 days. After then, each sample was subjected to wedge exposure with white light and the development processing similarly as above, and the magenta density was measured. When the sensitivity of the sample preserved in a freezer giving density of 1.0 was made as a standard, the fluctuation in sensitivity of the sample preserved under pressurized condition (ΔS) was taken as a criterion of the evaluation of storage stability. Sensitivity was expressed as the logarithm of the reciprocal of the exposure amount.

Processing step and composition of each processing solution are shown below. Processing was carried out using an automatic processor. A general photographed film was processed in advance until the cumulative replenishment amount of a developing solution reached three times of the tank capacity, thus a running solution was prepared. Each of the above prepared samples were processed using this running solution.

| Processing Step | Processing Time (min) | Processing Temperature (°C.) | Tank Capacity (liter) | Replenishment Rate (ml/m²) |
|---|---|---|---|---|
| First Development | 6 | 38 | 12 | 2,200 |
| First Washing | 2 | 38 | 4 | 7,500 |
| Reversal | 2 | 38 | 4 | 1,100 |
| Color Development | 6 | 38 | 12 | 2,200 |
| Pre-bleaching | 2 | 38 | 4 | 1,100 |
| Bleaching | 6 | 38 | 12 | 220 |
| Fixing | 4 | 38 | 8 | 1,100 |
| Second Washing | 4 | 38 | 8 | 7,500 |
| Final Rinsing | 1 | 25 | 2 | 1,100 |

The composition of each processing solution used was as follows.

| | Tank Solution | Replenisher |
|---|---|---|
| First Developing Solution | | |
| Pentasodium Nitrilo-N,N,N-trimethylenephosphonate | 1.5 g | 1.5 g |
| Pentasodium Diethylenetriaminepentaacetate | 2.0 g | 2.0 g |
| Sodium Sulfite | 30 g | 30 g |
| Potassium Hydroquinone-monosulfonate | 20 g | 20 g |
| Potassium Carbonate | 15 g | 20 g |
| Sodium Bicarbonate | 12 g | 15 g |
| 1-Phenyl-4-methyl-4-hydroxymethyl-3-pyrazolidone | 1.5 g | 2.0 g |

-continued

| | Tank Solution | Replenisher |
|---|---|---|
| Potassium Bromide | 2.5 g | 1.4 g |
| Potassium Thiocyanate | 1.2 g | 1.2 g |
| Potassium Iodide | 2.0 mg | — |
| Diethylene Glycol | 13 g | 15 g |
| Water to make | 1,000 ml | 1,000 ml |
| pH (adjusted with sulfuric acid or potassium hydroxide) | 9.60 | 9.60 |
| Reversal Solution | | |
| Pentasodium Nitrilo-N,N,N trimethylenephosphonate | 3.0 g | same as the tank solution |
| Stannous Chloride Dihydrate | 1.0 g | |
| p-Aminophenol | 0.1 g | |
| Sodium Hydroxide | 8 g | |
| Glacial Acetic Acid | 15 ml | |
| Water to make | 1,000 ml | |
| pH (adjusted with acetic acid or sodium hydroxide) | 6.00 | |
| Color Developing Solution | | |
| Pentasodium Nitrilo-N,N,N-trimethylenephosphonate | 2.0 g | 2.0 g |
| Sodium Sulfite | 7.0 g | 7.0 g |
| Trisodium Phosphate 12 Hydrate | 36 g | 36 g |
| Potassium Bromide | 1.0 g | — |
| Potassium Iodide | 90 mg | — |
| Sodium Hydroxide | 3.0 g | 3.0 g |
| Citrazinic Acid | 1.5 g | 1.5 g |
| N-Ethyl-N-(β-methanesulfonamidoethyl)-3-methyl-4-aminoaniline · 3/2 Sulfate · Monohydrate | 11 g | 11 g |
| 3,6-Dithiaoctane-1,8-diol | 1.0 g | 1.0 g |
| Water to make | 1,000 ml | 1,000 ml |
| pH (adjusted with sulfuric acid or potassium hydroxide) | 11.80 | 12.00 |
| Pre-bleaching Solution | | |
| Disodium Ethylenediaminetetraacetate Dihydrate | 8.0 g | 8.0 g |
| Sodium Sulfite | 6.0 g | 8.0 g |
| 1-Thioglycerol | 0.4 g | 0.4 g |
| Sodium Bisulfite Addition Products of Formaldehyde | 30 g | 35 g |
| Water to make | 1,000 ml | 1,000 ml |
| pH (adjusted with acetic or sodium hydroxide) | 6.30 | 6.10 |
| Bleaching Solution | | |
| Disodium Ethylenediaminetetraacetate Dihydrate | 2.0 g | 4.0 g |
| Ammonium Ethylenediaminetetraacetato Ferrate Dihydrate | 120 g | 240 g |
| Potassium Bromide | 100 g | 200 g |
| Ammonium Nitrate | 10 g | 20 g |
| Water to make | 1,000 ml | 1,000 ml |
| pH (adjusted with nitric acid or sodium hydroxide) | 5.70 | 5.50 |
| Fixing Solution | | |
| Ammonium Thiosulfate | 80 g | same as the tank solution |
| Sodium Sulfite | 5.0 g | same as the tank solution |
| Sodium Bisulfite | 5.0 g | same as the tank solution |
| Water to make | 1,000 ml | same as the tank solution |
| pH (adjusted with acetic acid or aqueous ammonia) | 6.60 | |
| Stabilizing Solution | | |
| 1,2-Benzisothiazolin-3-one | 0.02 g | 0.03 g |
| Polyoxyethylene-p- | 0.3 g | 0.3 g |

-continued

| | Tank Solution | Replenisher |
|---|---|---|
| monononylphenyl Ether (average polymerization degree: 10) | | |
| Polymaleic Acid (average molecular weight: 2,000) | 0.1 g | 0.15 g |
| Water to make | 1,000 ml | 1,000 ml |
| pH | 7.0 | 7.0 |

The thus obtained results are summarized in Table 5.

TABLE 4

| Sample No. | Magenta Coupler 9th Layer | 10th Layer | 11th Layer | Compound in 8th Layer | Compound in 9th Layer | Compound in 12th Layer | Compound in 13th Layer | Remarks |
|---|---|---|---|---|---|---|---|---|
| 101 | C-4 (20)<br>C-5 (40)<br>C-6 (40) | C-4 (60)<br>C-5 (20)<br>C-6 (20) | C-4 (60)<br>C-5 (20)<br>C-6 (20) | Cpd-A (50)<br>Cpd-C (50) | Cpd-D | Cpd-A | Cpd-A | Comparison |
| 102 | M-21 | M-21 | M-21 | " | " | " | " | " |
| 103 | " | " | " | Comparative Compound A | " | " | " | " |
| 104 | " | " | " | Comparative Compound B | " | " | " | " |
| 105 | " | " | " | Comparative Compound C | " | " | " | " |
| 106 | M-13 | M-13 | M-13 | Comparative Compound D | " | " | " | " |
| 107 | " | " | " | Comparative Compound E | " | " | " | " |
| 108 | M-21 | M-21 | M-21 | H-1 | " | " | " | Invention |
| 109 | " | " | " | H-2 | " | " | " | " |
| 110 | M-25 (80)<br>M-5 (20) | M-25 (80)<br>M-5 (20) | M-25 (80)<br>M-5 (20) | H-4 | " | " | " | " |
| 111 | M-13 | M-21 | C-4 (60)<br>C-5 (20)<br>C-6 (20) | H-16 | Cpd-D | Cpd-A | Cpd-A | Invention |
| 112 | M-15 (71)<br>C-5 (29) | M-15 (37)<br>M-5 (63) | M-15 (13)<br>C-5 (87) | H-23 | " | " | " | " |
| 113 | M-21 | M-21 | M-21 | H-1 | H-1 | " | " | " |
| 114 | " | " | " | H-2 | H-2 | " | " | " |
| 115 | M-25 (80)<br>M-5 (20) | M-25 (80)<br>M-5 (20) | M-25 (80)<br>M-5 (20) | H-4 | H-4 | " | " | " |
| 116 | C-4 (20)<br>C-5 (40)<br>C-6 (40) | C-4 (60)<br>C-5 (20)<br>C-6 (20) | C-4 (60)<br>C-5 (20)<br>C-6 (20) | H-17 | H-17 | H-17 | H-17 | Comparison |
| 117 | M-21 | M-21 | M-21 | " | " | " | " | Invention |
| 118 | M-21 (50)<br>M-26 (50) | M-21 (50)<br>M-26 (50) | M-21 (50)<br>M-26 (50) | H-28 | H-28 | H-28 | H-28 | " |
| 119 | M-21 | M-21 | M-21 | H-1 (50)<br>H-23 (50) | H-1 (50)<br>H-23 (50) | H-1 (50)<br>H-23 (50) | H-1 (50)<br>H-23 (50) | " |
| 120 | M-34 | M-34 | M-34 | H-2 (75)<br>Cpd-A (25) | H-2 (75)<br>Cpd-A (25) | H-2 (30)<br>Cpd-A (70) | H-2 (30)<br>Cpd-A (70) | Invention |

In Table 4, numerals in parentheses are mixing mol ratio (%).

TABLE 5

| Sample No. | Light Fading Resistance $[(D_t/D_0) \times 100]$ | Degree of Color Turbidity ($D_{min}$) | Storage Stability ($\Delta S$) | Remarks |
|---|---|---|---|---|
| 101 | 82 | 0.48 | −0.12 | Comparison |
| 102 | 63 | 0.39 | −0.11 | " |
| 103 | 79 | 0.42 | −0.05 | " |
| 104 | 79 | 0.41 | −0.05 | " |
| 105 | 80 | 0.43 | −0.07 | " |
| 106 | 80 | 0.42 | −0.06 | " |
| 107 | 81 | 0.39 | −0.06 | " |
| 108 | 82 | 0.29 | −0.06 | Invention |
| 109 | 83 | 0.33 | −0.05 | " |

TABLE 5-continued

| Sample No. | Light Fading Resistance $[(D_t/D_0) \times 100]$ | Degree of Color Turbidity ($D_{min}$) | Storage Stability ($\Delta S$) | Remarks |
|---|---|---|---|---|
| 110 | 80 | 0.34 | −0.06 | " |
| 111 | 84 | 0.34 | −0.05 | " |
| 112 | 84 | 0.36 | −0.06 | " |
| 113 | 88 | 0.28 | −0.05 | " |

TABLE 5-continued

| Sample No. | Light Fading Resistance $[(D_t/D_0) \times 100]$ | Degree of Color Turbidity ($D_{min}$) | Storage Stability ($\Delta S$) | Remarks |
|---|---|---|---|---|
| 114 | 88 | 0.31 | −0.05 | " |
| 115 | 85 | 0.32 | −0.05 | " |
| 116 | 82 | 0.45 | −0.05 | Comparison |
| 117 | 92 | 0.29 | −0.03 | Invention |
| 118 | 93 | 0.29 | −0.04 | " |
| 119 | 92 | 0.29 | −0.03 | " |
| 120 | 87 | 0.33 | −0.07 | " |

It can be seen from Table 5 that, although color turbidity can be improved by the magenta coupler of the present invention, light discoloration resistance is not good. However, by using the compound represented by formula (H) of the present invention, light fading resistance is extremely improved. This effect is conspicuous even when the compound represented by formula (H) of the present invention is present in a different layer from the magenta coupler, and this is unexpected and surprising effect.

Further, storage stability is also apparently improved and this is also unexpected effect. The present inventors are now eagerly elucidating details of these effects, and this is presumably because these effects relate to generation of some influencing material concerning with the decomposition of a magenta dye and the preservability of an emulsion.

Moreover, it is also understood that the compound represented by formula (H) of the present invention is highly reactive with the oxidized product of a developing agent and is very effective for improving color turbidity.

Also it is understood that this is, in particular, effective for using a magenta coupler which is excellent in color reproducibility and equivalency. The excellent equivalency means that smaller equivalence amount of silver halide is used to provide a dye-production from one mol of coupler.

Thus it became possible for the first time to provide a photographic material excellent in color reproducibility, storage stability and light fastness of a color image by the execution of the present invention.

EXAMPLE 2

1) Support

The support which was used in the present invention was prepared as follows.

100 weight parts of polyethylene-2,6-naphthalate polymer and 2 weight parts of Tinuvin P. 326 (product of Ciba Geigy), as an ultraviolet absorbing agent, were dried, then melted at 300° C., subsequently, extruded through a T-type die, and stretched 3.3 times in a lengthwise direction at 140° C. and then 3.3 times in a width direction at 130° C., and further thermal fixed for 6 seconds at 250° C. and the PEN film having the thickness of 90 μm was obtained. Further, appropriate amounts of blue dyes, magenta dyes and yellow dyes were added to this PEN film (I-1, I-4, I-6, I-24, I-26, I-27, II-5 disclosed in Kokai-Giho, Kogi No. 94-6023). Further, the film was wound on to a stainless steel spool having a diameter of 20 cm and provided heat history at 110° C. for 48 hours to obtain a support reluctant to get curling habit.

2) Coating of an Undercoat Layer

After both surfaces of the support were subjected to corona discharge, UV discharge and glow discharge treatments, on each side of the support an undercoat solution having the following composition was coated (10 cc/m$^2$, using a bar coater): 0.1 g/m$^2$ of gelatin, 0.01 g/m$^2$ of sodium α-sulfo-di-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of polyamide-epichlorohydrin polycondensation product. The undercoat layer was provided on the hotter side at the time of stretching. Drying was conducted at 115° C. for 6 min (the temperature of the roller and transporting apparatus of the drying zone was 115° C.).

3) Coating of a Backing Layer

On one side of the above support after undercoat layer coating, an antistatic layer, a magnetic recording layer and a sliding layer (or a lubricating layer) having the following compositions were coated as backing layers.

3-1) Coating of an Antistatic Layer 0.2 g/m$^2$ of a dispersion of fine grain powder of a stannic oxide-antimony oxide composite having the average grain size of 0.005 μm and specific resistance of 5 Ω.cm (the grain size of the second agglomerate: about 0.08 μm), 0.05 g/m$^2$ of gelatin, 0.02 g/m$^2$ of $(CH_2{=}CHSO_2CH_2CH_2NHCO)_2CH_2$, 0.005 g/m$^2$ of poly(polymerization degree: 10)oxyethylene-p-nonylphenol and resorcin were coated.

3-2) Coating of a Magnetic Recording Layer 0.06 g/m$^2$ of cobalt-γ-iron oxide which was coating-treated with 3-poly(polymerization degree: 15)oxyethylenepropyloxytrimethoxysilane (15 wt %) (specific surface area: 43 m$^2$/g, major axis: 0.14 μm, mono axis: 0.03 μm, saturation magnetization: 89 emu/g, $Fe^{+2}/Fe^{+3}$ is 6/94, the surface was surface-treated with 2 wt %, respectively, based on the iron oxide, of aluminum oxide and silicon oxide), 1.2 g/m$^2$ of diacetyl cellulose (dispersion of the iron oxide was carried out using an open kneader and a sand mill), 0.3 g/m$^2$ of $C_2H_5C(CH_2OCONH{-}C_6H_3(CH_3)NCO)_3$ as a hardener, with acetone, methyl ethyl ketone and cyclohexanone as solvents, were coated with a bar coater to obtain a magnetic recording layer having the film thickness of 1.2 μm. Silica grains (0.3 μm) as a matting agent and aluminum oxide (0.15 μm) coating-treated with 3-poly (polymerization degree: 15)oxyethylenepropyloxytrimethoxysilane (15 wt %) as an abrasive were added each in an amount of 10 mg/m$^2$. Drying was conducted at 115° C. for 6 minutes (the temperature of the roller and transporting apparatus of the drying zone was 115° C.). The increase of the color density of $D^B$ of the magnetic recording layer by X-light (a blue filter) was about 0.1, and saturation magnetization moment of the magnetic recording layer was 4.2 emu/g, coercive force was 7.3×10$^4$A/m, and rectangular ratio was 65%.

3—3) Preparation of a Sliding (Lubricating) Layer

Diacetyl cellulose (25 mg/m$^2$), and a mixture of $C_6H_{13}CH(OH)C_{10}H_{20}COOC_{40}H_{81}$ (Compound a, 6 mg/m$^2$)/$C_{50}H_{101}O(CH_2CH_2O)_{16}H$ (Compound b, 9 mg/m$^2$) were coated. This mixture of Compound a/Compound b was dissolved in xylene/propylene monomethyl ether (1/1) by heating at 105° C., and poured into propylene monomethyl ether (10 time amount) at room temperature and dispersed, and further dispersed in acetone (average grain size: 0.01 μm), then added to the coating solution. Silica grains (0.3 μm) as a matting agent and aluminum oxide (0.15 μm) coated with 3-poly(polymerization degree: 15)oxyethylenepropyloxytrimethoxysilane (15 wt %) as an abrasive were added each in an amount of 15 mg/m$^2$. Drying was conducted at 115° C. for 6 minutes (the temperature of the roller and transporting apparatus of the drying zone was 115° C.). The thus-obtained sliding (lubricating) layer showed excellent performances of dynamic friction coefficient of 0.06 (a stainless steel hard ball of 5 mmφ, load: 100 g, speed: 6 cm/min), static friction coefficient of 0.07 (clip method), and the sliding (lubricating) property with the surface of the emulsion described below provided dynamic friction coefficient of 0.12.

4) Coating of a Light-Sensitive Layer

Next, the same emulsion layers as Sample Nos. 101 and 120 in Example 1 were multilayer coated on the opposite side of the above obtained backing layer and Sample Nos. 201 and 220 were prepared.

5) Evaluation

The samples obtained were evaluated in the same manner as in Example 1. Sample No. 220 was apparently improved in color turbidity, light discoloration and storage stability compared with Sample No. 201.

EXAMPLE 3

Sample No. 301 of the present invention was prepared by replacing Cpd-7, -16 in the fifth layer and Cpd-7 in the eighth layer of Sample No. 101 in Example 1 of JP-A-4-163454 with Compound (H-1) of the present invention in equimolar amounts. Further, Sample Nos. 302 and 303 were prepared similarly using Compounds (H-3) and (H-16).

These samples were evaluated for the storage stabilities of the photographic material and color image, and color turbidity similarly in Example 1 of the present invention. Also, the improving effects by the compounds of the present invention could be confirmed.

Processing of the photographic material was carried out according to the method disclosed in Example 1 of JP-A-4-163454.

EXAMPLE 4

The present invention will be illustrated in more detail with reference to examples below, but these are not to be construed as limiting the invention.

Preparation of Sample No. 101'

A multilayer color photographic material was prepared as Sample No. 101 by coating each layer having the following composition on an undercoated cellulose triacetate film support having the thickness of 127 μm. The numeral corresponding to each component indicates the addition amount per $m^2$. The function of the compounds added is not limited to the use described.

| | |
|---|---|
| **First Layer: Antihalation Layer** | |
| Black Colloidal Silver | 0.10 g |
| Gelatin | 1.90 g |
| Ultraviolet Absorbing Agent U-1 | 0.10 g |
| Ultraviolet Absorbing Agent U-3 | 0.040 g |
| Ultraviolet Absorbing Agent U-4 | 0.10 g |
| High Boiling Point Organic Solvent Oil-1 | 0.10 g |
| Microcrystal Solid Dispersion of Dye E-1 | 0.10 g |
| **Second Layer: Interlayer** | |
| Gelatin | 0.40 g |
| Compound Cpd-C | 5.0 mg |
| Compound Cpd-J | 5.0 mg |
| Compound Cpd-K | 3.0 mg |
| High Boiling Point Organic Solvent Oil-3 | 0.10 g |
| Dye D-4 | 0.80 mg |
| **Third Layer: Interlayer** | |
| Surface and Interior Fogged Fine Grain Silver Iodobromide Emulsion (average grain size: 0.06 μm, variation coefficient: 18%, AgI content: 1 mol %) | silver amount: 0.050 g |
| Yellow Colloidal Silver | silver amount: 0.030 g |
| Gelatin | 0.40 g |
| **Fourth Layer: Low Sensitivity Red-Sensitive Emulsion Layer** | |
| Emulsion A | silver amount: 0.35 g |
| Emulsion B | silver amount: 0.30 g |
| Gelatin | 0.80 g |
| Coupler C-1 | 0.10 g |
| Coupler C-2 | 0.25 g |
| Compound Cpd-C | 5.0 mg |
| Compound Cpd-J | 5.0 mg |
| High Boiling Point Organic Solvent Oil-2 | 0.10 g |
| Additive P-1 | 0.10 g |
| **Fifth Layer: Middle Sensitivity Red-Sensitive Emulsion Layer** | |
| Emulsion B | silver amount: 0.20 g |
| Emulsion C | silver amount: 0.30 g |
| Gelatin | 0.80 g |
| Coupler C-1 | 0.06 g |
| Coupler C-2 | 0.15 g |
| High Boiling Point Organic Solvent Oil-2 | 0.10 g |
| Additive P-1 | 0.10 g |
| **Sixth Layer: High Sensitivity Red-Sensitive Emulsion Layer** | |
| Emulsion D | silver amount: 0.60 g |
| Gelatin | 1.10 g |
| Coupler C-1 | 0.20 g |
| Coupler C-2 | 0.40 g |
| Additive P-1 | 0.10 g |
| **Seventh Layer: Interlayer** | |
| Gelatin | 0.70 g |
| Additive M-1 | 0.30 g |
| Compound Cpd-1 | 2.6 mg |
| Dye D-5 | 0.020 g |
| Dye D-6 | 0.010 g |
| Compound Cpd-J | 5.0 mg |
| Color Mixing Preventive Cpd-A | 0.060 g |
| High Boiling Point Organic Solvent Oil-1 | 0.020 g |
| High Boiling Point Organic Solvent Oil-3 | 0.060 g |
| **Eighth Layer: Interlayer** | |
| Surface and Interior Fogged Silver Iodobromide Emulsion (average grain size: 0.06 μm, variation coefficient: 16%, AgI content: 0.3 mol %) | silver amount: 0.020 g |
| Yellow Colloidal Silver | silver amount: 0.020 g |
| Gelatin | 1.00 g |
| Additive P-1 | 0.05 g |
| Color Mixing Preventive Cpd-A | 0.10 g |
| High Boiling Point organic Solvent Oil-3 | 0.10 g |
| **Ninth Layer: Low Sensitivity Green-Sensitive Emulsion Layer** | |
| Emulsion E | silver amount: 0.10 g |
| Emulsion F | silver amount: 0.20 g |
| Emulsion G | silver amount: 0.20 g |
| Gelatin | 0.50 g |
| Coupler C-3' | 0.10 g |
| Coupler C-6' | 0.050 g |
| Coupler C-7' | 0.10 g |
| Compound Cpd-B | 0.030 g |
| Compound Cpd-D' | 0.020 g |
| Compound Cpd-E' | 0.020 g |
| Compound Cpd-F' | 0.040 g |
| Compound Cpd-J | 10 mg |
| High Boiling Point Organic Solvent Oil-1 | 0.10 g |
| High Boiling Point Organic Solvent Oil-2 | 0.10 g |
| **Tenth Layer: Middle Sensitivity Green-Sensitive Emulsion Layer** | |
| Emulsion G | silver amount: 0.30 g |
| Emulsion H | silver amount: 0.10 g |
| Gelatin | 0.60 g |
| Coupler C-3' | 0.070 g |
| Coupler C-6' | 0.050 g |
| Coupler C-7' | 0.050 g |
| Compound Cpd-B | 0.030 g |
| Compound Cpd-D' | 0.020 g |
| Compound Cpd-E' | 0.020 g |
| Compound Cpd-F' | 0.050 g |
| High Boiling Point Organic Solvent Oil-2 | 0.010 g |
| **Eleventh Layer: High Sensitivity Green-** | |

-continued

| | |
|---|---|
| **Sensitive Emulsion Layer** | |
| Emulsion I | silver amount: 0.50 g |
| Gelatin | 1.00 g |
| Coupler C-3' | 0.20 g |
| Coupler C-6' | 0.10 g |
| Coupler C-7' | 0.050 g |
| Compound Cpd-B | 0.080 g |
| Compound Cpd-E' | 0.020 g |
| Compound Cpd-F' | 0.040 g |
| Compound Cpd-K | 5.0 mg |
| High Boiling Point organic Solvent Oil-1 | 0.020 g |
| High Boiling Point organic Solvent Oil-2 | 0.020 g |
| **Twelfth Layer: Interlayer** | |
| Gelatin | 0.60 g |
| **Thirteenth Layer: Yellow Filter Layer** | |
| Yellow Colloidal Silver | silver amount: 0.070 g |
| Gelatin | 1.10 g |
| Color Mixing Preventive Cpd-A | 0.05 g |
| High Boiling Point Organic Solvent Oil-3 | 0.05 g |
| Microcrystal Solid Dispersion of Dye E-2 | 0.030 g |
| Microcrystal Solid Dispersion of Dye E-3 | 0.020 g |
| **Fourteenth Layer: Interlayer** | |
| Gelatin | 0.60 g |
| **Fifteenth Layer: Low Sensitivity Blue-Sensitive Emulsion Layer** | |
| Emulsion J | silver amount: 0.20 g |
| Emulsion K | silver amount: 0.30 g |
| Gelatin | 0.80 g |
| Coupler C-4' | 0.20 g |
| Coupler C-5' | 0.10 g |
| Coupler C-8' | 0.40 g |
| Compound Cpd-I | 0.02 g |
| **Sixteenth Layer: Middle Sensitivity Blue-Sensitive Emulsion Layer** | |
| Emulsion L | silver amount: 0.30 g |
| Emulsion M | silver amount: 0.30 g |
| Gelatin | 0.90 g |
| Coupler C-4' | 0.10 g |
| Coupler C-5' | 0.10 g |
| Coupler C-8' | 0.60 g |
| **Seventeenth Layer: High Sensitivity Blue-sensitive Emulsion Layer** | |
| Emulsion N | silver amount: 0.20 g |
| Emulsion O | silver amount: 0.20 g |
| Gelatin | 1.20 g |

-continued

| | |
|---|---|
| Coupler C-4' | 0.10 g |
| Coupler C-5' | 0.10 g |
| Coupler C-8' | 0.60 g |
| High Boiling Point Organic Solvent Oil-2 | 0.10 g |
| **Eighteenth Layer: First Protective Layer** | |
| Gelatin | 0.70 g |
| Ultraviolet Absorbing Agent U-1 | 0.20 g |
| Ultraviolet Absorbing Agent U-2 | 0.050 g |
| Ultraviolet Absorbing Agent U-5 | 0.30 g |
| Color Mixing Preventive Cpd-A | 0.10 g |
| Formalin Scavenger Cpd-H' | 0.40 g |
| Dye D-1 | 0.15 g |
| Dye D-2 | 0.050 g |
| Dye D-3 | 0.10 g |
| High Boiling Point organic Solvent Oil-3 | 0.10 g |
| **Nineteenth Layer: Second Protective Layer** | |
| Colloidal Silver | silver amount: 0.10 mg |
| Fine Grain Silver Iodobromide Emulsion (average grain size: 0.06 μm, AgI content: 1 mol %) | silver amount: 0.10 g |
| Gelatin | 0.40 g |
| **Twentieth Layer: Third Protective Layer** | |
| Gelatin | 0.40 g |
| Polymethyl Methacrylate (average particle size: 1.5 μm) | 0.10 g |
| Copolymer of Methyl Methacrylate/Acrylic Acid in Proportion of 4/6 (average particle size: 1.5 μm) | 0.10 g |
| Silicone Oil | 0.030 g |
| Surfactant W-1 | 3.0 mg |
| Surfactant W-2 | 0.030 g |

Further, Additives F-1 to F-8 were added to every emulsion layer in addition to the above components. Moreover, gelatin hardener h-1 and surfactants W-3, W-4, W-5 and W-6 for coating and emulsifying were added to every layer in addition to the above components.

In addition, phenol, 1,2-benzisothiazolin-3-one, 2-phenoxyethanol, phenethyl alcohol, p-benzoic acid butyl ester were added as antibacterial and antifungal agents.

The silver iodobromide emulsions A to O used in Sample No. 101' are the same as used in Sample No. 101 in Example 1.

C-3'

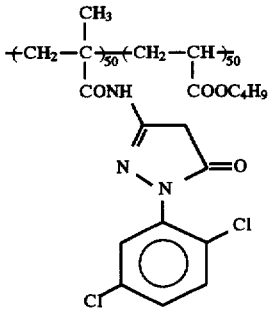

numerals indicate wt%
average molecular weight: about 25,000

C-4'

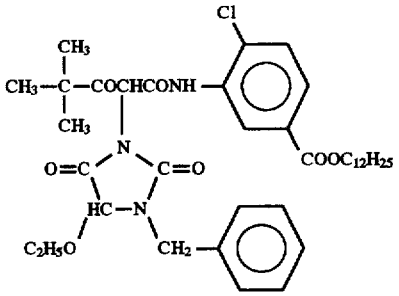

-continued
C-5'
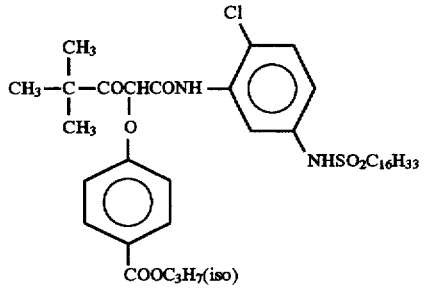
C-6'
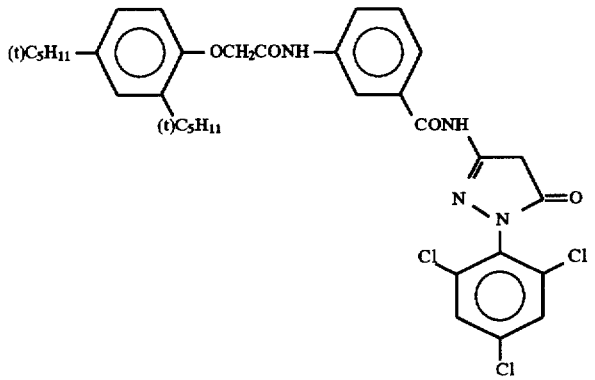
C-7'
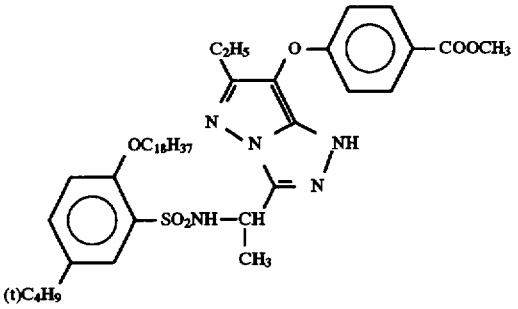
C-8'
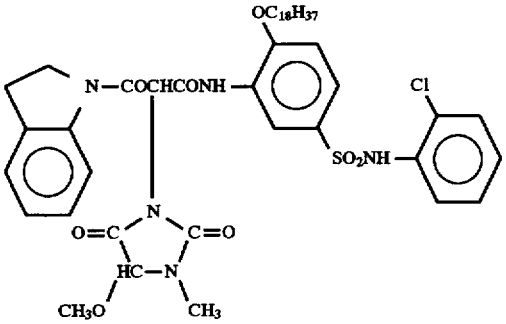
Cpd-D'
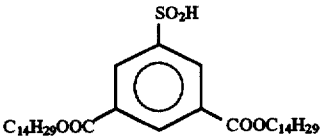
Cpd-E'
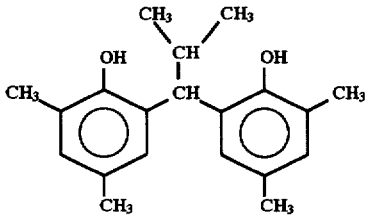
Cpd-F'
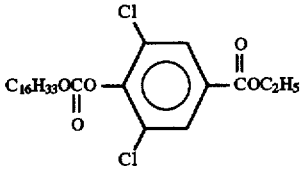
Cpd-H'
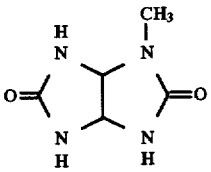
Cpd-I'
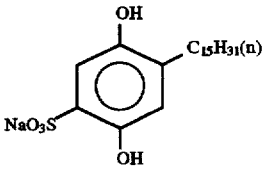
Cpd-J'
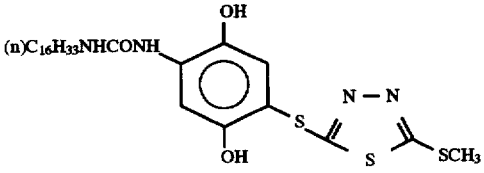

-continued

Cpd-K'

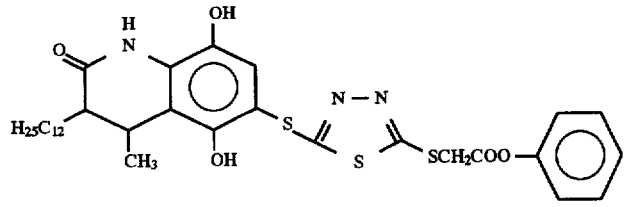

E-3

M-1

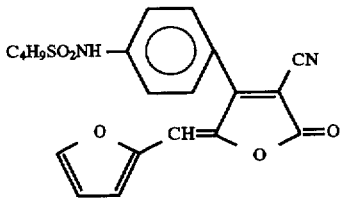

Preparation of Dispersion of Organic Solid Dispersion Dye

Dye E-1 was dispersed according to the following method. That is, water and 200 g of Pluronic F88 (ethylene oxide/propylene oxide block copolymer) manufactured by BASF Co. were added to 1,430 g of a wet cake of the dye containing 30% of methanol, and stirred to obtain a slurry having dye concentration of 6%. Next, 1,700 ml of zirconia beads having an average grain size of 0.5 mm were filled in an ultravisco mill (UVM-2) manufactured by Imex Co., the slurry was passed and the content was pulverized at a peripheral speed of about 10 m/sec and discharge amount of 0.5 l/min for 8 hours. Beads were removed by filtration, water was added to dilute the dispersion to dye concentration of 3%, then heated at 90° C. for 10 hours for stabilization. The average grain size of the obtained fine grains of the dye was 0.60 μm and the extent of distribution of grain sizes (standard deviation of grain sizes×100/average grain size) was 18%.

Solid dispersions of E-2 and E-3 were obtained in the same manner. Average grain sizes were 0.54 μm and 0.56 μm, respectively.

Samples were prepared by replacing the cyan couplers in the fourth to sixth layers of Sample No. 101' with the cyan coupler of the present invention so as to the color density became the same, further samples in which the compounds represented by formula (H) of the present invention were added in the fourth to sixth layers in an amount of 5 mol % based on the cyan coupler, and samples in which color mixing preventives in the seventh and eighth layers were replaced with comparative compounds and the compounds represented by formula (H) of the present invention in equimolar amount were prepared as indicated in Table 6.

TABLE 6

| Sample No. | Remarks | Cyan Coupler | Diffusion Resistant Compound: 4th to 6th Layers | Diffusion Resistant Compound: 7th and 8th Layers |
|---|---|---|---|---|
| 101' | Comparison | C-1/C-2 | — | Cpd-A |
| 102' | " | (1) | Comparative Compound A | " |
| 103' | " | " | Comparative Compound B | " |
| 104' | " | " | Comparative Compound C | " |

TABLE 6-continued

| Sample No. | Remarks | Cyan Coupler | Diffusion Resistant Compound: 4th to 6th Layers | Diffusion Resistant Compound: 7th and 8th Layers |
|---|---|---|---|---|
| 105' | Invention | " | H-(1) | " |
| 106' | " | " | H-(16) | " |
| 107' | " | " | H-(23) | " |
| 108' | " | (7) | H-(1) | " |
| 109' | " | (28) | " | " |
| 110' | " | (39) | " | " |
| 111' | Comparison | (1) | — | Comparative Compound A |
| 112' | " | " | — | Comparative Compound C |
| 113' | Invention | " | — | H-(1) |
| 114' | " | " | — | H-(17) |
| 115' | " | (23) | — | " |
| 116' | " | (29) | — | " |
| 117' | " | (36) | — | H-(28) |
| 118' | " | C-1/(1) = 3/7 (mol ratio) | — | " |
| 119' | " | (29) | H-(1) | H-(16) |
| 120' | " | (39) | H-(3) | H-(4) |

The structural formulae of the comparative compounds A, B and C are the same as used in Example 1.

The thus obtained Sample Nos. 101' to 120' were cut in strips and subjected to wedge exposure through a red filter. Subsequently, these samples were developed according to the following development processing step. Density measurement was conducted from the characteristic curve and the minimum density value ($D_{min}$) of cyan color density was read out and color turbidity (color mixture) was evaluated. The lower the density value, the smaller is the color mixture.

Next, Sample Nos. 101' to 120' were preserved under 50° C., 55% RH for seven days. After preservation, they were subjected to wedge exposure in the ordinary method, and processed together with the samples preserved at room temperature according to the following processing step and the reduction of the maximum color density value ($D_{max}$) of cyan color density was examined. The higher the value, the larger is the reduction of the maximum color density.

Subsequently, Sample Nos. 101' to 120' were cut to 10×10 cm in size, and exposed so that each of cyan, magenta and yellow color densities came near 1.0, and after being processed similarly as above, the number of a spot of 50 μm or more was examined using a microscope.

Then, Sample Nos. 101' to 120' were subjected to exposure of three color separation, and after processing, preserved under 80° C., 70% RH for one month and discoloration test was conducted. Evaluation was indicated by remaining rate of the color image in $D_{max}$ of the initial cyan color density in %.

The results obtained are shown in Table 7 below.

TABLE 7

| Sample No. | Remarks | Color[1] Mixture | ΔDmax[2] | Spot[3] | Color Image[4] fastness (80° C., 70%) (%) |
|---|---|---|---|---|---|
| 101' | Comparison | 0.46 | 0.24 | ○ | 76 |
| 102' | " | 0.45 | 0.30 | x | 83 |
| 103' | " | 0.46 | 0.31 | xx | 85 |
| 104' | " | 0.43 | 0.33 | xx | 86 |
| 105' | Invention | 0.38 | 0.12 | Δ | 91 |
| 106' | " | 0.39 | 0.10 | Δ | 90 |
| 107' | " | 0.38 | 0.13 | Δ | 90 |
| 108' | " | 0.36 | 0.17 | Δ | 91 |
| 109' | " | 0.37 | 0.13 | Δ | 89 |
| 110' | " | 0.38 | 0.12 | Δ | 91 |
| 111' | Comparison | 0.43 | 0.35 | ○ | 86 |
| 112' | " | 0.42 | 0.38 | ○ | 88 |
| 113' | Invention | 0.36 | 0.16 | ○ | 93 |
| 114' | " | 0.35 | 0.15 | ○ | 94 |
| 115' | " | 0.35 | 0.19 | ○ | 93 |
| 116' | " | 0.37 | 0.16 | ○ | 95 |
| 117' | " | 0.36 | 0.18 | ○ | 93 |
| 118' | " | 0.37 | 0.18 | ○ | 89 |
| 119' | " | 0.33 | 0.12 | Δ | 91 |
| 120' | " | 0.34 | 0.15 | Δ | 90 |

[1]Color mixture is $D_{min}$ of cyan coloring characteristic curve
[2]$\Delta D_{max} = D_{max}$ of the samples preserved at room temperature minus $D_{max}$ of the samples preserved at 50° C., 55% RH for seven days
[3]Spot evaluation:
○: from 0 to 3 spots
Δ: from 3 to 10 spots
x: from 11 to 30 spots
xx: 31 spots or more
[4]Color Image fastness = $D_{max}$ of the sample before preservation/$D_{max}$ of the sample after preservation × 100

From the results in Table 7, it can be seen that Sample Nos. 105' to 110', in which the cyan coupler of the present invention and the hydrazine compound represented by formula (H) of the present invention were used in combination in the same layer, were extremely improved in spot failure compared with comparative Sample Nos. 102' to 104'. Also, in Sample Nos. 113' to 117', in which the hydrazine compound of the present invention was used in the seventh and eighth layers (color mixing preventing layers) adjacent to the layers containing the cyan coupler of the present invention, there was generated no spot, this is apparently the manifestation of the present invention. Further, Sample No. 118', in which the conventional phenol cyan coupler was used in combination with the cyan coupler of the present invention, was a little inferior in color image stability, but the effect of the present invention was sufficiently exhibited in other performances. On the contrary, comparative Sample Nos. 111' and 112' were, although there was no generation of a spot, inferior to the samples of the present invention in the reduction of $D_{max}$ when preserved at 50° C., 55% RH for seven days and color image stability. Also, Sample Nos. 119' and 120', in which the hydrazine compound of the present invention and the cyan coupler of the present invention were used in combination in the adjacent layers, sufficiently manifested the effect of the present invention.

Further, in Sample No. 113' of the present invention, in which the color mixing preventives Cpd-A in the thirteenth and eighteenth layers were replaced with the compound H-(1) of the present invention in equal weight, the same effect as above was obtained.

As described above, color turbidity which occurs when pyrroloazole cyan coupler is used, the reduction of $D_{max}$ when preserved under high temperature, and the spot failure which occurs when hydrazine compound is used with cyan coupler in the same layer can be prevented by the combined use of the cyan coupler of the present invention and the hydrazine compound of the present invention. In addition, color image stability can be further improved by the combined use of the cyan coupler of the present invention and the hydrazine compound of the present invention.

EXAMPLE 5

1) Support

The support which was used in the present invention was prepared as follows.

100 weight parts of commercially available polyethylene-2,6-naphthalate polymer and 2 weight parts of Tinuvin P. 326 (product of Ciba Geigy), as an ultraviolet absorbing agent, were dried in a usual method, then, melted at 300° C., subsequently, extruded through a T-type die, and stretched 3.0 times in a lengthwise direction at 140° C. and then 3.0 times in a width direction at 130° C., and further thermal fixed for 6 seconds at 250° C. and the PEN film having the thickness of 90 μm was obtained.

Further, a part of it was spooled around a stainless steel spool having a diameter of 20 cm and provided a heat history at 110° C. for 48 hours.

2) Coating of an Undercoat Layer

An undercoat layer having the following composition was coated on each side of the above support after both surfaces of which were subjected to corona discharge, UV discharge, further, glow discharge and flame discharge treatments. The undercoat layer was provided on the hotter side at the time of stretching. The corona discharge treatment was carried out using solid state corona processor model 6 KVA available from Pillar Co., Ltd. which can treat the support of 30 cm wide at a rate of 20 m/min. At this time, the treatment of 0.375 KV.A.min/$m^2$ was conducted to the support from the reading of the electric current and voltage. The discharge frequency at the treatment time was 9.6 KHz, gap clearance between the electrode and the induction roll was 1.6 mm. UV discharge treatment was conducted by heating at 75° C. Further, glow discharge treatment was conducted by a cylindrical electrode at 3,000 w and irradiated for 30 sec.

| | |
|---|---|
| Gelatin | 3 g |
| Distilled Water | 25 ml |
| Sodium-α-sulfo-di-2-ethylhexyl-succinate | 0.05 g |
| Formaldehyde | 0.02 g |
| Salicylic Acid | 0.1 g |
| Diacetyl Cellulose | 0.5 g |
| p-Chlorophenol | 0.5 g |
| Resorcin | 0.5 g |
| Cresol | 0.5 g |
| $(CH_2{=}CHSO_2CH_2CH_2NHCO)_2CH_2$ | 0.2 g |
| Trimethylolpropane Aziridine 3 Time Mol Addition Product | 0.2 g |
| Trimethylolpropane-Toluene-diisocyanate 3 Time Mol Addition product | 0.2 g |
| Methanol | 15 ml |
| Acetone | 85 ml |
| Formaldehyde | 0.01 g |
| Acetic Acid | 0.01 g |
| Concentrated Hydrochloric Acid | 0.01 g |

3) Coating of a Backing Layer

On one side of the above support after undercoat layer coating, an antistatic layer, a magnetic recording layer and a sliding layer having the following compositions were coated as backing layers.

3-1) Coating of an antistatic layer 3-1-1) Preparation of electrically conductive fine grain dispersion solution (a composite dispersion solution of stannic oxide-antimony oxide)

230 weight parts of stannic chloride hydrate and 23 weight parts of antimony trichloride were dissolved in 3,000 weight parts of ethanol and homogeneous solution was obtained. A 1N aqueous sodium hydroxide solution was dropwise added to the above solution until the pH of the solution reached 3, thereby the coprecipitate of colloidal stannic oxide and antimony oxide was obtained. The thus-obtained coprecipitate was allowed to stand at 50° C. for 24 hours and red brown colloidal precipitate was obtained.

The red brown colloidal precipitate was isolated by a centrifugal separator. Water was added to the precipitate and washed by centrifugation to remove excessive ions. The excessive ions were removed by repeating this operation three times.

200 weight parts of the colloidal precipitate from which the excessive ions were removed was again dispersed in 1,500 weight parts of water, atomized in a kiln heated to 650° C., thereby a bluish fine grain powder of a stannic oxide-antimony oxide composite having an average grain size of 0.005 μm was obtained. The specific resistance of this fine grain powder was 5 Ω.cm.

The pH of the mixed solution comprising 40 weight parts of the above fine grain powder and 60 weight parts of water was adjusted to 7.0. This mixed solution was dispersed coarsely by a disperser, then dispersed using a horizontal sand mill (Dyno Mill, manufactured by WILLYA. BACHOFENAG) until the residence time reached 30 minutes, thus the objective product was prepared. The average grain size of the second agglomerate was about 0.04 μm.

3-1-2) Coating of an electrically conductive layer

The electrically conductive layer having the following formulation was coated on a support so as to the dry film thickness reached 0.2 μm and dried at 115° C. for 60 seconds.

| | |
|---|---|
| Electrically Conductive Fine Grain Dispersion Solution prepared in 3-1-1) | 20 weight parts |
| Gelatin | 2 weight parts |
| Water | 27 weight parts |
| Methanol | 60 weight parts |
| p-Chlorophenol | 0.5 weight parts |
| Resorcin | 2 weight parts |
| Polyoxyethylenenonylphenyl Ether | 0.01 weight parts |

The resistance of the obtained electrically conductive film was $10^{8.0}$ (100 V) and this showed excellent antistatic property.

3-2) Coating of a magnetic recording layer

To 1,100 g of magnetic substance Co-adherend $\gamma$-$Fe_2O_3$ (acicular, major axis: 0.14 μm, minor axis: 0.03 μm, specific surface area: 41 $m^2/g$, saturation magnetization: 89 emu/g, the surface was surface treated with 2 wt %, respectively, based on $Fe_2O_3$, of aluminum oxide and silicon oxide, coercive force: 930 Oe, $Fe^{+2}/Fe^{+3}$ is 6/94), 220 g of water and 150 g of silane coupling agent of poly(polymerization degree: 16)-oxyethylenepropyltrimethoxysilane were added and kneaded well in an open kneader for 3 hours. This coarsely dispersed viscous solution was dried at 70° C. a whole day and night and the water was removed, and heated at 110° C. for 1 hour to prepare the surface-treated magnetic grains.

Further, this product was again kneaded in the open kneader according to the following formulation.

| | |
|---|---|
| The Above Surface-Treated Magnetic Grain | 1,000 g |
| Diacetyl Cellulose | 17 g |
| Methyl Ethyl Ketone | 100 g |
| Cyclohexanone | 100 g |

Further, this product was finely dispersed by a sand mill (1/4 G) at 200 rpm for 4 hours according to the following formulation.

| | |
|---|---|
| The Above Kneaded Product | 100 g |
| Diacetyl Cellulose | 60 g |
| Methyl Ethyl Ketone | 300 g |
| Cyclohexanone | 300 g |

Further, acetyl cellulose and trimethylolpropanetoluenediisocyanate 3 time mol addition product as a hardening agent were added thereto in an amount of 20 wt % based on the binder. This was diluted with equal amounts of methyl ethyl ketone and cyclohexanone so that the obtained solution provided the viscosity of 80 cp. The solution was coated on the above electrically conductive layer using a bar coat so that the film thickness became 1.2 μm. The magnetic substance was coated in an amount of 62 $mg/m^2$. Silica grains (0.3 μm) as a matting agent and aluminum oxide (0.5 μm) as an abrasive were added each in an amount of 10 $mg/m^2$. Drying was conducted at 115° C. for 6 min (the temperature of the roller and transporting apparatus of the drying zone was 115° C.).

The increase of the color density of $D^B$ of the magnetic recording layer was about 0.1 when a blue filter was used at status M of X-light. Saturation magnetization moment of the magnetic recording layer was 4.2 $emu/m^2$, coercive force was 923 Oe, and rectangular ratio was 65%.

3-3) Preparation of a sliding layer

A sliding layer was prepared by coating the following composition so that the coating amount of the solid part of the compound became the following amounts, and dried at 110° C. for 5 min to prepare a sliding layer.

| | |
|---|---|
| Diacetyl Cellulose | 25 $mg/m^2$ |
| $C_6H_{13}CH(OH)C_{10}H_{20}COOC_{40}H_{81}$ (Compound a) | 6 $mg/m^2$ |
| $C_{50}H_{101}O(CH_2CH_2O)_{16}H$ (Compound b) | 9 $mg/m^2$ |

Compound a/Compound b (6/9) were dissolved in xylylene and propylene glycol monomethyl ether solvent (volume ratio: 1/1) by heating at 105° C., this solution was poured into 10 time amount of propylene glycol monomethyl ether (25° C.) and finely dispersed. This was further diluted in 5 time amount of acetone, dispersed again using a high pressure homogenizer and the obtained dispersion (average grain size: 0.01 μm) was added to the coating solution. The obtained sliding layer showed excellent performances of dynamic friction coefficient: 0.06 (a stainless steel hard ball of 5 mmϕ, load: 100 g, speed: 6 cm/min), static friction coefficient: 0.07 (clip method). The sliding property with the surface of the emulsion shown below provided dynamic friction coefficient of 0.12.

4) Coating of a Light-Sensitive Layer and Evaluation

Next, the coating solution having same composition as used in Example 4 was coated on the opposite side of the above obtained backing layer and Sample Nos. 201' to 220' were prepared.

The samples obtained were evaluated in the same manner as in Example 4, the results obtained were the same as in Example 4.

EXAMPLE 6

The sample having the same constitution as Sample No. 102' in Example 4 of JP-A-4-116637 was prepared and this was designated Sample No. 301'. Then, the cyan couplers in the third and fourth layers (ExC-1, ExC-2) of the above sample were replaced with the cyan coupler (1) of the present invention shown in Example 4 so that the color density became equal, and similarly as in Example 4, the compound H-(1) of the present invention was added to the third and fourth layers in an amount of 10 mol % based on the cyan coupler, and this sample was designated Sample No. 302'. Sample No. 303' was prepared by replacing the color mixing preventives in the fifth, eighth and eleventh layers (Cpd-6, Cpd-7, Cpd-14) with the compound H-(16) of the present invention in an equimolar amount and the same evaluation was carried out. In this case, also, almost the same results as in Example 1 were obtained.

EXAMPLE 7

A sample having the same constitution as Sample No. 105 in Example 1 of JP-A-6-337506 was prepared as Sample No. 401'. Next, the cyan coupler in the third layer (ExC-1, ExC-2, ExC-3) of the above sample were replaced with the cyan coupler (33) of the present invention shown in Example 4 so that the color density became equal, and similarly as in Example 4, the compound H-(17) of the present invention was added to the third layer in an amount of 7 mol % based on the cyan coupler, and this sample was designated Sample No. 402'. Sample No. 403' was prepared by replacing the color mixing preventives in the fourth, seventh and ninth layers (Cpd-7, Cpd-17) with the compound H-(17) of the present invention in an equimolar amount and the same evaluation as in Example 4 was carried out. In this case, also, almost the same results as in Example 4 were obtained.

While the invention has been described in detail and with reference to specific examples thereof, it will be apparent to one skilled in the art that various changes and modifications can be made therein without departing from the spirit and scope thereof.

What is claimed is:

1. A silver halide color photographic material comprising a support having thereon one or more constituent layers including at least one silver halide emulsion layer, wherein at least one hydrophilic colloid layer of said constituent layers contains a coupler represented by the following formula (M) or formula (I) and at least one hydrophilic colloid layer of said constituent layers contains a compound represented by the following formula (H):

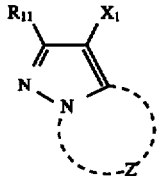

(M)

wherein $R_{11}$ represents a hydrogen atom or a substituent; Z represents a non-metallic atomic group necessary to form a 5-membered azole ring containing from 2 to 4 nitrogen atoms, and said azole ring may have a substituent; and $X_1$ represents a hydrogen atom or a group capable of being eliminated upon a coupling reaction with the oxidized product of a developing agent;

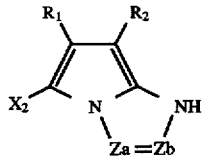

(I)

wherein Za represents —C($R_3$)= or —N=, when Za represents —N=, Zb represents —C($R_3$)= and when Za represents —C($R_3$)=, Zb represents —N=; $R_1$ and $R_2$ each represents an electron attractive group having a Hammett's substitution constant $\sigma_p$ value of from 0.20 to 1.0; $R_3$ represents a substituent; and $X_2$ represents a hydrogen atom or a group capable of being eliminated upon a coupling reaction with an oxidized product of a color developing agent;

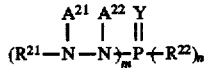

(H)

wherein $R^{21}$ represents an aryl group or a heterocyclic group; $R^{22}$ represents an alkyl group, a cycloalkyl group, an aryl group, an alkoxyl group or an aryloxy group; $A^{21}$ and $A^{22}$ each represents a hydrogen atom or a group being eliminated by alkali; m represents 1, 2 or 3; n represents 0, 1 or 2, the total of m and n is 3, when n represents 2, two groups represented by $R^{22}$ may be the same or different, and they may be bonded to each other to form a cyclic structure containing a phosphorus atom; and Y represents a sulfur atom or an oxygen atom, which may form a dimer or more polymer by bonding at $R^{21}$ or $R^{22}$, provided that $R^{21}$ is not a phenyl group substituted with an acylamino group at the p-position, and when $R^{22}$ represents an unsubstituted phenoxy group, $R^{21}$ is not a phenyl group substituted at the p-position with a substituted or unsubstituted benzenesulfonamido group or a hydroxyl group.

2. A silver halide color photographic material as claimed in claim 1, wherein at least a light-insensitive layer adjacent to the silver halide emulsion layer containing the coupler represented by formula (M) or formula (I) contains the compound represented by formula (H).

3. A silver halide color photographic material as claimed in claim 1, wherein at least the silver halide emulsion layer containing the coupler represented by formula (M) or formula (I) contains the compound represented by formula (H).

4. A silver halide color photographic material as claimed in claim 1, wherein at least the silver halide emulsion layer contains the coupler represented by formula (M) and the compound represented by formula (H).

5. A silver halide color photographic material as claimed in claim 1, wherein at least the silver halide emulsion layer contains the coupler represented by formula (I) and the compound represented by formula (H).

6. A silver halide color photographic material as claimed in claim 1, wherein the compound represented by formula (H) is contained in both the silver halide emulsion layer containing the coupler represented by formula (M) or formula (I) and a light-insensitive layer adjacent to said silver halide emulsion layer.

7. A silver halide color photographic material as claimed in claim 1, wherein the compound represented by formula (H) is contained in both the silver halide emulsion layer containing the coupler represented by formula (M) and a light-insensitive layer adjacent to said silver halide emulsion layer.

8. A silver halide color photographic material as claimed in claim 1, wherein the compound represented by formula (H) is contained in both the silver halide emulsion layer containing the coupler represented by formula (I) and a light-insensitive layer adjacent to said silver halide emulsion layer.

9. A silver halide color photographic material as claimed in claim 1, wherein the coupler represented by formula (M) is represented by formula (M-I), (M-II), (M-III) or (M-IV):

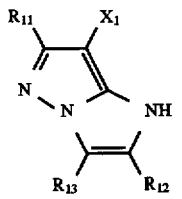
(M-I)

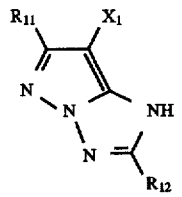
(M-II)

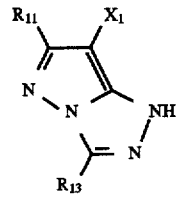
(M-III)

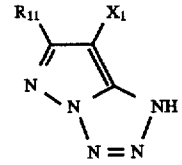
(M-IV)

wherein $R_{11}$, $R_{12}$ and $R_{13}$ represents a hydrogen atom, a halogen atom, an alkyl group, an aryl group, a heterocyclic group, a cyano group, a hydroxyl group, a nitro group, a carboxyl group, an amino group, an alkoxyl group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a sulfonyl group, an aryloxycarbonyl group, an acyl group, or an azolyl group, and $R_{11}$, $R_{12}$ and $R_{13}$ may be a divalent group to form a bis form, and $X_1$ represents a hydrogen atom or a group capable of being eliminated upon reaction with an oxidized product of an aromatic primary amine color developing agent.

10. A silver halide color photographic material as claimed in claim 1, wherein $R_{11}$ represents a hydrogen atom, a halogen atom, an alkyl group, an aryl group, a heterocyclic group, a cyano group, a hydroxyl group, a nitro group, a carboxyl group, an amino group, an alkoxyl group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a sulfonyl group, an aryloxycarbonyl group, an acyl group, or an azolyl group, and $R_{11}$ may be a divalent group to form a bis form.

11. A silver halide color photographic material as claimed in claim 1, wherein $X_1$ represents a halogen atom, an alkoxyl group, an aryloxy group, an acyloxy group, an alkyl- or arylsulfonyloxy group, an acylamino group, an alkyl- or arylsulfonamido group, an alkoxycarbonyloxy group, an aryloxycarbonyloxy group, an alkyl-, aryl- or heterocyclic thio group, a carbamoylamino group, a 5- or 6-membered nitrogen-containing heterocyclic group, an imido group or an arylazo group.

12. A silver halide color photographic material as claimed in claim 1, wherein a coupler represented by formula (I) is represented by formulas (II) or (III):

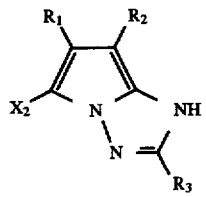
(II)

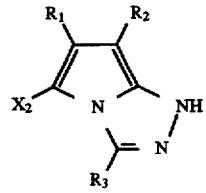
(III)

wherein $R_1$ and $R_2$ each represents an electron attractive group having a Hammett's substitution constant $\sigma_p$ value of from 0.20 to 1.0 and $R_3$ represents a substituent.

13. A silver halide color photographic material as claimed in claim 1, wherein $R_1$ and $R_2$ represent an acyl group, an acyloxy group, a carbamoyl group, an aliphatic oxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, an alkyl group substituted with at least two halogen atoms, an alkoxyl group substituted with at least two halogen atoms, an aryloxy group substituted with at least two halogen atoms, an alkylamino group substituted with at least two halogen atoms, an alkylthio group substituted with at least two halogen atoms, an aryl group substituted with an electron attractive group having $\sigma_p$ value of 0.20 or more, a heterocyclic group, a chlorine atom, a bromine atom, an azo group or a selenocyanate group.

14. A silver halide color photographic material as claimed in claim 1, wherein $R_3$ represents a halogen atom, an aliphatic group, an aryl group, a heterocyclic group, a cyano group, a hydroxyl group, a nitro group, a carboxy group, an amino group, an alkoxyl group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an acyloxycarbonyl group, an acyl group, or an azolyl group.

15. A silver halide color photographic material as claimed in claim 1, wherein the compound represented by formula (I) is represented by formula (V):

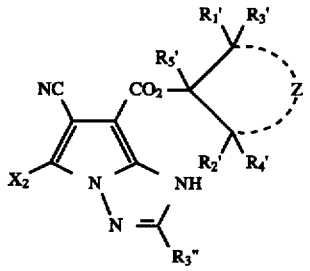

(V)

wherein $R_1'$ and $R_2'$ represent an aliphatic group, $R_3'$, $R_4'$ and $R_5'$ represent a hydrogen atom or an aliphatic group, $X_2$ represents a hydrogen atom or a group capable of being eliminated upon a coupling reaction with an oxidized product of a color developing agent, Z represents a non-metallic atomic group necessary to form a 5- to 8-membered ring, which may be substituted, saturated, or contain an unsaturated bond, and $R_3''$ represents an aliphatic group or an aryl group.

16. A silver halide color photographic material as claimed in claim 1, wherein in $R^{21}$, the aryl group has from 6 to 30 carbon atoms and the heterocyclic group is a 3 to 8-membered ring containing an oxygen atom, a nitrogen atom or a sulfur atom as a heteroatom.

17. A silver halide color photographic material as claimed in claim i, wherein in $R^{22}$, the alkyl group has 1 to 60 carbon atoms and is substituted or unsubstituted; the cycloalkyl group has 3 to 60 carbon atoms and is substituted or unsubstituted, the alkoxy group has an alkyl moiety which is substituted or unsubstituted and has from 1 to 60 carbon atoms, and the aryloxy group has 7 or more carbon atoms.

18. A silver halide color photographic material as claimed in claim 1, wherein the compounds represented by formula (H) are represented by formula (H-A):

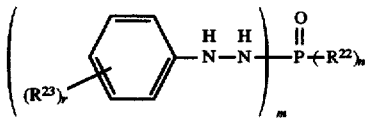

(H-A)

wherein $R^{22}$ represents an alkyl group, a cycloalkyl group, an aryl group, an alkoxy group or an aryloxy group $R^{23}$ represents a substituent group with the proviso that $R^{23}$ does not represent an acylamino group substituted on the phenyl ring at a position para to the —NH—NH— group and with the proviso that when $R^{22}$ represents an unsubstituted phenoxy group, $R^{23}$ is not a substituted or unsubstituted benzenesulfonamido group or a hydroxyl group substituted at the p-position, m represents 1, 2 or 3, n represents 0, 1 or 2, the total of m and n is 3, when n represents 2, two groups represented by $R^{22}$ may be the same or different, and they may be bonded to each other to form a cyclic structure containing a phosphorus atom, and r represents an integer of from 1 to 5, and when r is 2 or more, a plurality of groups represented by $R^{23}$ may be the same or different, and the adjacent groups of $R^{23}$ may be connected to each other to form a cyclic structure.

19. A process for processing an imagewise exposed silver halide color photographic material comprising color developing the silver halide color photographic material and then black-and-white developing, wherein the silver halide color photographic material comprises a support having thereon one or more constituent layers including at least one silver halide emulsion layer, in which at least one hydrophilic colloid layer of said constituent layers contains a coupler represented by the following formula (M) or formula (I) and at least one hydrophilic colloid layer of said constituent layers contains a compound represented by the following formula (H):

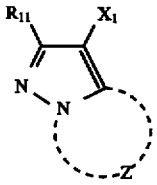

(M)

wherein $R_{11}$ represents a hydrogen atom or a substituent; Z represents a non-metallic atomic group necessary to form a 5-membered azole ring containing from 2 to 4 nitrogen atoms, and said azole ring may have a substituent; and $X_1$ represents a hydrogen atom or a group capable of being eliminated upon a coupling reaction with the oxidized product of a developing agent;

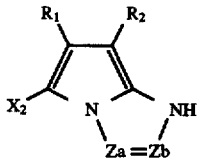

(I)

wherein Za represents —C($R_3$)= or —N=, when Za represents —N=, Zb represents —C($R_3$)= and when Za represents —C($R_3$)=, Zb represents —N=; $R_1$ and $R_2$ each represents an electron attractive group having a Hammett's substitution constant $\sigma_p$ value of from 0.20 to 1.0; $R_3$ represents a substituent; and $X_2$ represents a hydrogen atom or a group capable of being eliminated upon a coupling reaction with an oxidized product of a color developing agent;

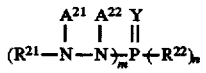

(H)

wherein $R^{21}$ represents an aryl group or a heterocyclic group; $R^{22}$ represents an alkyl group, a cycloalkyl group, an aryl group, an alkoxyl group or an aryloxy group; $A^{21}$ and $A^{22}$ each represents a hydrogen atom or a group being eliminated by alkali; m represents 1, 2 or 3; n represents 0, 1 or 2, the total of m and n is 3, when n represents 2, two groups represented by $R^{22}$ may be the same or different, and they may be bonded to each other to form a cyclic structure containing a phosphorus atom; and Y represents a sulfur atom or an oxygen atom, which may form a dimer or more polymer by bonding at $R^{21}$ or $R^{22}$, provided that $R^{21}$ is not a phenyl group substituted with an acylamino group at the p-position, and when $R^{22}$ represents an unsubstituted phenoxy group, $R^{21}$ is not a phenyl group substituted at the p-position with a substituted or unsubstituted benzenesulfonamido group or a hydroxyl group.

20. A process for processing a silver halide color photographic material as claimed in claim 19, wherein said silver halide color photographic material is subjected to imagewise exposure and black-and-white development processing, and then processed with a color developing solution having pH of 11 or more.

* * * * *